United States Patent [19]

Denda

[11] Patent Number: 4,674,269

[45] Date of Patent: Jun. 23, 1987

[54] WRAPPING MACHINE

[75] Inventor: Toshio Denda, Tokyo, Japan

[73] Assignee: Teraoka Seiko Co., Limited, Tokyo, Japan

[21] Appl. No.: 769,100

[22] Filed: Aug. 26, 1985

[30] Foreign Application Priority Data

| | | | |
|---|---|---|---|
| Aug. 31, 1984 | [JP] | Japan | 59-182466 |
| Sep. 29, 1984 | [JP] | Japan | 59-204743 |
| Sep. 29, 1984 | [JP] | Japan | 59-204744 |

[51] Int. Cl.[4] ..... B65B 11/18

[52] U.S. Cl. ..... 53/502; 53/556; 53/228

[58] Field of Search ..... 53/502, 556, 228, 230, 53/206

[56] References Cited

U.S. PATENT DOCUMENTS

| | | | |
|---|---|---|---|
| 2,597,041 | 5/1952 | Stokes | 53/556 X |
| 2,914,893 | 12/1959 | Berst | 53/556 |
| 3,662,513 | 5/1972 | Fabbri . | |
| 3,967,433 | 7/1976 | Bonfiglioli . | |
| 4,178,740 | 12/1979 | Groom | 53/228 |
| 4,199,697 | 3/1979 | Suga | 53/556 |
| 4,458,470 | 7/1984 | Fine | 53/502 |
| 4,501,106 | 2/1985 | Treiber et al. . | |
| 4,513,558 | 4/1985 | Treiber | 53/556 |
| 4,520,613 | 6/1985 | Gaudio | 53/556 X |

*Primary Examiner*—John Sipos
*Attorney, Agent, or Firm*—Armstrong, Nikaido, Marmelstein & Kubovcik

[57] ABSTRACT

A wrapping machine includes a mechanism for feeding a stretchable film, means for lift an article to be wrapped, a mechanism for underfolding the film, means for controlling the timing at which various elements of the wrapping machine are actuated, and means for adjusting the tension of the film. The film feeding mechanism clamps opposite edge portions of the film, which has been cut to a predetermined length, by a plurality of grippers to apply a prescribed tension to the film and extend the film at a predetermined position of the wrapping machine. The article lifting means is adapted to raise an article to be wrapped, which has been fed in by infeed conveyance means, into taut engagement with the film extended at the predetermined position. The film folding mechanism includes left and right folding plates disposed above the cut length of extended film at positions having left-right symmetry with respect to the article feed-in direction for underfolding left and right edge portions of the film covering the article from above, a front folding plate and a rear folding member disposed at positions perpendicular to the left and right folding plates for underfolding front and rear edge portions of the film, the left, right and front folding plates and the rear folding member defining a generally rectangular opening, and sliding means for moving the left, right and front folding plates toward the center of the opening. The film tension adjusting means adjusts the tension of the film wrapping the article by regulating the cut length of film in dependence upon the size of the article to be wrapped and by regulating the timing at which the grippers release their hold on the opposite edge portions of the film.

15 Claims, 92 Drawing Figures

Fig.29

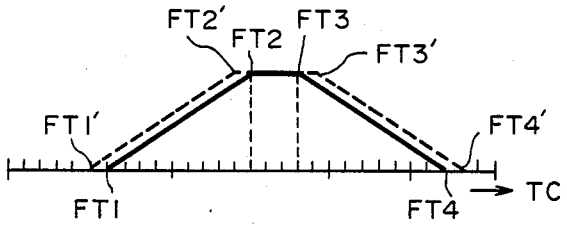

Fig.30

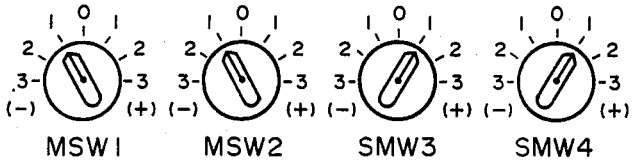

Fig.31(A)

123a

TC

TMa

| | |
|---|---|
| FRONT FOLDING PLATE CLOSING OPERATION START (FT1) | 6 |
| FRONT FOLDING PLATE CLOSING OPERATION STOP (FT2) | 15 |
| FRONT FOLDING PLATE OPENING OPERATION START (FT3) | 18 |
| FRONT FOLDING PLATE OPENING OPERATION STOP (FT4) | 27 |

Fig.31(B)

123b

TC

TRMa

| | |
|---|---|
| FRONT FOLDING PLATE CLOSING OPERATION START (FT1') | 5 |
| FRONT FOLDING PLATE CLOSING OPERATION STOP (FT2') | 14 |
| FRONT FOLDING PLATE OPENING OPERATION START (FT3') | 19 |
| FRONT FOLDING PLATE OPENING OPERATION STOP (FT4') | 28 |

Fig. 37
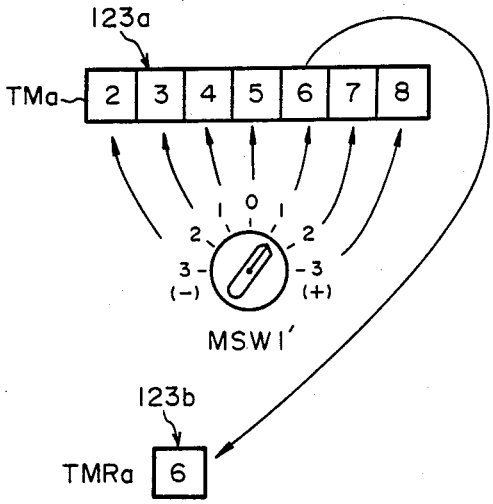
Fig.38(A)
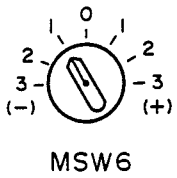
Fig. 38(B)
| GRADUATION POSITION | -3 | -2 | -1 | 0 | 1 | 2 | 3 |
|---|---|---|---|---|---|---|---|
| NUMERICAL VALUE DATA | -2 | -1 | -1 | 0 | 0 | 1 | 1 |
| TIME INFORMATION Tm | 1 | 0 | 1 | 0 | 1 | 0 | 1 |
Fig. 39
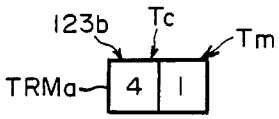

| NUMBER OF SENSORS OPERATING | | S6 ON | S7 ON |
|---|---|---|---|
| 2 | a | a | b |
| 3 | a | b | c |
| 4 | b | c | d |
| 5 | c | d | e |

| | TCa | TCb | TCc | TCd |
|---|---|---|---|---|
| a | 7(8) | 11(12) | 21 | 25 |
| b | 6(7) | 10(11) | 23 | 26 |
| c | 5(6) | 9(10) | 25 | 27 |
| d | 4(5) | 8(9) | 26 | 28 |
| e | 3(4) | 7(8) | 29 | 29 |

TCa : LEFT-AND RIGHT-SIDE CLAMPING MECHANISM RELEASE TIMING

TCb : CENTRAL FRONT-SIDE CLAMPING MECHANISM RELEASE TIMING

TCc : FILM CUT TIMING

TCd : CHAIN CONVEYOR STOP TIMING

Fig.50

| | SZ1 | SZ2 | SZ |
|---|---|---|---|
| L | 0 | 0 | 0 |
| | 1 | 0 | 1 |
| H | 1 | 1 | 2 |

SZ1, SZ2 : HEIGHT SENSORS

Fig.51

| NUMBER OF SXs ACTUATED | NUMBER OF SZs ACTUATED | | |
|---|---|---|---|
| | 0 | 1 | 2 |
| 2 | a | a | b |
| 3 | a | b | c |
| 4 | b | c | d |
| 5 | c | d | e |

a ~ e : LENGTHS OF FILM CUT
SX : WIDTH SENSOR

Fig.52

| NUMBER OF SYs ACTUATED | SIZE OF Y |
|---|---|
| 1 | a |
| 2 | b |
| 3 | c |
| 4 | d |

a ~ d : LONGITUDINAL LENGTHS OF TRAYS
SY : LENGTH SENSOR

Fig.53

Z = L

| Fℓ | TCa | TCc | TCd |
|---|---|---|---|
| a | 7 | 21 | 25 |
| b | 6 | 23 | 26 |
| c | 5 | 25 | 27 |
| d | 4 | 27 | 28 |
| e | 3 | 29 | 29 |

Fℓ : CUT LENGTH OF FILM
TCa : LEFT-AND RIGHT-SIDE CLAMPING MECHANISM RELEASE TIMING
TCd : CHAIN CONVEYOR STOP TIMING
TCc : FILM CUT TIMING

Fig.54

Z = L

| TYℓ | TCb |
|---|---|
| a | 11 |
| b | 10 |
| c | 9 |
| d | 8 |

TYℓ : LENGTH OF TRAY
TCb : CENTRAL FRONT-SIDE CLAMPING MECHANISM RELEASE TIMING

Fig. 55

Z = H

| Fℓ | TCa | TCc | TCd |
|---|---|---|---|
| a | 6 | 21 | 25 |
| b | 5 | 23 | 26 |
| c | 4 | 25 | 27 |
| d | 3 | 27 | 28 |
| e | 2 | 29 | 29 |

Fig. 56

Z = H

| TYℓ | TCb |
|---|---|
| a | 10 |
| b | 9 |
| c | 8 |
| d | 7 |

Fig.63

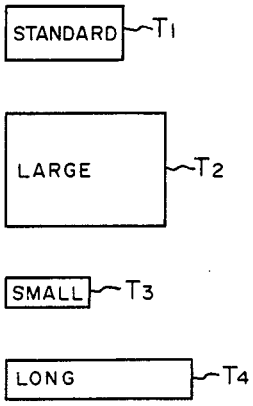

Fig.64

| SW3 \ SW1 | 1 | 2 | 3 | 4 | 5 |
|---|---|---|---|---|---|
| STANDARD | A | B | C | D | E |
| LARGE | C | D | D | E | E |
| SMALL | A | A | A | B | B |
| LONG | D | D | E | E | E |

A~E : LENGTHS OF FILM CUT
SW1 : FILM LENGTH SELECTION SWITCH
SW3 : TRAY TYPE CHANGEOVER SWITCH

Fig. 65

| SW3 | STANDARD | | | | | LARGE | | | | | SMALL | | | | | LONG | | | | |
|---|---|---|---|---|---|---|---|---|---|---|---|---|---|---|---|---|---|---|---|---|
| SW2 / SW1 | 1 | 2 | 3 | 4 | 5 | 1 | 2 | 3 | 4 | 5 | 1 | 2 | 3 | 4 | 5 | 1 | 2 | 3 | 4 | 5 |
| 1 | – | – | a | – | – | – | – | a | – | – | – | – | d | – | – | – | – | a | – | – |
| 2 | – | – | b | – | – | – | – | a | – | – | – | – | d | – | – | – | – | a | – | – |
| 3 | – | – | c | – | – | – | – | b | – | – | – | – | d | – | – | – | – | a | – | – |
| 4 | – | – | d | – | – | – | – | b | – | – | – | – | e | – | – | – | – | b | – | – |
| 5 | – | – | e | – | – | – | – | b | – | – | – | – | e | – | – | – | – | b | – | – |

SW2 : FILM TENSION ADJUSTMENT SWITCH
a~e : CENTRAL FRONT-, LEFT-AND RIGHT-SIDE CLAMPING MECHANISM RELEASE TIMING

Fig.66

| Fℓ | A | B | C | D | E |
|---|---|---|---|---|---|
| Tm | 6 (30°) | 8 (40°) | 8 (40°) | 8 (40°) | 10 (50°) |

Fℓ : CUT FILM LENGTH
Tm : LEFT AND RIGHT FOLDING PLATE OPERATING TIMING VALUE (PULSE COUNT VALUE)

WRAPPING MACHINE

BACKGROUND OF THE INVENTION

This invention relates to a wrapping machine for wrapping items in stretchable films.

Many years have passed since the introduction of practical wrapping machines wherein containers or trays made of resin materials such as foamed styrene are supplied with various articles and then wrapped individually in transparent stretchable film. During this period a variety of wrapping machines have been proposed and improved upon.

Wrapping machines for wrapping articles in stretchable film on a tray-by-tray basis are equipped with various means for avoiding a wasteful wrapping operation while at the same time improving the appearance of the wrapped package. In particular, to obtain a wrapped package having an attractive appearance, means of paramount importance are a film folding mechanism for folding the stretchable film under the tray bearing the items to be packaged, a control mechanism for adjustably controlling the timing at which various operating units constituting the wrapping machine are actuated, and a film tension adjusting mechanism for adjusting the tension of the stretchable film stretched over the items on the tray.

Almost all of the conventional film folding mechanisms for folding the stretchable film under the trays include such elements as left and right folding plates and a front folding plate. These elements are mechanically coupled with a source of drive via a mechanism such as a drank link and are adapted to be actuated by power transmitted from the drive source. An example of such a wrapping machine is disclosed in the specification of Japanese Patent Application Laid-Open No. 58-160230. The disclosed wrapping machine includes left and right folding plates which perform arcuate motion, each folding plate being provided with a guide groove, and a front folding plate having rollers arranged in the guide grooves so that the front folding plate operates in tandem with the left and right folding plates.

The above-described prior-art folding mechanism has a number of drawbacks. Specifically, since the stretchable film covering the items on a tray is folded under the tray by being squeezed and pressed by the left and right folding plates and the rollers of the front folding plate, the film develops a large number of creases and wrinkles that detract from the appearance of the final package. Moreover, there are cases where the items being wrapped become jammed in the folding mechanism. Since the various operating elements of the conventional folding mechanism are mechanically coupled with the drive source via the mechanism such as the crank link, the drive source must be operated by hand to move the operating elements when such jamming occurs in order to permit removal of the items that have been turned over or that have becomed jammed in the machine. These operating elements must then be returned to their original positions following removal of the items, after which the machine is restarted. Thus, restoring the machine to operation is a difficult and time-consuming task.

Since the left and right folding plates and the front folding plate are mechanically connected, the timing at which each folding plate is started cannot be adjusted independently of the others. By way of example, assume that the tray which receives the articles to be wrapped is comparatively small. In such case, the opening formed by the folding plates will be too large in comparison with the size of the tray, with the result that opposing edges of the film cannot be folded under the tray in reliable fashion even though the left and right folding plates are actuated. The results will be the same even if the film is cut to a small length.

The conventional control mechanism for controlling the operation timing of the elements constituting the wrapping machine relies upon mechanical means composed mainly of a combination of various cams. In addition, analog-type means such as a volume resistor are used to set the cut length of film and well as the operation timing of the left, right and front folding plates.

The method of adjusting the operation timing of the various wrapping machine elements by relying upon the cam mechanism involves difficulties in terms of on-site assembly, adjustment and maintenance. These operations cannot be performed well unless done by one having special skills. Another disadvantage is that since the wrapping machines manufactured cannot provide a uniform mechanical timing from one machine to another owing to the machining precision of the component parts and errors in assembly, mechanical adjustments must be made on all such occasions. The result is a decline in operation efficiency. Problems are also encountered in the analog means such as the volume resistor for setting the cut length of the film and the operation timing of the folding plates. Specifically, not only is it difficult to make the adjustments when the wrapping machine is assembled, but a difficult readjustment is necessary whenever the machine becomes maladjusted.

The conventional means for adjusting the tension of the stretchable film convering the articles in the tray includes a clamping mechanism and a lifting mechanism. When the stretchable film cut to predetermined dimensions is extended over substantially the center of the wrapping machine, the edges of the stretchable film are held fast by the clamping mechanism and the articles to be wrapped are raised into stretching engagement with the stretchable film by the lifting mechanism, whereby the stretchable film covering the articles is stretched and brought into intimate contact with the articles. When the edges of the stretchable film are subsequently folded under the tray by the folding mechanism, the clamping mechanism is actuated at a predetermined timing to release its hold on the edges of the stretchable film. This leaves the stretchable film of the package in the stretched state. However, since the stretched state of the film wrapping the package is influenced by the dimensions of the film as well as such dimensions as the length, width and height of the articles to be wrapped, the final wrapped packages produced by the wrapping machine using the conventional tension adjusting method lack a uniform appearance due to the size of the articles wrapped.

SUMMARY OF THE INVENTION

The present invention has been devised in view of the foregoing circumstances and its object is to provide an easily adjustable and operable wrapping machine capable of providing attractively wrapped packages irrespective of the size of the items wrapped and without waste.

According to the present invention, the foregoing object is attained by providing a wrapping machine for wrapping an article in a stretchable film by extending a stretchable film cut to predetermined dimensions at a predetermined position in the wrapping machine and raising the article, which has been fed in to a point below the stretchable film, into contact with the stretchable film. The wrapping apparatus comprises a film folding mechanism, a control mechanism and a film tension adjusting mechanism.

The film folding mechanism includes left and right folding plates arranged to oppose each other at right angles to the direction of article conveyance above the extended stretchable film for folding opposed left and right edges of the stretchable film under the article, a front folding plate arranged at a position at right angles to the left and right folding plates for folding the front edge of the stretchable film under the article, a rear folding roller arranged at a position at right angles to the left and right folding plates and opposing the front folding plate for folding the rear edge of the stretchable film under the article, the left, right and front folding plates and the rear folding roller forming a generally rectangular opening, first sliding means for moving the left and right folding plates toward and away from the center of the opening after the article is raised into contact with the stretchable film, second sliding means for moving the front folding plate toward and away from the rear folding roller, and control means for independently driving the left and right folding plates and the front folding plate.

The control mechanism comprises timing signal generating means for generating a timing signal in synchronism with rotation of a main power section driving the wrapping machine, basic timing data memory means for storing basic operating times, which are necessary for operating time adjustment, of various operating elements of the wrapping machine, each of the basic operating times being stored as a counted value indicative of the number of timing signals generated, manipulatable control means for adjustment provided for corresponding operating elements for adjusting the operating time of these operating elements, operating time data memory means for storing data indicative of the operating time of each operating element, and control means for determining operating time data for each of the operating elements on the basis of data from the basic timing data memory means and data from the manipulatable control means, storing the operating time data in the operating time data memory means, counting the timing signals from the timing signal generating means, and, when the value of the count and the operating time data for a particular one of the operating elements stored in the operating time data memory means attain a predetermined relationship, actuating the particular operating element.

The film tension adjusting mechanism includes left, right and central clamping mechanisms for clamping the stretchable film at left, right and central portions in the width direction thereof. When the stretchable film covering the article from above is folded under the article, a time difference between the time at which the left and right folding plates start operating and the time at which the left and right clamping mechanisms release the stretchable film is adjusted on the basis of the width of the article or the cut length of the stretchable film. The film tension adjusting mechanism also adjusts, based on the dimensions of the article to be wrapped, a time difference between the time at which the front folding plate starts operating and a time at which the central clamping mechanism releases the stretchable film.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 1 through 3 are views illustrating the overall structure of a wrapping machine according to the present invention, in which FIG. 1 is a plan view, FIG. 2 is a longitudinal sectional front view (as seen from the direction of the arrow A in FIG. 1), and FIG. 3 is a longitudinal sectional side view (as seen from the direction of the arrow B in FIG. 1);

FIGS. 6 and 7 are views illustrating the structure of a film clamping mechanism, in which FIG. 6 is a sectional view showing a gripper portion and FIG. 7 is a partial side view showing the relation between a movable guide member and gripper;

FIG. 29 is a mechanical chart showing the operation timing of a front folding plate;

FIG. 30 is a view showing an example of switches for adjusting the operation timing of the front folding plate;

FIGS. 31(A), 31(B) are views schematically illustrating a basic timing storage area of a ROM and an operation timing register of a RAM, respectively;

FIG. 37 is a view showing the basic timing storage area of the ROM as well as the relationship between an adjustment switch and the operation timing register of the RAM;

FIGS. 38(A), 38(B) are views schematically showing an adjustment switch and a timing register of the RAM;

FIG. 39 is a view schematically showing the operation timing register of the RAM;

FIG. 50 is a table showing the relationship between a height sensor and article height subdivisions;

FIG. 51 is a table showing the relationship among a width sensor, height sensor and film cut-length subdivisions a through e;

FIG. 52 is a table showing the relation between a length sensor and length subdivisions;

FIG. 53 is a view showing the relationship between film cut length Fl for a case where the height Z of the article to be wrapped is equal to L (i.e., Z=L) and timing subdivisions indicating timings TCa, TCc, TCd at which left and right clamping mechanisms are released, a chain conveyor is stopped at the film is cut, respectively;

FIG. 54 is a view showing the relationship between tray length TYl for the case where Z=L and timing TCb at which a central front clamping mechanism is released;

FIG. 55 is a view showing the relationship between film cut length Fl for a case where the height Z of the article to be wrapped is equal to H (i.e., Z=H) and timings TCa, TCc, TCd at which the left and right clamping mechanisms are released, the chain conveyor is stopped at the film is cut, respectively;

FIG. 56 is a view showing the relationship between tray length TYl for the case where Z=H and timing TCb at which the central front clamping mechanism is released;

FIG. 63 is a view showing various trays;

FIG. 64 is a table showing the relationship among a film length selection switch, tray type changeover switch and film cut length subdivisions;

FIG. 65 is a table showing the relationship among a film cut length selection switch, a film tension adjustment switch, a tray type changeover switch and timings at which a central front clamping mechanism and left and right clamping mechanisms are released;

FIG. 66 is a table showing the relationship between a cut length of film and the operation timings of left and right folding plates;

DESCRIPTION OF THE PREFERRED EMBODIMENT

Figure 1:
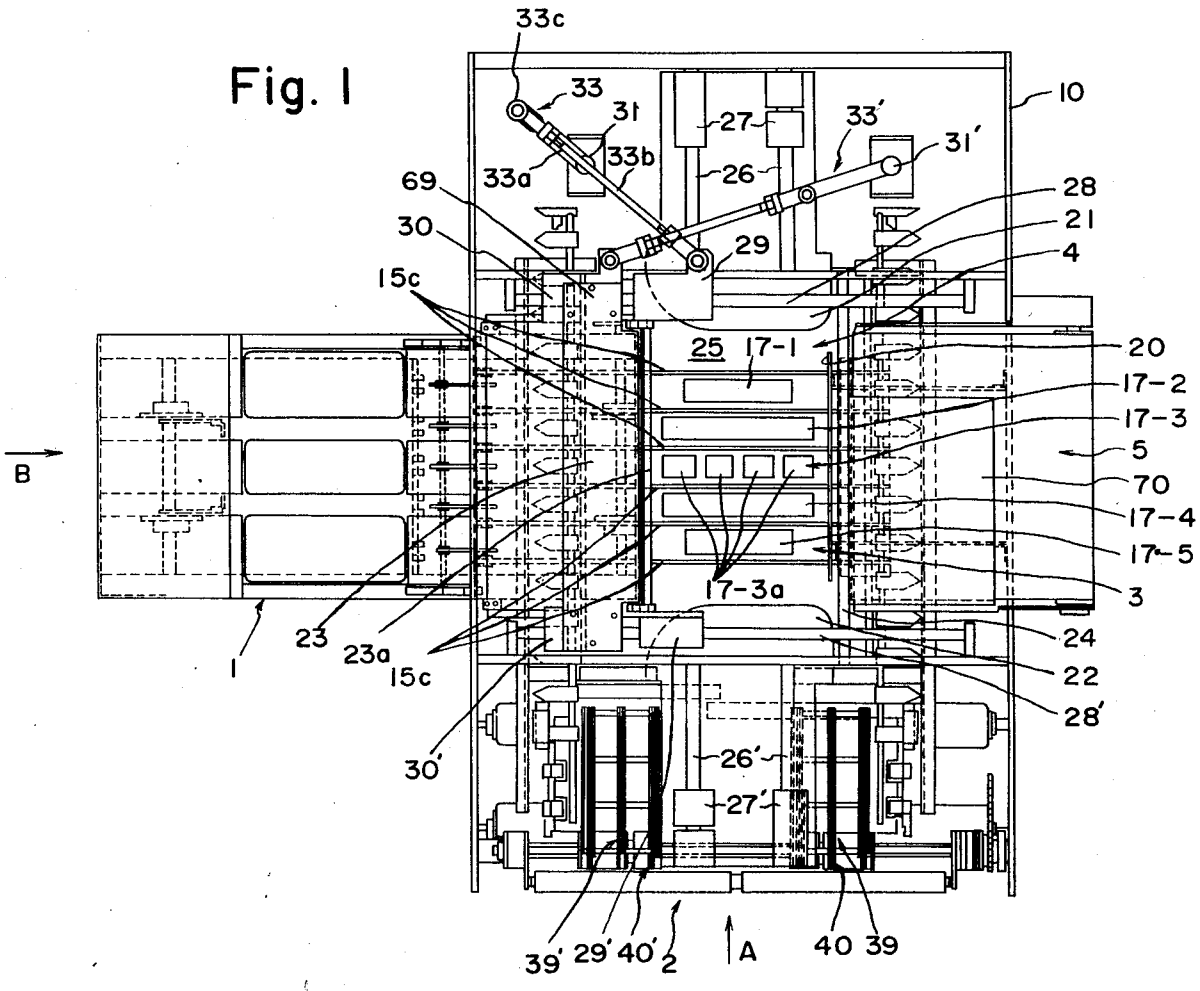
Figure 2:
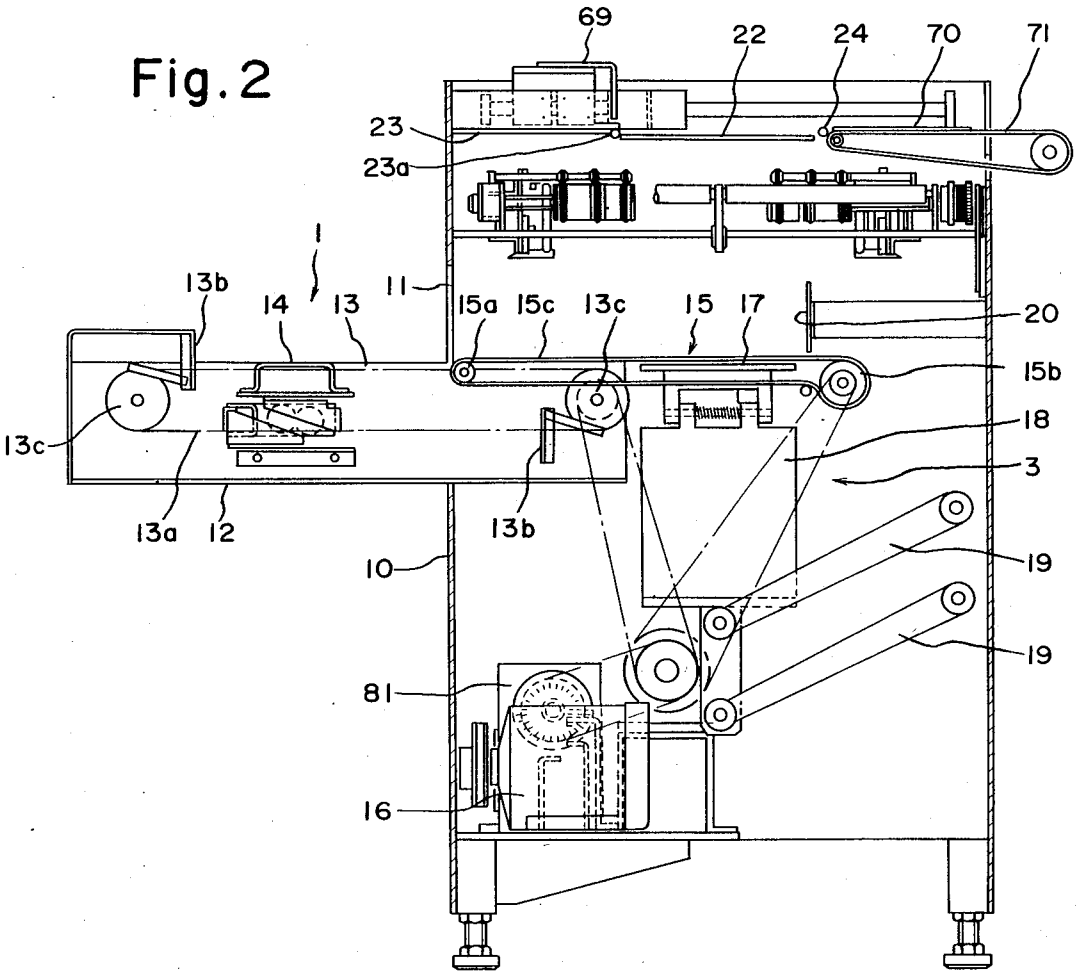
Figure 3:
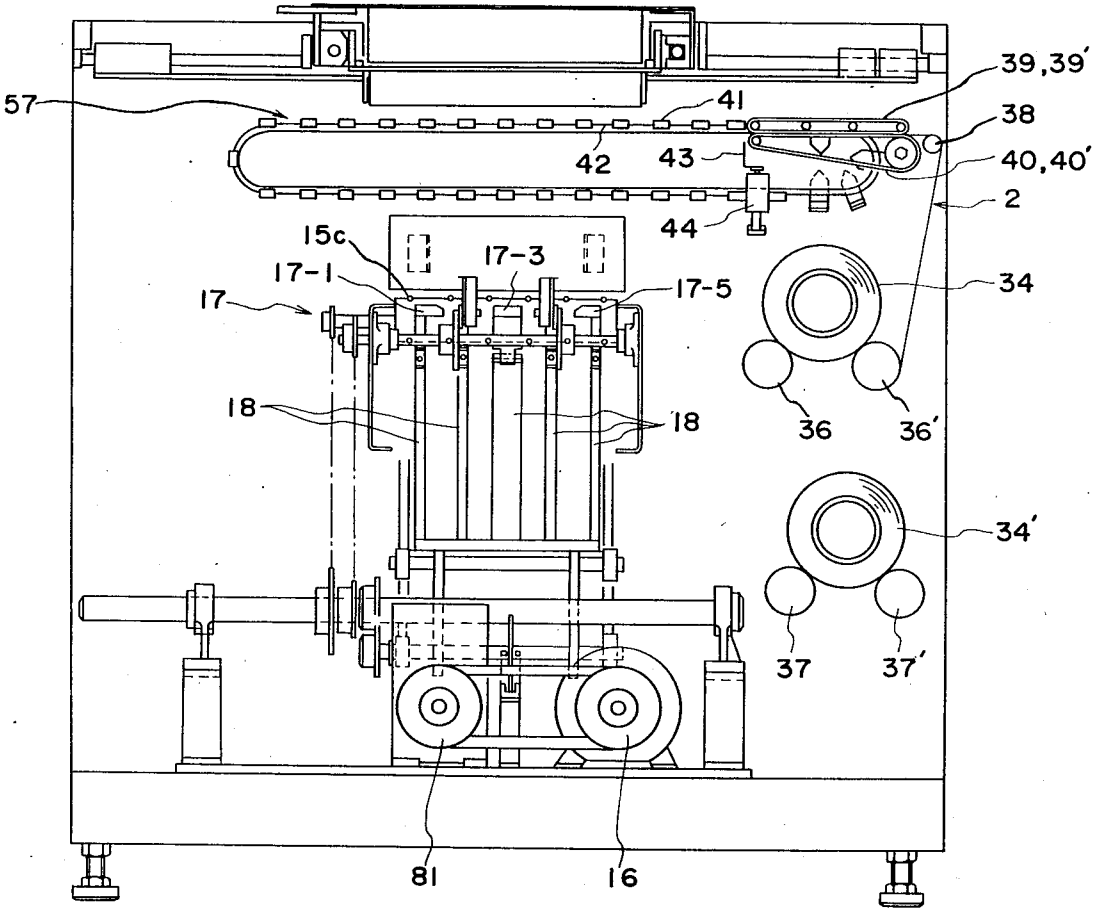

Referring first to FIGS. 1 through 3 illustrating the overall structure of the present invention, there is shown a wrapping machine comprising an infeed conveyance mechanism 1 for feeding in articles to be wrapped, a film feeding mechanism 2 for unreeling and feeding a stretchable film, an elevator mechanism 3 for raising an article to be wrapped, which has been fed in by the infeed conveyance mechanism 1, into stretching engagement with a length of the stretchable film delivered by the film feeding mechanim 2, a folding mechanism 4 for folding the opposing left and right edges as well as the front and rear edges of a cut length of the stretchable film, which covers the article to be wrapped, under the tray carrying the article, and an outfeed conveyance mechanism 5 for feeding out the article which has been wrapped by having the stretchable film folded thereunder by the folding mechanism 4.

The foregoing mechanisms will now be described in detail. For the sake of the description, the left and right sides of FIG. 1 shall be referred to as the front side and rear sides of the wrapping machine, respectively, and the upper and lower sides of FIG. 1 shall be referred to as the left and right sides of the wrapping machine, respectively. Therefore, the left, right, front and rear edges of a cut length of stretchable film mentioned hereinbelow will correspond to the left, right, front and rear sides of the wrapping machine as defined above.

The wrapping machine has a machine frame 10 the front side of which is provided with a generally centrally located infeed opening 11 having an infeed frame 12 in which a pusher conveyor 13 is arranged. The pusher conveyor 13 includes a pair of endless chains 13*a* (see also FIG. 12) provided with two pushers 13*b* at predetermined locations, and two sprockets 13*c*, 13*c* engaging with the respective endless chains 13*a*, 13*a* for driving the pusher conveyor 13, the arrangement being such that a single article to be wrapped is fed every half revolution of the endless chains. A weigher 14 is arranged on the front side of the pusher conveyor 13 for measuring the weight of the article fed in by the conveyor. Arranged downstream of the pusher conveyor 13 is a belt conveyor 15 for carrying the article fed in by the pusher conveyor 13 to an elevator bed 17 of the elevator mechanism 3. The belt conveyor 15, which comprises freely rotatably rollers 15*a*, 15*b* and six round rubber belts 15*c* stretched between the rollers 15*a*, 15*b*, is driven rotatably by power from a motor 16. The pusher conveyor 13, belt conveyor 15 and the elements associated therewith constitute the infeed conveyance mechanism 1.

The elevator mechanism 3 comprises the elevator bed 17, a mount 18 for attaching the elevator bed 17, and a pair of frames 19, 19 supporting the mount 18, and is adapted to be moved up and down at a predetermined timing via a reduction gear mechanism 81 in response to rotation of the motor 16. The timing for the vertical motion performed by elevator mechanism 3 is set by the shape of a cam in a cam mechanism, described below, which acts in a mechanism for transmitting power from the motor 16 to the mount 18.

The elevator bed 17 raises the article to be wrapped, which has been fed in by the pusher conveyor 13 and belt conveyor 15, up to the position of the folding mechanism 4. To accomplish this, the position occupied by the vertically travelling elevator bed 17 when the bed is at the lowermost end of is stroke is set to be substantially level with the conveying surface of the belt conveyor 15. The position occupied by the elevator bed 17 at the uppermost end of its stroke is set to lie substantially in the same plane as left, right and front folding plates 21, 22, 23, respectively, which are described below and which constitute the aforementioned folding mechanism 4.

As shown in FIGS. 1 through 3, the elevator bed 17 is composed of blade-shaped slats 17-1 through 17-5, and the mount 18 is composed of individual slats separated from one another to correspond to the slats 17-1 through 17-5 of the elevator bed. Thus, the arrangement is such that the elevator bed 17 and mount 18 will not strike the rubber belts 15*c* of belt conveyor 15 when the elevator bed 17 is moved up and down. The central slat 17-3 of the elevator bed 17 is split into a plurality of small slats 17-3*a* each of which is urged into an upstanding attitude at all times by biasing means, not shown, but which are forcibly reclined to the right in FIG. 1 by a force applied from the left in the same Figure. The slats 17-1, 17-2 located on the upper side of the central slat 17-3 as seen in FIG. 1 are forcibly reclined downwardly in FIG. 1 by a force applied from above in the same Figure. The slats 17-4, 17-5 located on the lower side of the central slat 17-3 as seen in FIG. 1 are forcibly reclined upwardly in FIG. 1 by a force applied from below in the same Figure. Such an arrangement enables a stretchable film to be folded smoothly under an article by the folding mechanism 4 in a manner set forth below.

As shown in FIGS. 1 and 2, a positioning plate 20 for positioning an article to be wrapped is provided in back of the elevator bed 17. The plate 20 serves to position the article, which has been conveyed into place by the belt conveyor 15, by contacting the rear edge of the article.

As shown in FIG. 3, the feed mechanism 2 for unreeling and feeding the stretchable film is adapted to unreel a continuous web of stretchable film from stretchable film supply rolls 34, 34' provided on the right side of the wrapping machine and to feed the film by gripping it at the longitudinal side edges thereof. The stretchable film supply rolls 34, 34' on which there are wound continuous webs of stretchable films of different width, are supported by pairs of support rollers 36, 36' and 37, 37', respectively, with the supply roll 34 or 34' being selected for use depending upon the size of the article to be wrapped. The upper stretchable film supply roll 34 is shown to be in use in the example of FIG. 3.

The continuous web of stretchable film unreeled from the stretchable film supply roll 34 is drawn out via the right support roller 36', introduced through a delivery roller 38 and fed by being embraced at its longitudinally extending side edges between upper delivery belts 39, 39' and lower delivery belts 40, 40'. The stretchable film embraced by the upper and lower delivery belts 39, 39'; 40, 40' is delivered up to the forward ends of these belts by the circulation thereof. The stretchable film is subsequently embraced at its longitudinally extending edge portions between grippers 41, 41' of respective chain conveyors 57, 57', described below, and round rubber belts 42, 42' so that a predetermined length of the film necessary for wrapping the article may be delivered thereby. At this time the chain conveyors 57, 57' are run at a speed greater than that at which the delivery belts 39, 39', 40, 40' are run in order to prestretch the film by tensioning it in the longitudinal direction. When the predetermined length of the stretchable film has thus been delivered, a cutter 43 is raised by a cutter drive unit 44 to sever the film from the continuous web thereof. The cut length of stretchable film is thereafter fed to a predetermined position overlying the elevator bed 17, namely until the center of the cut length of film coincides with the center of the elevator bed 17. The feed of the cut length of film is then halted.

The left and right folding plates 21, 22, the front folding plate 23 and a rear folding roller 24 define an opening 25. As shown in FIGS. 1 through 3, the gripper groups 41, 41' and the rubber belts 42, 42' are arranged to lie between the opening 25 and the lower end of the stroke of the elevator bed 17 and, when the wrapping machine is viewed from above, to flank the opening 25 on either side.

Figure 4:
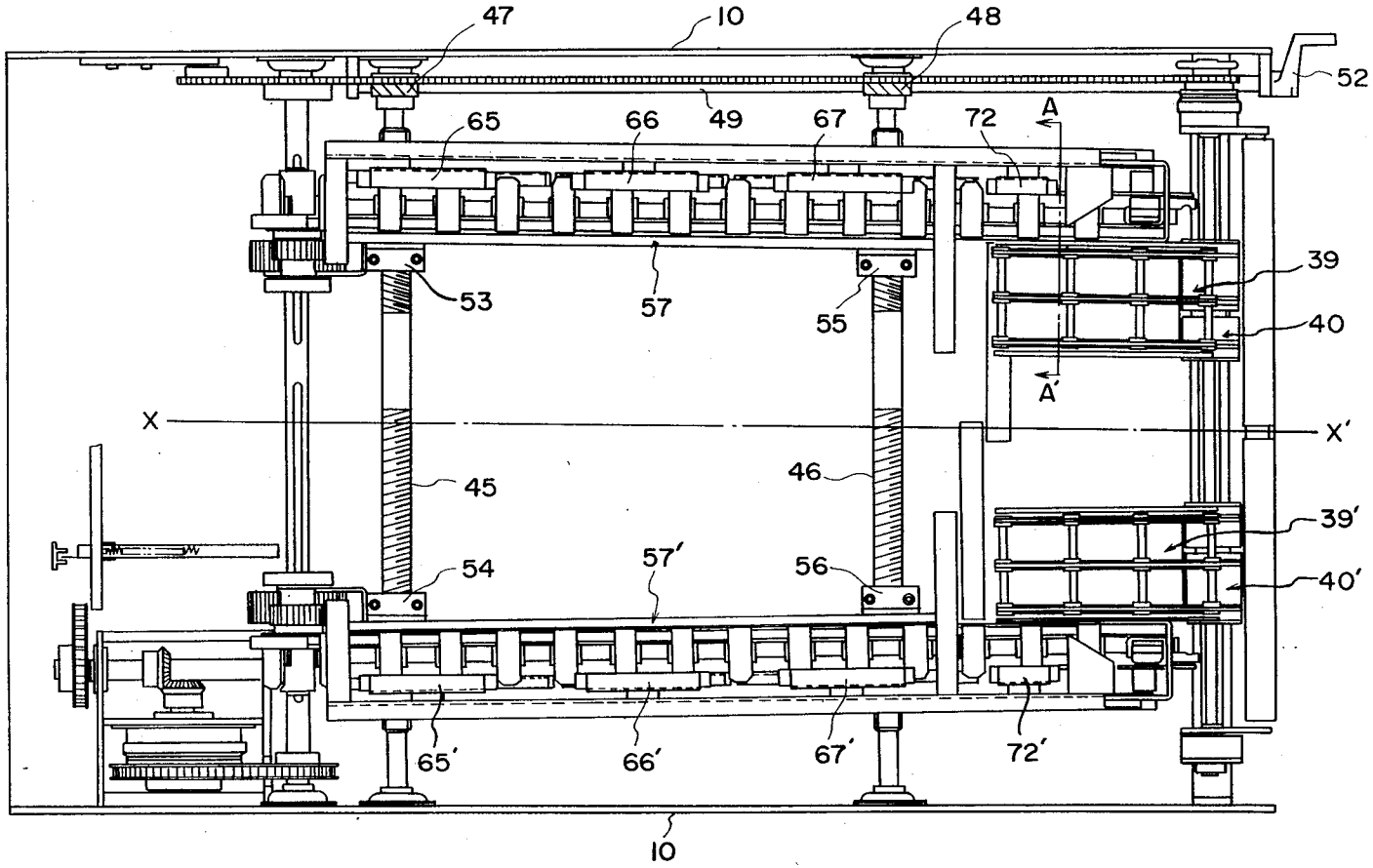
FIGS. 4 and 5 are views illustrating the structure of a film feeding mechanism included in the wrapping machine of the present invention.
Figure 5:
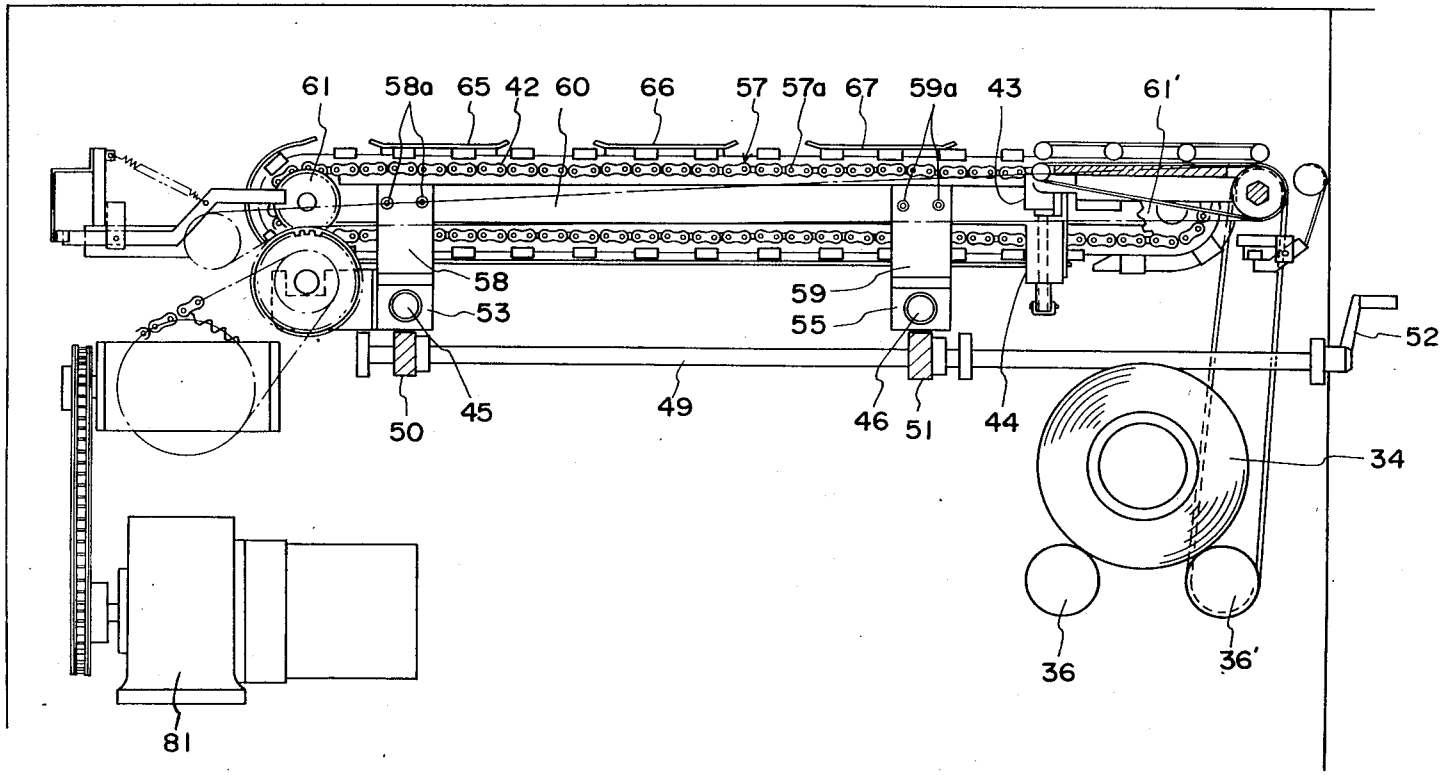

Reference will now be had to FIGS. 4 and 5 to describe the film feeding mechanism 2 in still greater detail. A pair of adjust screws 45, 46 are rotatably provided in opposing relation at prescribed positions of the machine frame 10 and have respective hypoid gears 47, 48 secured thereto at their rear end portions. Arranged along the rear face of the machine frame 10 is a rotary shaft 49 to which are secured at prescribed positions a pair of hypoid gears 50, 51 meshing with the respective hypoid gears 47, 48.

A handle 52 is attached to right-hand end portion of the rotary shaft 49 so as to be situated outboard of the machine frame 10. The adjust screws 45, 46 can be rotated through the rotary shaft 49 by turning the handle 52.

The adjust screws 45, 46 have a close screw pitch on the upper side of FIG. 4 and a less dense screw pitch on the lower side of FIG. 4. Provided in close proximity to both ends of the adjust screws 45, 46 are adjust blocks 53 through 56 having nuts which engage with the threaded portions of respective ones of the adjust screws. The adjust blocks 53, 55 at the rear serve as a base for the chain conveyor 57, and the adjust blocks 54, 56 at the front serve as a base for the chain conveyor 57'.

The chain conveyors 57, 57' are arranged so as to diverge from each other in relation to a central axis X–X' in the direction of film feed, whereby the film is prestretched strongly as it is fed.

The chain conveyors 57, 57' are symmetrical in structure and only the structure of chain conveyor 57 will be described. As shown in FIG. 5, the adjust block 53 is provided with a mounting and supporting member 58, and the adjust block 55 is provided with a mounting and supporting member 59. Fixedly attached to the mounting and supporting members 58, 59 by a plurality of respective screws **58*a*, 59*a* is a mounting base plate 60. Sprockets 61, 61' which rotate freely are disposed on the opposite ends of the mounting base plate 60, and an endless chain 57*a* is stretched between the sprockets 61, 61'**.

Figure 6:
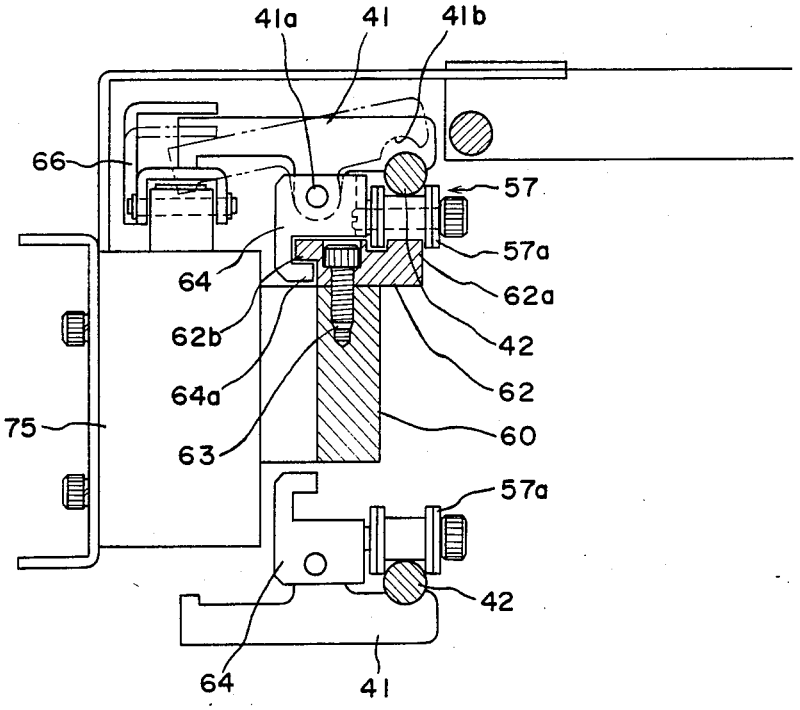

As shown in FIG. 6, the round rubber belt 42, which is an endless belt having a circular cross section, is disposed to lie on the outer periphery of the chain **57*a*. A plurality of the grippers 41, which are spaced apart from one another by a prescribed distance, are mounted for pivotal motion externally of the chain 57*a* about respective shafts 41*a*. The distal end portion of each gripper 41 is formed to include a semicircular recess 41*b* shaped to fit over the round rubber belt 42. A support plate 62 is attached to the upper portion of the mounting base plate 60 by a screw 63 and extends over a prescribed region of the mounting plate. The support plate 62 is formed to include a projection 62*a* as an integral part thereof fitted into the central recess of the chain 57*a* for guiding the same, and an projection 62*b* as an integral part thereof which mates with an engagement flange 64*a* formed on a member 64 to which the gripper 41 is attached, thus guiding the member 64**.

Left, central and right movable guide members 65, 66, 67 are provided at predetermined positions outboard of the chain conveyor 57 in close proximity thereto, and left, central and right movable guide members 65', 66', 67' are provided at predetermined positions outboard of the chain conveyor 57' in close proximity thereto, as shown in FIG. 4. Each of these movable guide members is of substantially the same structure and only the structure of the central movable guide member 66 will be described here.

Figure 7:
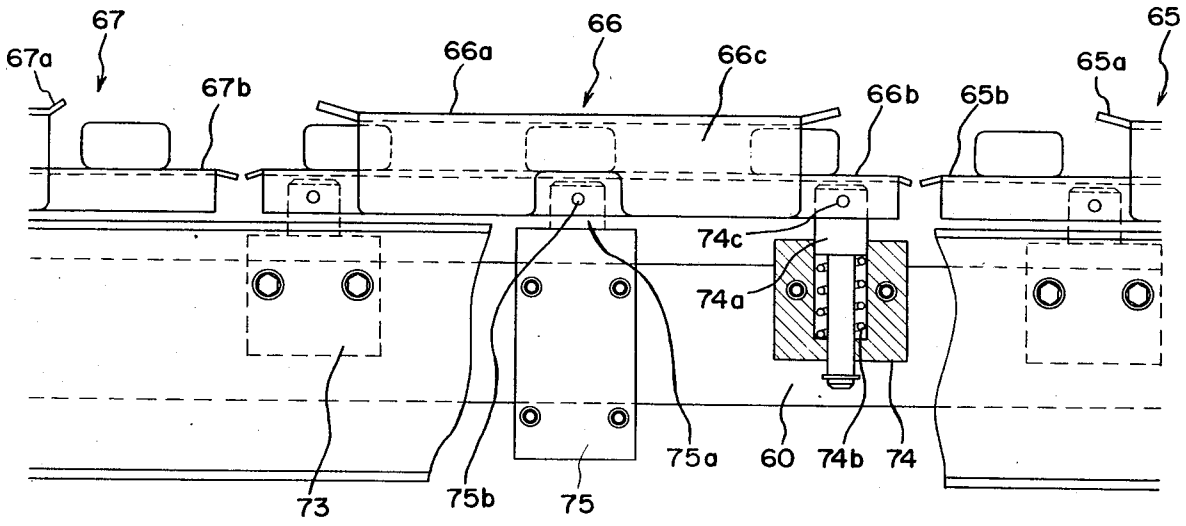

As shown in FIG. 7, the movable guide member 66 is equipped with an upper pressing plate **66*a* and a lower pressing plate 66*b*. The lower pressing plate 66*b* is formed so as to define a substantially continuous surface with neighboring lower pressing plates 65*b*, 67*b* on either side, and the upper pressing plate 66*a* is formed to be somewhat shorter than the lower pressing plate 66*b*. The lower portion of the side face of upper pressing plate 66*a* is fixed to the side face of lower pressing plate 66*b* as by spot welding. The upper and lower pressing plates 66*a*, 66*b* define a space 66*c* in which the rear end portion of the gripper 41 is fitted. The opposite end portions of the lower pressing plate 66*b* are provided with biasing means 73, 74 which urge the lower pressing plate 66*b* upward at all times. The urging means 74 includes a center rod 74*a* the distal end whereof is connected to the lower pressing plate 66*b* by a pin 74*c*, and a coil spring 74*b* which constantly urges the center rod 74*a* upward. The urging means 73 is structurally identical with the urging means 74. A solenoid 75 for lowering the movable guide member 66 is provided at the central portion of the lower pressing plate 66*b*. The solenoid 75 has a rod 75*a* which moves up and down at the central portion thereof. The distal end of the rod 75*a* is connected to the lower portion of the lower pressing plate 66*b* by a pin 75*b***.

A side plate (not shown) attached to the mounting base plate 60 is secured by screws to the urging means 73, 74 and solenoid 75. When the solenoid 75 is in the deenergized state, the rod **75*a* is capable of sliding freely up and down. When the solenoid 75 is energized, however, the rod 75*a* is pulled downward to lower the movable guide member 66 against the urging force of the urging means 73, 74. As result of this lowering operation, the gripper 41, the rear end whereof is fitted into the space between the upper and lower pressing plates 66*a*, 66*b* of the movable guide member 66, is rotated about the shaft 41*a* so that the recess 41*b* thereof parts from the round rubber belt 42. When the solenoid 75 is deenergized, the movable guide member 66 is urged upwardly by the urging means 73, 74 and the gripper 41 rotates about the shaft 41*a* so that its recess 41*b* abuts against the round rubber belt 42**.

The movable guide members 65, 65' on the left side and the grippers 41, 41' fitted between the upper pressing plates **65*a*, 65*a'* and the lower pressing plates 65*b*, 65*b'* of these movable guide members 65, 65', respectively, construct a mechanism for clamping the opposing edges of the stretchable film. This mechanism shall be referred to as a left clamping mechanism. Likewise, the movable guide members 67, 67' on the right side and the grippers 41, 41' fitted between the upper pressing plates 67*a*, 67*a'* and the lower pressing plates 67*b*, 67*b'* of these movable guide members 67, 67', respectively, construct a mechanism for grasping the opposing edges of the stretchable film. This mechanism shall be referred to as a right clamping mechanism. Further, the movable guide members 66, 66' at the center and the grippers 41, 41' fitted between the upper pressing plates 66*a*, 66*a'* and the lower pressing plates 66*b*, 66*b'* of these movable guide members 66, 66', respectively, construct a mechanism for grasping the opposing edges of the stretchable film. This mechanism shall be referred to as a central clamping mechanism. Movable guide members 72, 72' for opening and closing only one of the grippers 41, 41', respectively, are provided at the ends of the respective chain conveyors 57, 57' on the stretchable film supply side, namely upstream of the entryway to the cutter 43. The movable guide members 72, 72' are substantially identical in structure, so only the structure of movable guide member 72** will be described.

Figure 8:
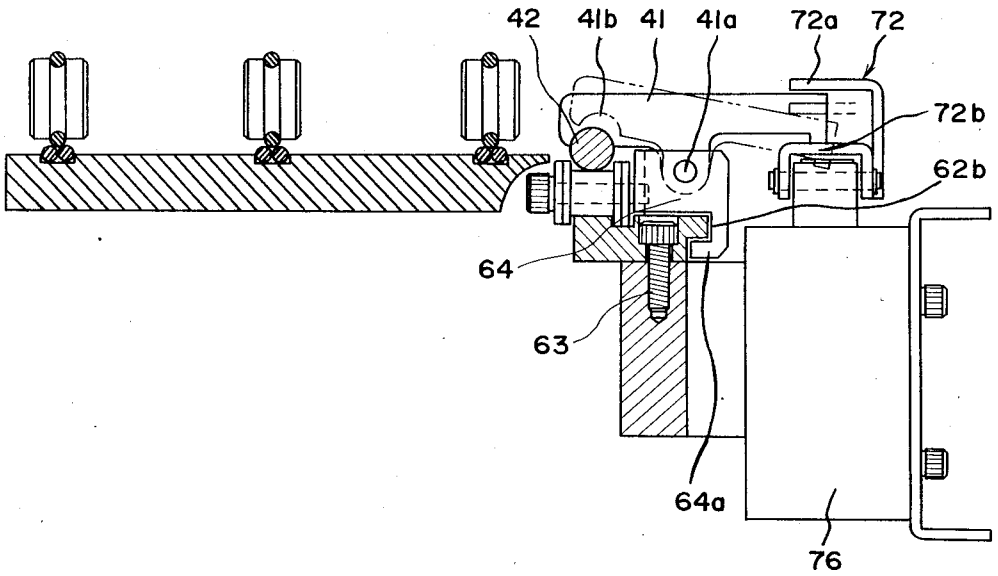
FIG. 8 is a sectional view taken along line A–A′ of FIG. 4.

As shown in FIG. 8, which is a sectional view taken along line A–A' of FIG. 4, the movable guide member 72 has a structure which is substantially the same as that of the movable guide members 65 through 67. Note, however, that the upper and lower pressing plates 72*a*, 72*b* constituting the movable guide member 72 are smaller in width than their counterparts in the movable guide members in order to open and close only a single one of the grippers 41. Energizing and deenergizing a solenoid 76 causes the gripper 41 to rotate about the shaft 41*a* so that the recess 41*b* formed in the distal end of the gripper separates from or comes into pressured contact with the round rubber belt 42. Operation is thus similar to that of the movable guide members 65 through 67.

Figure 9:
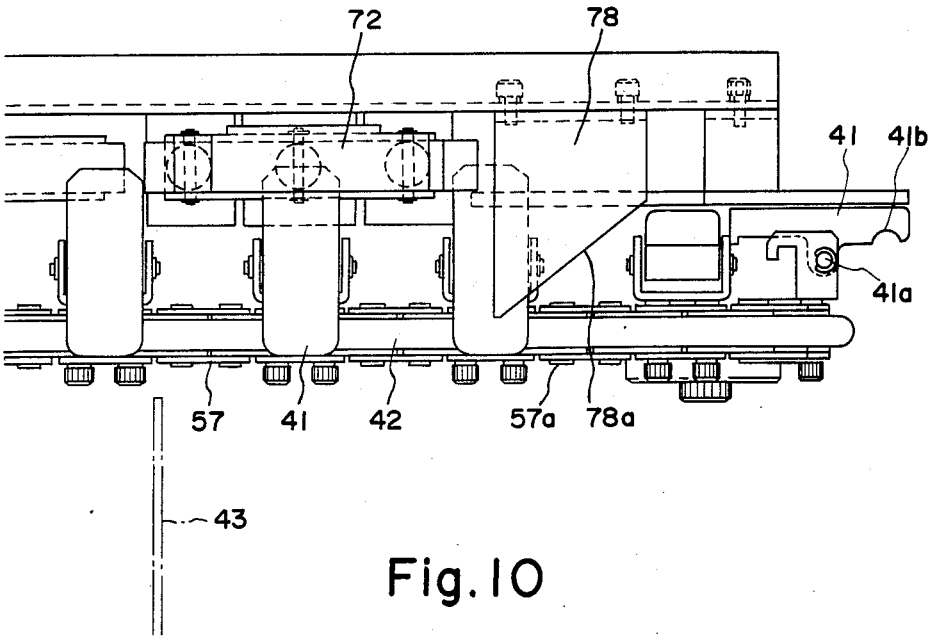
FIG. 9 is an enlarged plan view showing the vicinity of a sprocket of a chain conveyor.
Figure 10:
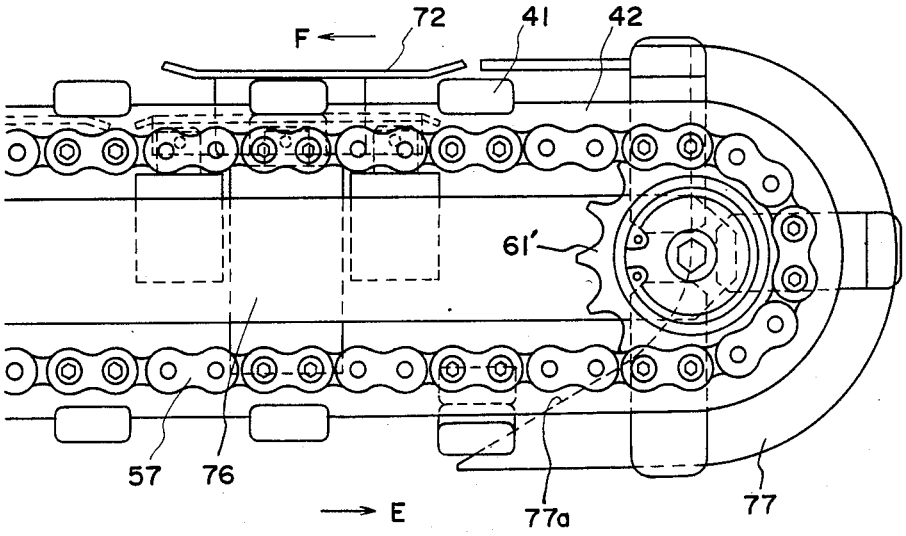
FIG. 10 is an enlarged side view of the same.

As shown in FIGS. 9 and 10, stationary guide members 77, 78 are provided in the vicinity of the sprocket 61' on the stretchable film supply side of the chain conveyors 57, 57'.

Figure 11:
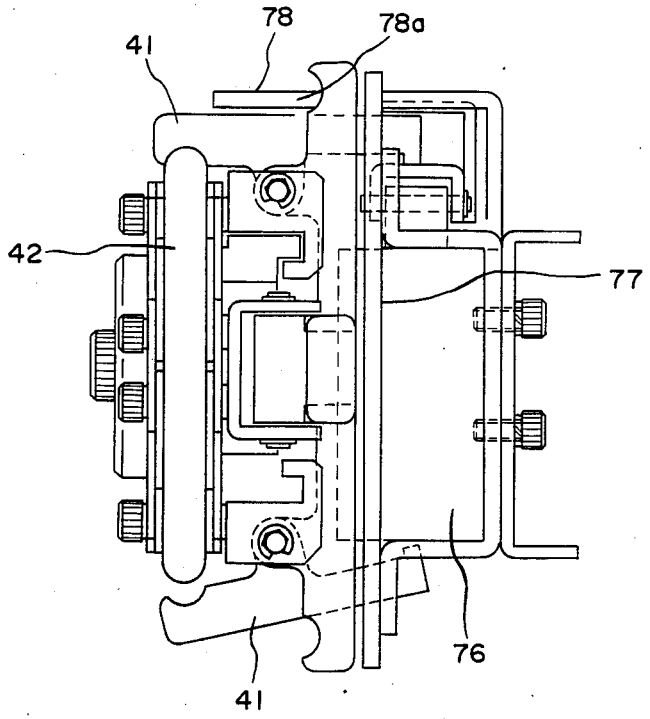
FIG. 11 is a front view of the same.

Reference will now be had to FIGS. 9, 10 and 11 to describe the operation through which the grippers 41, 41' are opened and closed when the chain conveyors 57, 57' travel round the sprocket 61' on the stretchable film supply side. FIG. 9 is an enlarged plan view showing the vicinity of the sprocket 61' of chain conveyor 57, FIG. 10 is an enlarged side view of the same, and FIG. 11 is a front view of the same.

The chain conveyor 57 travels in the directions of arrows E, F shown in FIG. 10. The gripper 41, which travels together with the chain conveyor 57, presses against an inclined face 77*a* at the tip of the stationary guide member 57 and is thus rotated about the shaft 41*a*, whereby the recess 41*b* at the distal end of the gripper 41 parts from the round rubber belt 42, with the gripper assuming a parallel relation with respect to the stationary guide member 77 at the central portion of sprocket 61'. As the chain conveyor 57 rotates further to move the gripper 41 to a portion at which it contacts an inclined face 78*a* of the stationary guide member 78, the front end of the gripper 41 presses against this inclined face 78*a* and is rotated about the shaft 41*a* in a direction opposite to that above, whereby the recess 41*b* at the tip of the gripper abuts against the round rubber belt 42 at the central portion of the stationary guide member 78. The gripper 41 then continues travelling through the space between the upper and lower pressing plates 72*a*, 72*b* of the movable guide 72.

As shown in FIG. 1, the folding mechanism 4 comprises the left and right folding plates 21, 22, the front folding plate 23 and the rear folding roller 24, these elements forming the opening 25 through which an article to be wrapped raised by the elevator bed 17 is passed.

The left and right folding plates 21, 22 are for folding left and right edges of a cut length of stretchable film tautly covering the article to be wrapped. In order to make it easier for the stretchable film to slip through the opening 25, the folding plates 21, 22 are made of flat plates having their front corner portions on the sides facing the opening 25 rounded into an arcuate configuration of a large radius of curvature, and having their rear corner portions on the sides facing the opening 25 rounded into an arcuate configuration of a small radius of curvature.

Figure 12:
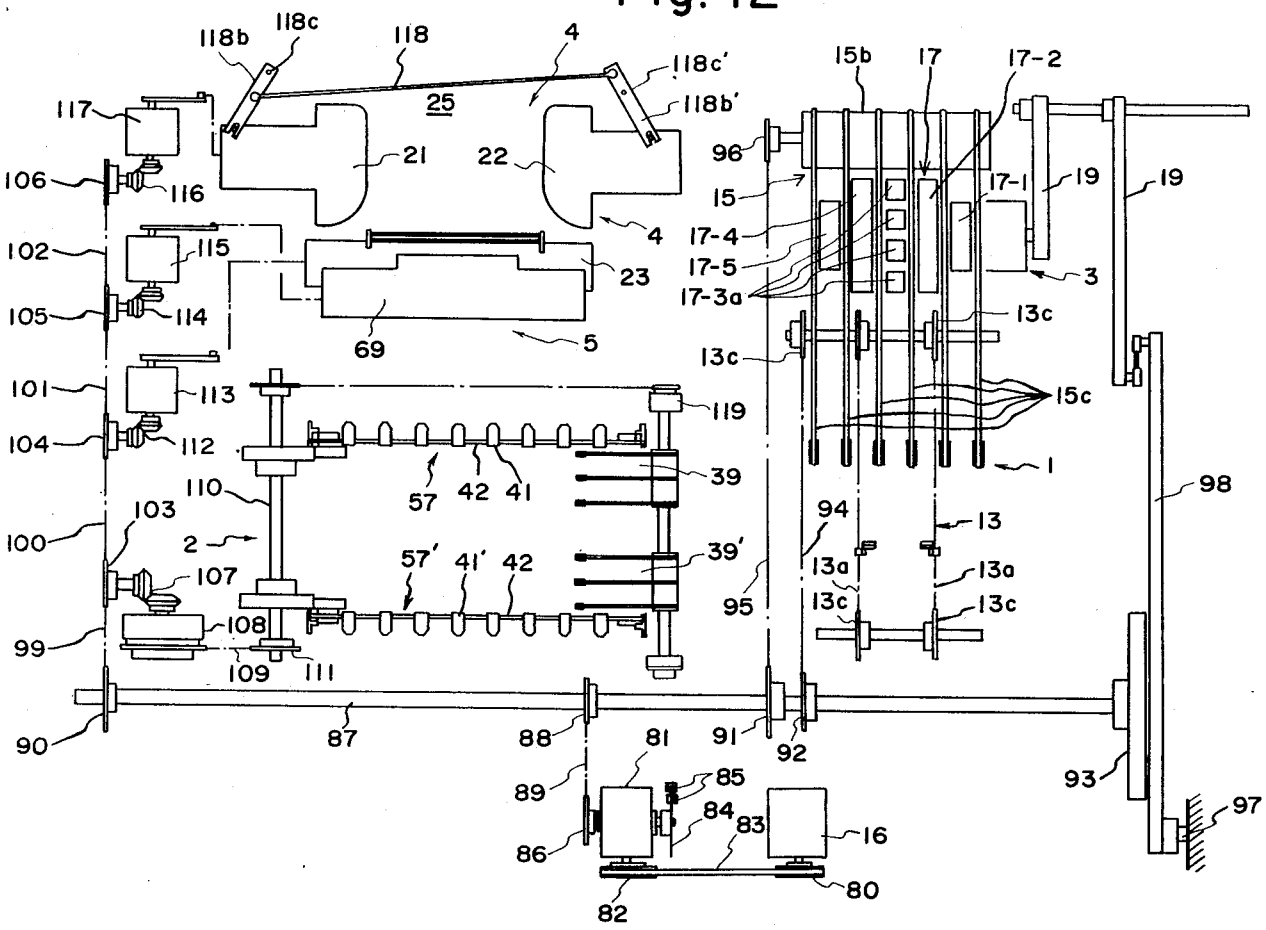
FIG. 12 is a systematic view illustrating the drive system of the wrapping machine according to the present invention.
Figure 13:
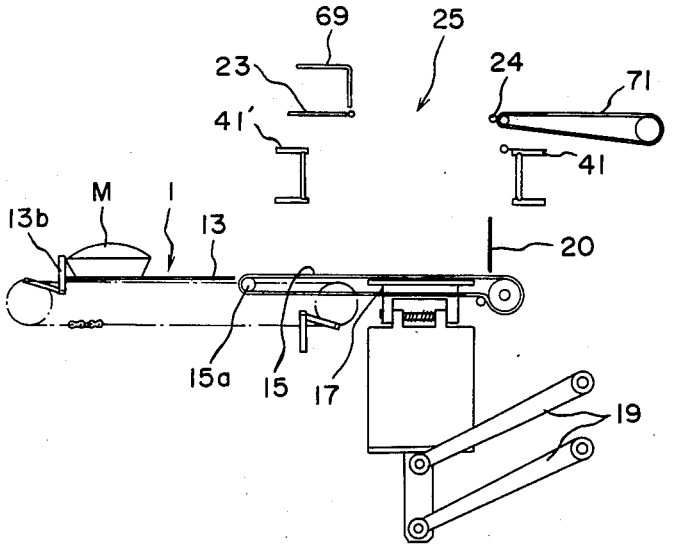
FIGS. 13(A), (B) through FIGS. 21(A), (B) are schematic views illustrating an operating sequence for wrapping an article by means of the wrapping machine of the present invention.
Figure 13:
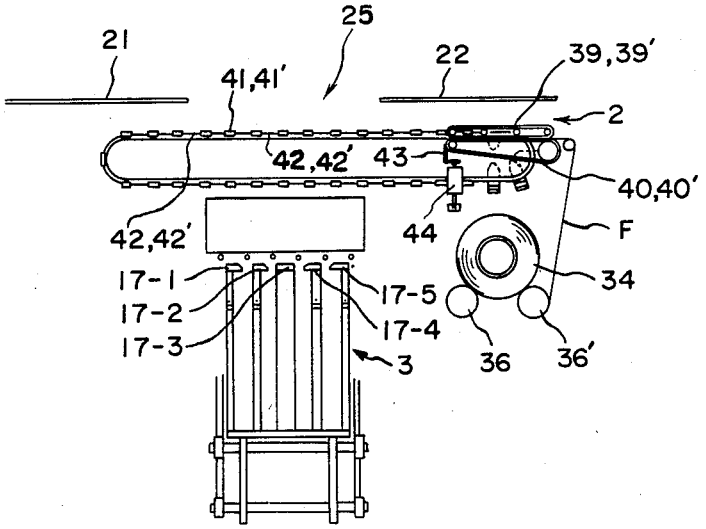
Figure 14:
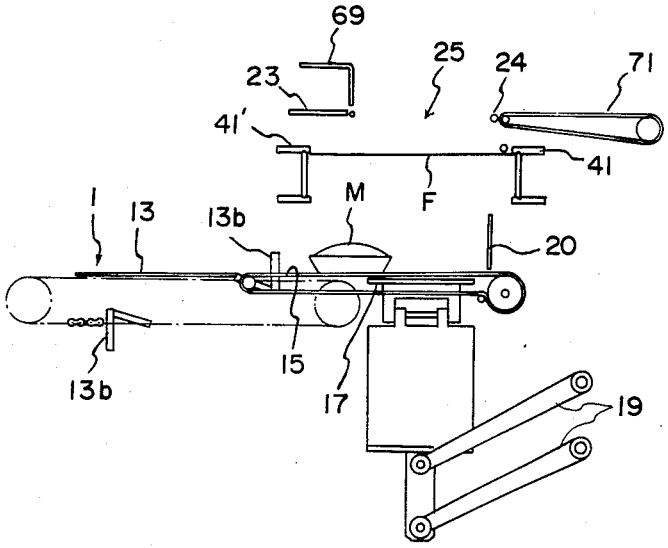
Figure 14:
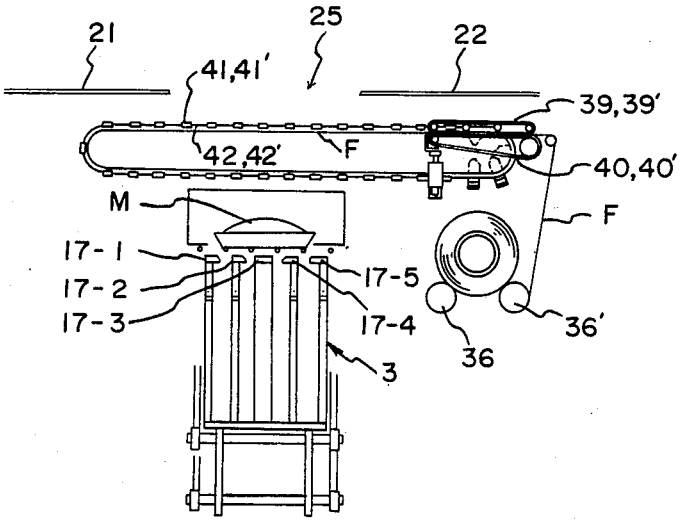
Figure 15:
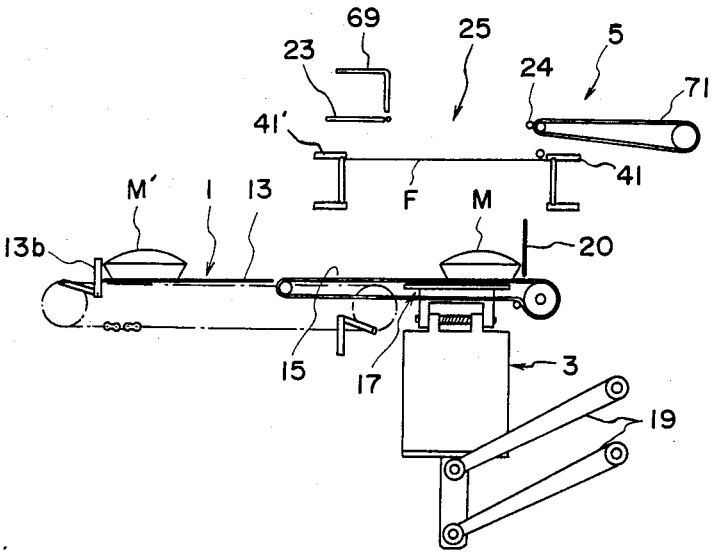
Figure 15:
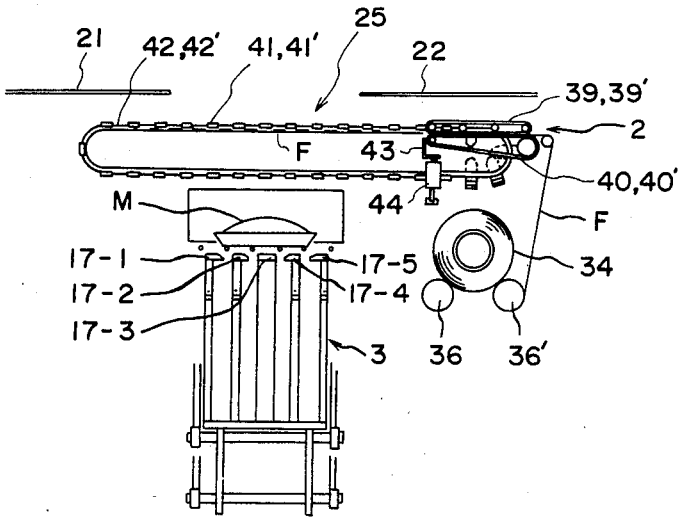
Figure 16:
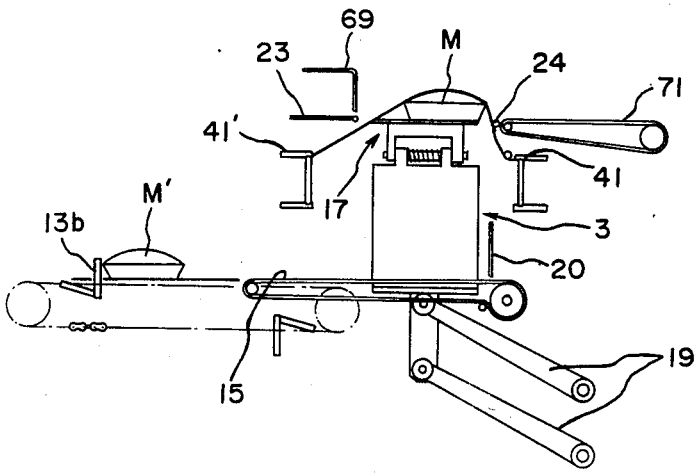
Figure 16:
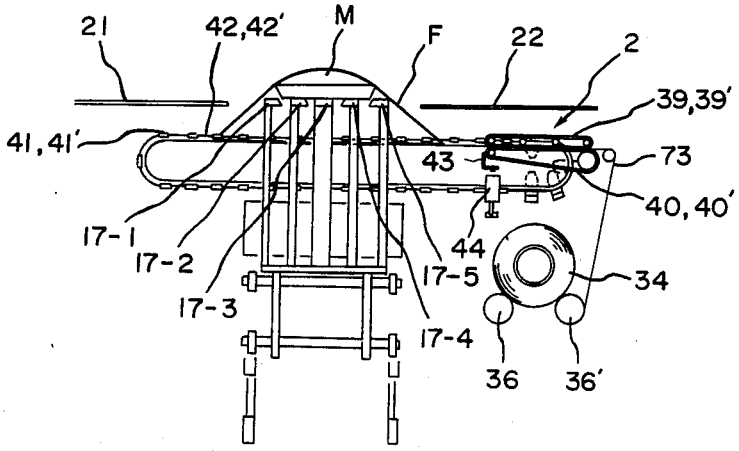
Figure 17:
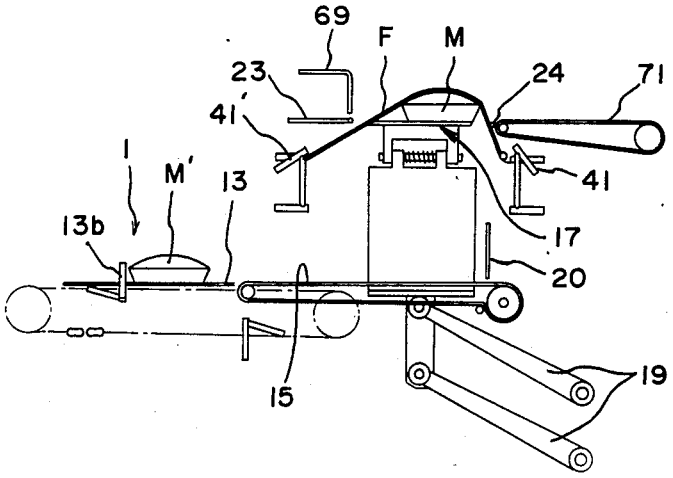
Figure 17:
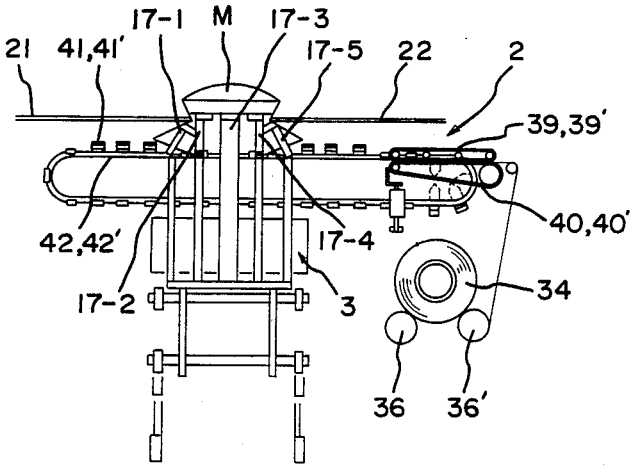
Figure 18:
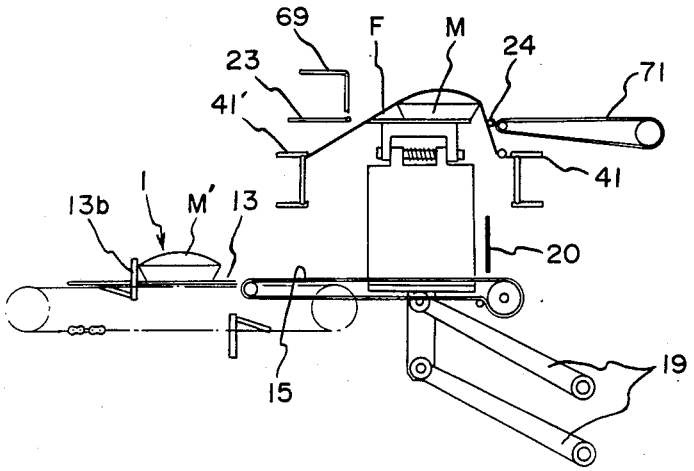
Figure 18:
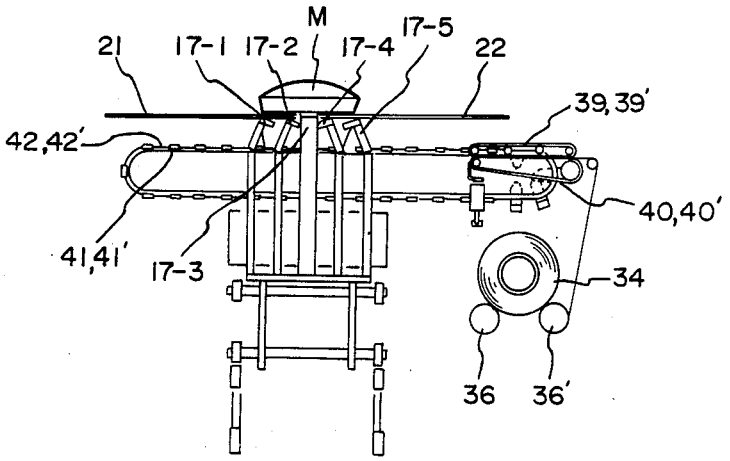
Figure 19:
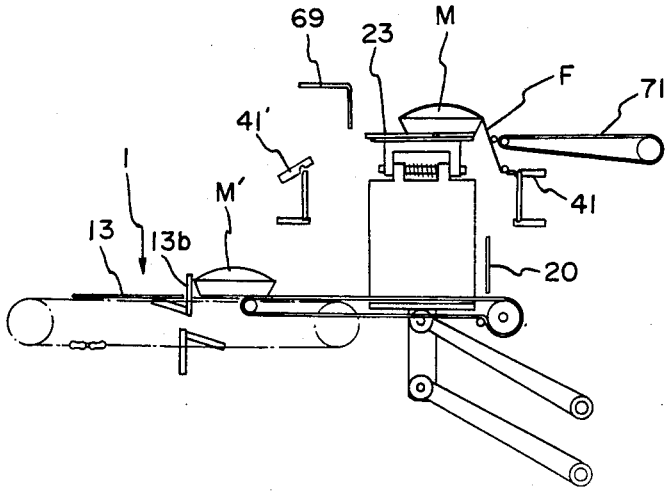
Figure 19:
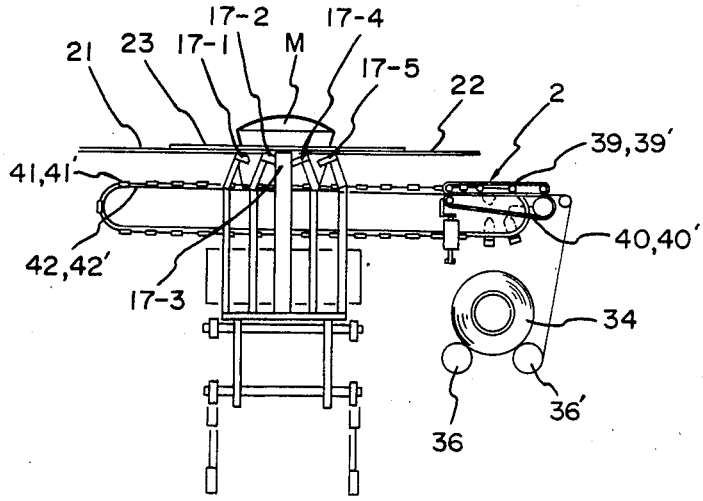

Parallel guide bars 26, 26; 26', 26' directed toward the opening 25 are provided at the upper portion of the machine frame on longitudinally opposing sides thereof. Slidably provided on the guide bars 26, 26; 26', 26' are sliding members 27, 27, 27', 27', respectively. The left folding plate 21 is attached to the lower portions of the sliding members 27, 27, and the right folding plate 22 is attached to the lower portions of the sliding members 27', 27'. The left folding plate 21 is connected to a drive shaft (not shown) by a crank mechanism. Pivot shafts 118*c*, 118*c'* are provided in close proximity to the respective left and right folding plates 21, 22, as shown in FIG. 12. Rotating rods 118*b*, 118*b'* are pivotably attached to the pivot shafts 118*c*, 118*c'*, respectively. The rear ends of the rotating rods 118*b*, 118*b'* are rotatably connected to the left and right folding plates 21, 22, respectively. The rotating rods 118b, 118b' are rotatably linked by a link 118, by which the left and right folding plates 21, 22 are simultaneously rotated in mutually opposing directions, that is, either forward toward or backward away from the center of the opening 25.

As shown in FIG. 1, the front folding plate 23 is a flat plate having a front folding roller 23*a* rotatably provided on the side thereof facing the opening 25. Side guide rails 28, 28' are arranged on the machine frame 10 on the left and right sides of the opening 25 and are provided with respective first sliding members 29, 29' and respective second sliding members 30, 30'. The front folding plate 23 is attached astride the first sliding members 29, 29'. The sliding member 29 and a first drive shaft 31 are connected by a crank mechanism 33 so that the front folding plate 23 is capable of being moved toward or away from the rear folding roller 24. The crank mechanism 33 rotatably connects rotating rods 33*a*, 33*b*, which are fixedly secured to the first drive shaft 31, via a pivot shaft 33*c*.

A pusher 69 is attached to the sliding members 30, 30. The pusher 69 is adapted to be moved toward or away from the rear folding roller 24 by a second drive shaft 31' and a crank mechanism 33', just as the front folding plate.

The outfeed conveyance mechanism 5 comprises a pusher 69 for pushing out an article under which the left, right and front edges of a cut length of stretchable film have been folded by the folding mechanism 4, a lateral slider 70 on which the wrapped article pushed out by the pusher 69 is placed for being moved laterally, and a heating belt 71, as shown in FIG. 2.

Thus, an article under which the left, right and front edges of a cut length of stretchable film have been folded by the left, right and front folding plates 21, 22 and 23, respectively, is pushed out by the pusher 69, whereby the rear edge of the stretchable film is folded under the article by the rear folding roller 24. This completes the folding of the stretchable film to produce a wrapped article. The article is then positioned by the lateral slider 70 in order that a label may be affixed thereto automatically. This is followed by fusing the stretchable film, which has been folded under the bottom of the article, on the heating belt 71. The finished product is then discharged from the wrapping machine.

FIG. 12 is a systematic view showing the drive system of the wrapping machine according to the present invention. The aforementioned motor is shown at reference numeral 16. Motive power produced by the motor 16 is transmitted from a V pulley 80 secured to the rotary shaft of the motor 16 to a V pulley 82 secured to an input rotary shaft of the speed reducer 81 via a V belt 83. The speed reducer 81 has a first output rotary shaft to which is secured a slitted disk 84, the structure whereof will be described below. Motion of slits formed in the disk 84 is sensed by a sensor 85 to obtain a timing signal for controlling wrapping machine motive power. The speed reducer 81 has a second output shaft to which a sprocket 86 is secured. Motive power is transmitted from the sprocket 86 to a sprocket 88, which is secured to a main drive shaft 87 of the wrapping machine, via a chain 89. Secured to the main drive shaft 87 are sprockets 90, 91 and 92. Also secured to one end of the main drive shaft 87 is a cam 93 for raising and lowering the elevator. The sprocket 92 transmits motive power to the sprocket 13*c* of the pusher conveyor 13 via a chain 94, and the sprocket 91 transmits motive power to a sprocket 96 via a chain 95. The sprocket 96 is secured to the rotary shaft of the roller 15*b*, which applies the motive power to the round rubber belt 15*c* of the belt conveyor 15. The elevator cam 93 raises and lowers the elevator bed 17 by applying motive power for up and down movement to levers 19, 19 via a drive rod 98 driven up and down about a fulcrum 97 as center. The sprocket 90 transmits power to sprockets 103, 104, 105, 106 via chains 99, 100, 101, 102, respectively. The sprocket 103 transmits power to an electromagnetic clutch brake 108 via a 90° bevel gear 107, and thence via a chain 109 to a sprocket 111 secured to a drive shaft 110 of the film feeding mechanism 2. Thus, drive for rotation is applied to the delivery belts 39, 39', 40, 40' for delivering and feeding the stretchable film, the round rubber belts 42, 42' for embracing the longitudinal edges of the stretchable film and for conveying the same, and the chain conveyors 57, 57' to which the spaced grippers 41, 41' are respectively attached. The sprocket 104 transmits power to an electromagnetic clutch brake 113 via a 90° bevel gear 112, and the electromagnetic clutch brake 113 transmits the power to the front folding plate 23. The sprocket 105 transmits power to an electromagnetic clutch brake 115 via a 90° bevel gear 114, and the electromagnetic clutch brake 115 transmits the power to the discharge pusher 69. The sprocket 106 transmits power to an electromagnetic clutch brake 117 via a 90° bevel gear 116, and the electromagnetic clutch brake 117 transmits drive to the left and right folding plates 21, 22 via the sliding members 27, 27' and crank mechanism 118 to move the folding plates 21, 22 toward and away from the center of the opening 25.

Thus, the drive system of the wrapping machine is composed of mutually independent drive means that act through the electromagnetic clutch brakes 108, 113, 115, 117. Accordingly, if the wrapping machine is shut down for an emergency caused by an accident such as the turnover or jamming of an article, the electromagnetic clutch brakes 108, 113, 115, 117 can be released by pressing a clutch release button on the control panel. This enables the various elements constituting the film feed mechanism 2, folding mechanism 4 and conveyance mechanism 5 to be moved individually by hand, thereby simplifying the removal of the turned over or jammed article and greatly shortening the time required to restore the wrapping machine to operation.

In the foregoing embodiment, the independent drive means illustrated transmit the power from the motor 16 through the intermediary of the electromagnetic clutch brakes 108, 113, 115, 117. However, reversible motors can be used in place of the motor 16 and electromagnetic clutch brakes 108, 113, 115, 117 and the various elements of the wrapping machine can be actuated automatically by appropriate selection of the rotating direction of these motors.

The operation of the wrapping machine will now be described with reference to FIGS. 13 through 21, in each of which (A) is a longitudinal sectional front view and (B) a longitudinal sectional side view.

The wrapping machine of the illustrated embodiment is adapted to wrap one article through two cycles. More specifically, first the operator places an article M to be wrapped at a prescribed position on the pusher conveyor 13 of the infeed conveyance mechanism 1, whereby the wrapping machine begins operating to drive the pusher conveyor 13 and the belt conveyor 15. The decision as to whether the article M has been placed on the pusher conveyor 13 is made based on a weight stability signal generated by the weigher 14, provided the wrapping machine is equipped with such a weigher. In the absense of the weigher 14, the decision is made based on a detection signal from a microswitch for detecting the article. Conveyance of the article M by the pusher 13*b* is started by driving the pusher conveyor 13 [see FIGS. 13(A), 13(B)]. At the start of conveyance, the width and height of the article M are sensed by a size sensing unit, described below. The article M conveyed by the pusher conveyor 13 is carried to the belt conveyor 15 which receives the article and continues to convey it. In concurrence with the first half of this article conveyance process, a series of wrapping operations is performed, namely the raising of the elevator bed 17, the advance of the left, right and front folding plates and the lowering of the elevator bed 17, as will be described below. At wrapping machine start-up here being described, however, an article M has not yet been conveyed into and placed on the elevator bed 17, nor has the stretchable film yet been unreeled and fed into position. Accordingly, the series of wrapping operations mentioned above are as yet idle motions that perform no work.

The stretchable film is unreeled and fed in a continuous web in concurrence with the latter half of the article conveyance process. The stretchable film, shown at reference character F, is embraced at its longitudinal edge portions by the delivery belts 39, 39' and 40, 40'. The film F thus embraced is fed while being gripped at its longitudinal edge portions between the gripper groups 41, 41' of the respective chain conveyors 57, 57' and the round rubber belts 42, 42'. When the length of continuous stretchable film F delivered is in accordance with the dimensions of the article M sensed at the infeed conveyance mechanism 1, the cutter 43 is raised by the cutter drive unit 44 to sever the stretchable film F, as shown in FIGS. 14(A), 14(B). The article M to be wrapped is transported by the belt conveyor 15 and is eventually stopped above the elevator bed 17 by coming into abutting contact with the positioning plate 20. This completes the article infeed conveyance operation. Meanwhile, the length of stretchable film F cut off from the continuous web of film by the cutter 43 is fed so that its center is brought into coincidence with the center of the opening 25, namely the center of the elevator bed 17. Feed of the cut length of film F is stopped when such a position is attained. This ends one packing cycle. Under these conditions, the operator places the next article to be wrapped, shown at M', on the front end of the pusher conveyor 13, as shown in FIGS. 15(A), 15(B), whereupon the next cycle starts. Then, as in the manner described above, infeed conveyance of the article M' commences and the wrapping operation is carried concurrently. Specifically, as shown in FIGS. 16(A), 16(B), the elevator mechanism 3 is raised by arms 19, 19' to push the article M, which has been placed on the elevator bed 17, upward into stretching engagement with the cut length of stretchable film F embraced at its opposing edge portions from above and below by the grippers 41, 41' and round rubber belts 42, 42', respectively, and extended across the opening 25 on the lower side thereof. In this state the left and right folding plates 21, 22 are moved toward the central portion of the opening 25, at which time, and in accordance with the size and material of the tray containing the article M, and at a suitable timing, the movable guide members 65, 67 and 65', 67' are lowered to free the recessed portions 41*b*, 41*b'*, formed at the ends of the grippers 41, 41' engaging the movable guide portions 65, 65', 67, 67', from the round rubber belts 42, 42'. At this time, however, the opposing edge portions of the cut length of stretchable film F are still clamped between the grippers 41, 41', which are engaging with the movable guide members 66, 66', and the round rubber belts 42, 42'.

Figure 20A:
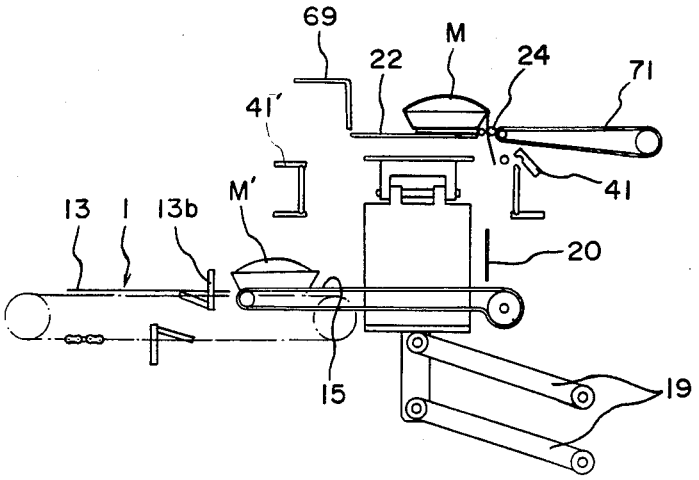
Figure 20B:
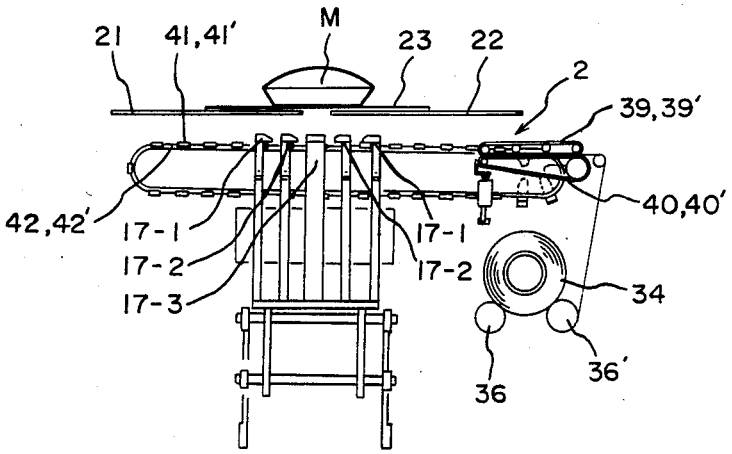
Figure 21:
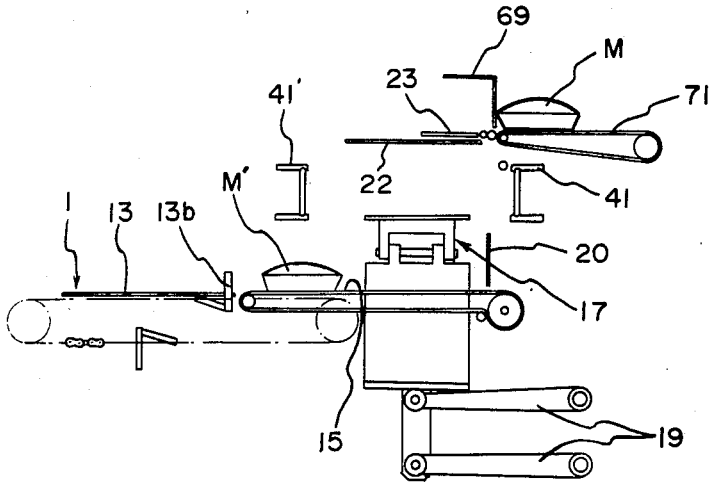
Figure 21:
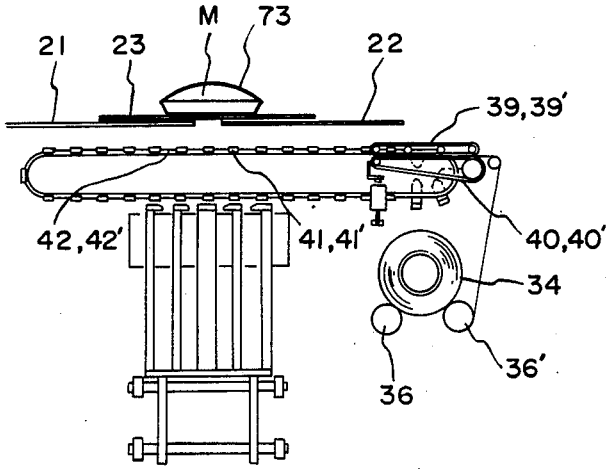

Next, as shown in FIGS. 17(A), 17(B), the elevator bed slats 17-1 and 17-5 recline toward the center of the opening 25 with the advance of the left and right folding plates 21, 22, respectively. As the left and right folding plates 21, 22 advance further, the elevator bed slat 17-2 and 17-4 also recline toward the center of the opening 25. As a result of these operations, the left and right edge portions of the cut length of stretchable film F, which tautly covers the article M from above, are smoothly folded far under the bottom of the tray containing the article, as illustrated in FIGS. 18(A), 18(B). The front folding plate 23 is now advanced toward the center of the opening 25 to fold the front edge of the cut length of stretchable film F under the tray of article M, as shown in FIGS. 19(A), 19(B). The earlier described front central clamping mechanism is released at this time. When the underfolding of the front edge of the film is completed with further advance of the front folding plate 23, the elevator mechanism 3 is lowered to lower the elevator bed 17, as shown in FIGS. 20(A), 20(B). At completion of underfolding of the left, right and front edges of the stretchable film F, the discharge pusher 69 is advanced toward the front edge of the heating belt 71 to push the article M. As a result, the rear edge portion of the cut length of stretchable film F is folded under the article tray by the rear folding roller 24. The article M, now in the wrapped state by virtue of the right, left, front and rear edge portions of the stretchable film F having been folded thereunder, is moved laterally by the slider 70, after which these portions of the stretchable film folded under the bottom of the tray are heat sealed by heat emitted from the heating belt 71. The wrapped article M is discharged from the wrapping machine after a label bearing such information as the product name, weight and price is affixed to the upper portion of the package at a suitable location. This last stage of the wrapping process is illustrated in FIGS. 21(A), 21(B).

Figure 22:
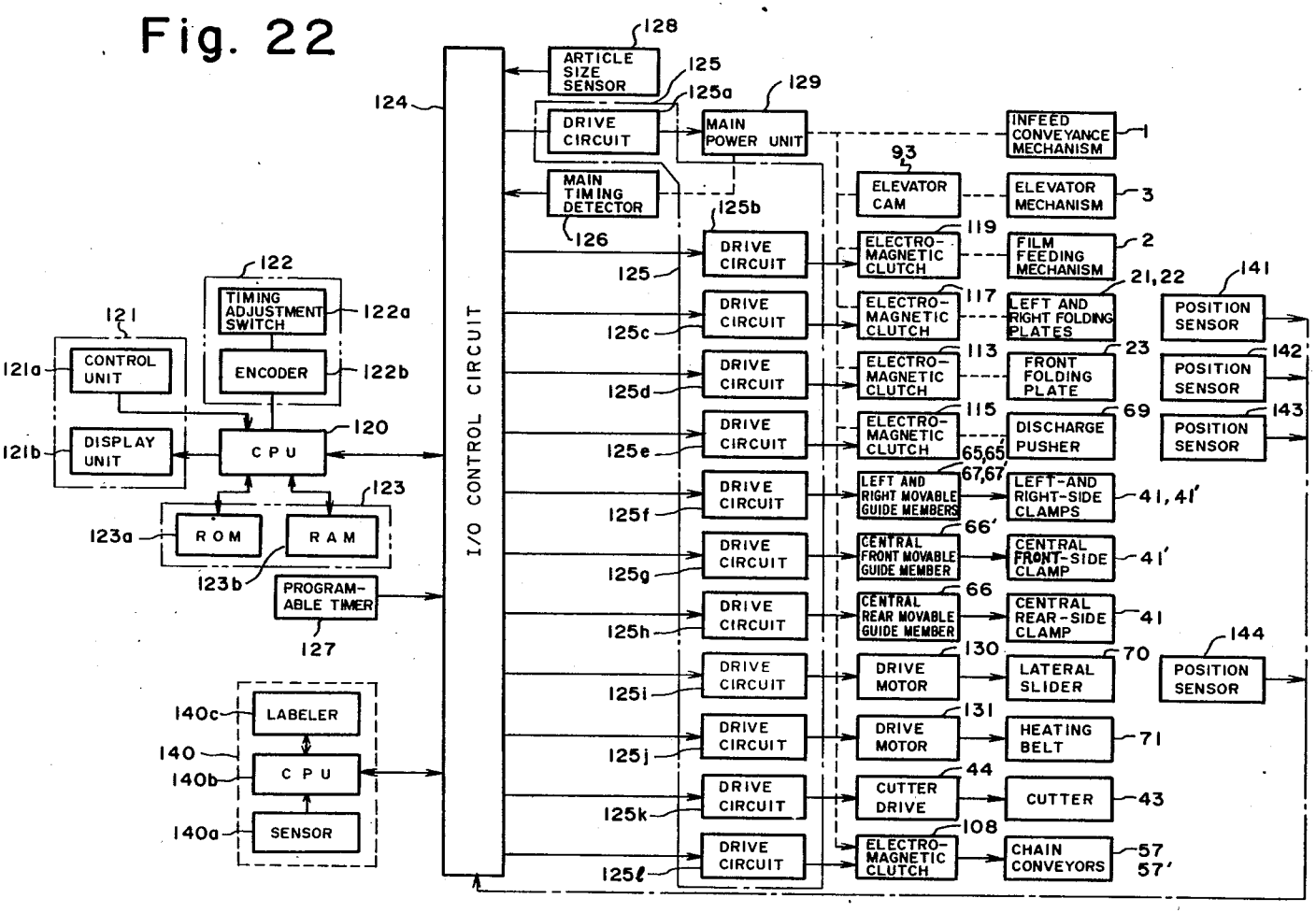
FIG. 22 is a block diagram illustrating the system configuration of a control apparatus included in the wrapping machine.

The construction of the wrapping machine control apparatus is illustrated in the block diagram of FIG. 22. The solid line arrows in FIG. 22 indicate the transmission of electrical signals, while the dashed lines indicate transmission of a mechanical variety. The control apparatus comprises a central processor 120, a control and display panel 121, a timing adjustment unit 122, a memory unit 123, an input/output control circuit 124, a drive control unit 125, a timing detector 126, and a programmable timer 127.

The control and display panel 121 comprises a control unit 121*a* for generating commands, which are applied to the central processor 120, for operating various elements of the wrapping machine, and a display unit 121*b* for displaying various detected states on the basis of a signal from the central processor 120. The timing adjustment unit 122 comprises a timing adjustment switch 122*a* and an encoder 122*b* and is used to adjust the operation timing of various wrapping machine elements such as the left and right folding plates 21, 22, the front folding plate 23 and the discharge pusher 69.

The memory unit 123 comprises a read-only memory (ROM) 123*a* and an random-access memory (RAM) 123*b*. The ROM 123*a* stores a control program as well as various data such as timing correction values, described later.

The input/output control circuit 124 is an interface control dircuit for delivering signals from the central processor 120 to the drive controller 125 and programmable timer 127, and for feeding the central processor 120 with a timing signal from the timing detector 126, and with signals from the programmable timer 127 and an article size sensing unit 128.

The drive control unit 125 is composed of drive circuits 125*a*–124*l*. The drive circuit 125*a* drives a main power unit 129, which is composed of the motor 16 and speed reducer 81. The drive circuit 125*b* is for energizing the electromagnetic clutch 119 that drives the film feed mechanism 2. The drive circuit 125*c* is for energizing the electromagnetic clutch 117 that drives the left and right folding plates 21, 22. The drive circuit 125*d* is for energizing the electromagnetic clutch 113 that operates the front folding plate 23. The drive circuit 125*e* is for energizing the electromagnetic clutch 115 that operates the discharge pusher 69. The drive circuit 125*f* operates the left and right side clamping mechanisms. More specifically, the drive circuit 125*f* drives the left and right movable guide members 65, 65', 67, 67' to open the grippers 41, 41' engaging with these movable guide members 65, 65', 67, 67'.

The drive circuit 125*g* operates the central front-side clamping mechanism, or more specifically, it drives the central movable guide member 66' on the front side to open the grippers 41' engaging with the movable guide member 66'. The drive circuit 125*h* operates the central rear-side clamping mechanism, or more specifically, it drives the central movable guide member 66 on the rear side to open the grippers 41 engaging with the movable guide member 66.

The drive circuit 125*i* starts a drive motor 130 for operating the lateral slider 70. The drive circuit 125*j* starts a drive motor 131 for operating the heating belt 71. The drive circuit 125*k* starts the cutter drive unit 44 for driving the cutter 43. The drive circuit 125*l* starts the electromagnetic clutch that drives the chain conveyors 57, 57'.

The timing detector 126 detects a signal from a timing signal generator comprising the slitted disk 84, which is secured to the rotary shaft of the speed reducer 81 of FIG. 12 for corotating with the rotary shaft, and the sensor 85. The timing detector 126 detects this timing signal, which is a standard for timing the operation of various operating elements such as the left, right and front folding plates 21, 22, 23, respectively, of the wrapping machine.

On the basis of a timing signal from the timing detector 126 and data stored in an operation timing register, described below, in the RAM 123*b* of the memory unit 123, the central processor 120 transmits signals to the drive circuits 125*a*–125*l* through the input/output control circuit 124 to drive the various elements of the wrapping machine at a predetermined timing.

A label affixing control unit 140 has a sensor 140*a* for sensing a weight signal from the weigher 14, a a central processor 104*b* and a labeler 140*c*. The central processor 140*b* of the control unit 140 sends a signal from the sensor 140*a* to the central processor 120 of the wrapping machine, calculates price from the weight information supplied by the sensor 140*a*, and controls the labeler 140*c*, which is adapted to print the price on a label together with the product name and unit price and affix the label to the article wrapped in the stretchable film.

In the illustrated embodiment, the left, right and front folding plates 21, 22, 23, respectively, the discharge pusher 69 and the lateral slider 70 are subjected to open-loop control by the central processor 120 on the basis of the timing signal from the timing detector 126. However, as illustrated, position sensors 141–144 may be provided and a closed loop control system adopted in which the position sensors sense the moving positions of the left, right and front folding plates 21, 22, 23, respectively, and of the discharge pusher 69 and lateral slider 70, and output signals from the position sensors 141–144 are fed back to the central processor 120 through the input/output control circuit 124.

Figure 23:
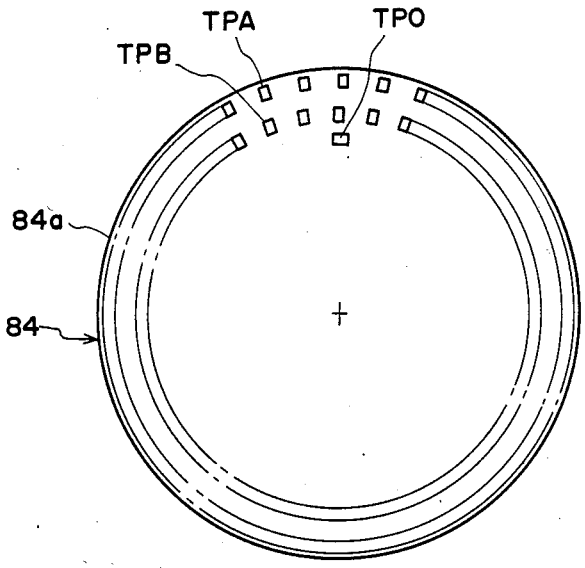
FIG. 23 is a plan view illustrating a slitted disk for generating a timing signal, direction detection signal and zero detection signal for controlling the operation of various elements of the wrapping machine.

The structure of the slitted disk 84 secured to the rotary shaft of the speed reducer 81 is illustrated in FIG. 23. As shown, the disk 84 comprises a disk body 84*a* provided along its outer edge with a circular array of slits TPA, having the same center as that of the disk body 84*a*, for producing a timing signal, and with a circular array of slits TPB for direction sensing disposed inwardly of and concentric with the slits TPA. The slits TPB are so arranged as to exhibit a prescribed angular delay with respect to the slits TPA. The disk body 84*a* is also provided with a slit TPO, located inwardly of the slits TPB, for sensing a predetermined zero point. Light which passes through these slits is sensed by the sensor 85 (see FIG. 12), the output whereof is applied to the timing detector 126.

Figure 24:
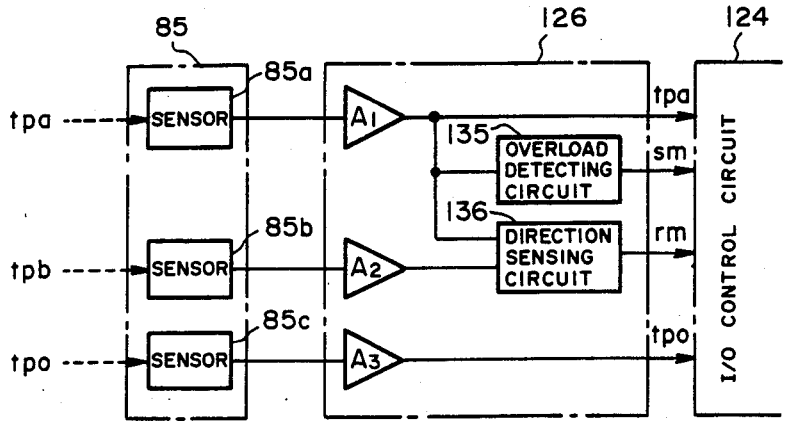
FIG. 24 is a block diagram illustrating the system configuration of a timing signal detector for detecting the timing signal.

The construction of the timing detector 126 is illustrated in the block diagram of FIG. 24. The sensor 85 is composed of sensors 85*a*, 85*b*, 85*c* for sensing a timing signal tpa, a direction detection signal tpb and a zero detection signal tpo from the respective slits TPA, TPB, TPO and for applying these signals to respective wave-shaping comparators A1, A2, A3. The timing signal tpa from comparator A1 is fed into an overload detecting circuit 135, a direction sensing circuit 136 and the input-/output control circuit 124. The direction detection signal tpb from the comparator A2 is applied to the direction sensing circuit 136. The zero detection signal from the comparator A3 is fed into the input/output control circuit 124. Further, the overload detecting circuit 135 and direction sensing circuit 136 produce respective output signals sm, rm that are also applied to the input/output control circuit 124.

Figure 25:
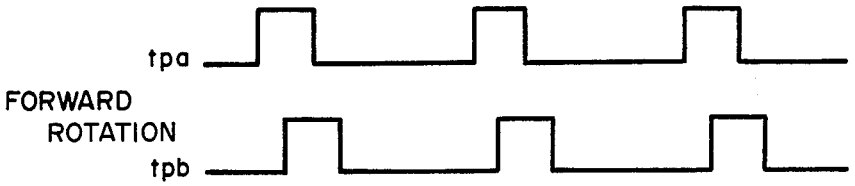
FIGS. 25(A) and 25(B) shows waveform diagrams illustrating the relation between the timing signal and the direction signal.
Figure 25:
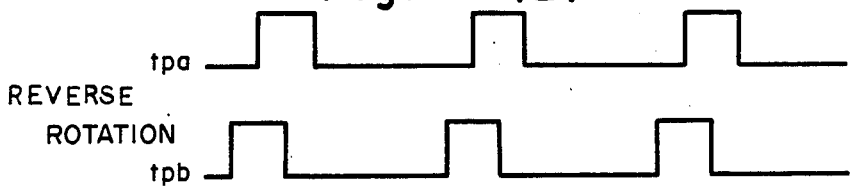

The relationship between the timing signal tpa and the direction detection signal tpb is as shown in FIGS. 25(A), 25(B). In a case where the motor 16 is rotating in the forward direction, the direction detection signal tpb is at a low logic level (hereafter referred to simply as the L level) at the leading edge of the timing detection signal tpa, as shown in FIG. 25(A). If the motor 16 is rotating in the reverse direction, the direction detection signal tpb is at a high logic level (hereafter referred to simply as the H level) at the leading edge of the timing detection signal tpa, as shown in FIG. 25(B). Accordingly, whether the motor 16 is rotating in the forward or reverse direction can be detected if the relationship between the timing signal tpa and direction detection signal tpb is known.

Figure 26:
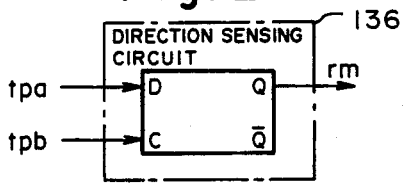
FIG. 26 is a view showing the construction of a direction sensing circuit.

An illustrative example of the direction detection circuit 136 is shown in FIG. 26. The direction sensing circuit 136 is constituted by a D-type flip-flop having the timing signal tpa and direction detection signal tpb respectively applied to the D and C terminals thereof. Therefore, when the timing signal tpa is at the H level at the leading edge of the direction detection signal tpb, the output rm of the flip-flop attains the H level. When the timing signal tpa is at the L level at the leading edge of the direction detection signal tpb, the output rm of the flip-flop attains the L level. Accordingly, the motor 16 is rotating in the forward direction when the output signal rm is at the H level at in the reverse direction when the signal rm is at the L level. The output signal rm of the direction sensing circuit 136 is applied to the central processor 120 through the input/output control circuit 124. If reverse rotation of the motor 16 is sensed, the central processor 120 immediately stops the motor 16, generates an error signal and causes the error signal to be displayed on the display unit 121*b*. With such an arrangement, the wrapping machine is protected against damage even if the connections of a three-phase outlet and the connections of the three-phase motor of the wrapping machine do not agree as at such time that the wrapping machine is delivered to the user or moved from one site of installation to another. Such damage is prevented by immediately detecting the reverse rotation of the motor and then stopping the motor without delay.

Figure 27:
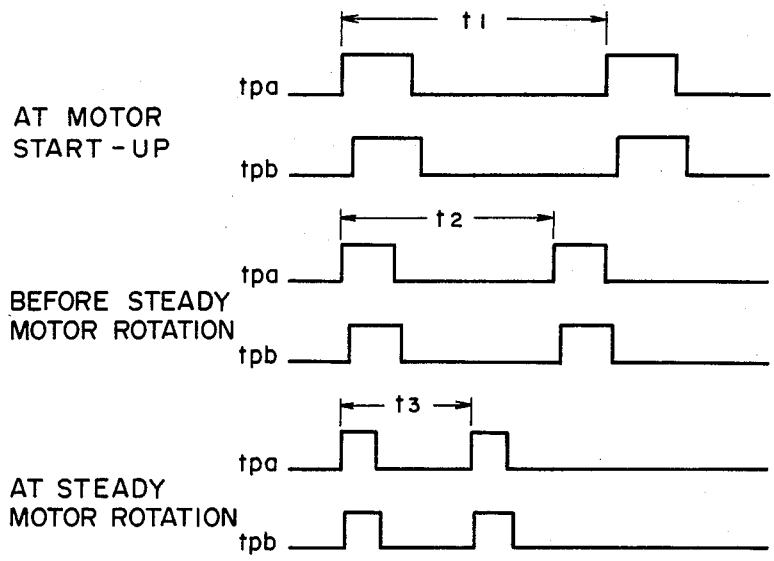
FIG. 27 is a waveform diagram showing the relation between the timing signal and the direction detection signal with rotation of a motor.

FIG. 27 illustrates the relationship between the timing signal tpa and direction detection signal tpb at start-up of the motor 16 as well as before and during steady rotation of the motor 16. As shown, the time interval between pulses of the timing detection signal tpa changes from $t_1$ at motor start-up to $t_2$ before steady rotation to $t_3$ during steady rotation. Since the time intervals $t_1$, $t_2$, $t_3$ will lengthen in the event of an overload, whether or not an overload has occurred can be determined by monitoring these time intervals $t_1$, $t_2$, $t_3$.

Figure 28:
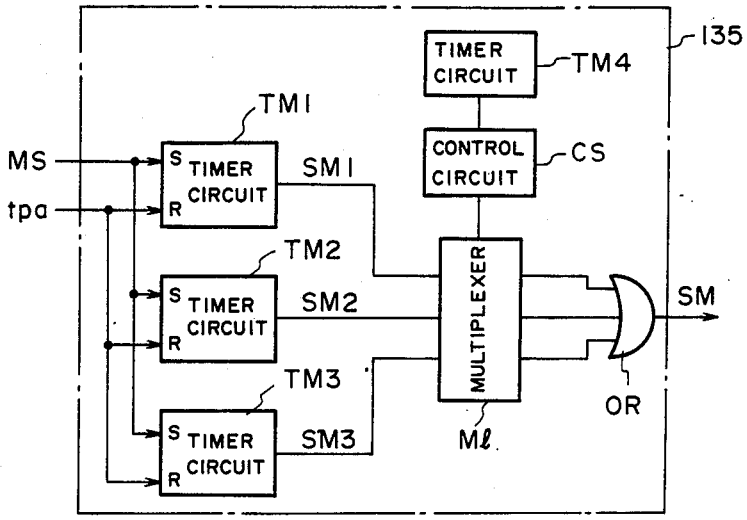
FIG. 28 is a block diagram illustrating the system configuration of an overload detection circuit.

FIG. 28 illustrates an example of the overload detecting circuit 135. The overload detecting circuit 135 comprises four timer circuits TM1, TM2, TM3, TM4, a control circuit CS, a multiplexer M1 and an OR circuit OR. The time intervals $t_1$, $t_2$, $t_3$ of the timing signal at motor start-up, before steady motor rotation and during steady motor rotation are set in the timer circuits TM1, TM2, TM3, respectively. Each of the timer circuits TM1, TM2, TM3 has an S terminal (set terminal) to which a start signal MS is applied, and an R terminal (reset terminal) to which the timing signal tpa is applied. If the time interval of the timing signal tpa is greater than $t_1$, the timer circuit TM1 produces an overload detection signal SM1; if greater than $t_2$, the timer circuit TM2 produces an overload detection signal SM2; if greater than $t_3$, the timer circuit TM3 produces an overload detection signal SM3. The multiplexer M1 is actuated in response to a command from the timer circuit TM4 to deliver an overload detection signal SM to the central processor 120 through the OR gate OR and input/output control circuit 124. When the overload detection signal SM is received, the central processor 120 immediately halts the operation of the wrapping machine and causes the display unit 121*b* to display a message indicative of this fact. This arrangement prevents the wrapping machine from sustaining damage by automatically stopping the operation of the wrapping machine in the event that the machine is subjected to an overload for any reason whatsoever.

Though reverse rotation and overloading of the motor 16 are detected by an arrangement using hardware in the illustrative embodiment, detection is of course possible by means of software, in which case the overload detecting circuit 135 and direction sensing circuit 136 would be unnecessary. Sensing direction by software means can be achieved by determining whether the direction detection signal tpb is at the H or L level when the timing signal tpa is applied, namely at the leading edge of the timing signal tpa. Sensing an overload can be accomplished by starting a timer whenever the timing signal tpa is applied and determining whether a length of time measured by the timer has elapsed by the time the next timing signal tpa is applied. The time set in this timer is changed over at motor start-up, before steady motor rotation and at attainment of steady motor rotation to respective predetermined values.

In the foregoing embodiment, the slitted disk 84 is provided with the slits TPA for the timing signal and with the slits TPB for detection of direction. However, it is possible for the timing signal tpa and direction detection signal tpb to be generated by just one of these groups of slits. In such case, two sensors would be placed at positions where the signals generated thereby would exhibit a predetermined phase relationship.

At the time of assembly at a plant or factory, the wrapping machine of the foregoing construction must be subjected to an overall adjustment of operating timing for the operating elements of the infeed conveyance mechanism 1, film feeding mechanism 2, elevator mechanism 3, folding mechanism 4 and outfeed conveyance mechanism 5, and the machine must be put in proper operating order. Readjustments must be made at maintenance and servicing to restore the normal operating state in the event that any of the operating elements functions at an improper timing during use. Furthermore, to improve the appearance of the final package, it is necessary to adjust the operation timing of the movable guide member 72 for the grippers, as well as the operation timing of the left and right folding plates 21, 22, front folding plate 23 and movable guide members 65–67, 65′–67′.

When the wrapping machine is assembled and adjusted, or at the time of maintenance and servicing, the manufacturer adjusts the operation timing of the left and right folding plates 21, 22 operated by the electromagnetic clutch brake 117, the operation timing of the front folding plate 23 operated by the electromagnetic clutch brake 113, the operation timing of the discharge pusher 69 operated by the electromagnetic clutch brake 115, the operation timing of the film feeding mechanism 2 operated by the electromagnetic clutch brake 108, the open/close timing of the grippers 41 operated by the movable gripper guide member 72, the timing at which the film is cut by the cutter 43, and the timing at which each of the film clamping mechanisms is released by operating the movable guide members 65–67, 65′–67′.

The arrangement is such that the timing at which the film is cut by the cutter 43 and the timing at which the film clamps are released by operating the movable guide members 65–67, 65′–67′ can be adjusted by the user to deal with articles of different types, sizes, etc. These adjustments are made automatically by sensing, e.g., the type and size of the article through use of a photosensor or the like.

In the above embodiment, mechanical charts which serve as the basis for each operating section of the wrapping machine are each set with the counted value of the timing signal tpa serving as a reference. By way of example, the foregoing embodiment is so arranged that the slitted disk 84 makes one revolution for one cycle of wrapping machine operation and is provided with one of the slits TPA every 12°, or in other words, with 30 (=360°/12°) of the slits TPA. Accordingly, 30 of the timing signals tpa are generated during one cycle of wrapping machine operation, so that the mechanical chart of each operating section is set based on the number of timing signals counted, i.e., based on the angle through which the slitted disk 84 rotates.

Let us now describe in detail the operation timing adjustments for the various operating elements of the wrapping machine by taking the operation of front folding plate 23 as an example. In FIG. 29, the solid line indicates a basic mechanical chart set in the above-described manner. Plotted along the horizontal axis is a counted value TC obtained by counting the timing signals tpa from the timing detector 126. The front folding plate 23 starts to be moved toward the rear folding roller 24 (this operation will be referred to as a "closing operation" hereafter) at timing FT1 (TC=6). The closing operation is concluded at timing FT2 (TC=15), at which point the front folding plate 23 is brought to a stop. Next, the front folding plate 23 starts to be moved back to its original position (this operation will be referred to as an "opening operation" hereafter) at timing FT3 (TC=18), and the opening operation is ended at timing FT4 (TC=27). The closing operation for the front folding plate 23 is performed by energizing a clutch coil in the electromagnetic clutch brake 113, and the closing operation is stopped by energizing a brake coil in the electromagnetic clutch brake 113.

Let us now describe a case for individually adjusting the timing FT1 at which the closing operation of the front folding plate is started, the timing FT2 at which the closing operation is stopped, the timing FT3 at which the opening operation is started, and the timing FT4 at which the opening operation is stopped. Switches MSW1–MSW4 of the kind shown in FIG. 30 for adjusting the respective timings FT1–FT4 are provided at prescribed positions on a printed board. If there is no fear of the user mistakenly operating the switches MSW1–MW4, these switches need not necessarily be provided on a printed board but can be disposed on a control unit furnished for maintenance purposes. Each of the switches MSW1–MW4 is a changeover switch capable of being switched to any one of seven stages that range from dial graduations of −3 to +3. Information indicative of the position to which each of these switches MSW1–MSW4 has been set is converted into a predetermined signal by the encoder **122*b* (FIG. 22). The resulting signal is fed into the central processor 120**.

As shown in FIG. 31(A), the ROM **123*a* of the memory unit 123 is provided at a prescribed location with a basic timing storage area TMa for storing counted values TC=6, 15, 18, 27 indicative of the basic timings FT1, FT2, FT3, FT4 at which the closing and opening operations of the front folding plate 23 are performed. Also, as shown in FIG. 31(B), the RAM 123*b* of the memory unit 123** is provided with an adjusted timing storage area TRMa (hereafter referred to as an "operation timing register") for storing counted values TC indicative of the basic timings FT1, FT2, FT3, FT4 following their adjustment.

The CPU 120 adds or subtracts numerical values, which are designated by the position information from the switches MSW1–MSW4, to or from the counted values TC indicative of the timings FT1–FT4 and stored in the ROM 123*a*, and writes the numerical values that result from this arithmetical operation into the operation timing register TRMa. More specifically, assume that the switches MSW1–MSW4 are set to −1, −1, +1, +1, respectively, as depicted in FIG. 30. In such case, the central processor 120 adds or subtracts the numerical values designated by the switches MSW1–MSW4 to or from the counted values TC=6, 15, 18, 27 indicative of the respective basic timings FT1–FT4 and stored in the basic timing storage area TMa of the ROM 123*a*, and writes counted values TC=5, 14, 19, 28, which are indicative of timings FT1′–FT4′ for the closing and opening operations of the front folding plate 23 and which are the result of the above arithmetical operation, into the operation timing register TRMa of the RAM 123*b*. When this has been accomplished, the mechanical chart takes on the form indicated by the dashed line in FIG. 29. Whenever any of the switches MSW1–MSW4 has its setting changed, the central processor 120 functions in the above-described manner to rewrite the data in the part of the operation timing register TRMa corresponding to the switch operated.

Taking the front folding plate 23 as an example, we will now describe a specific control sequence for operating the various operating elements of the wrapping machine on the basis of the operation timing register TRMa.

Figure 32:
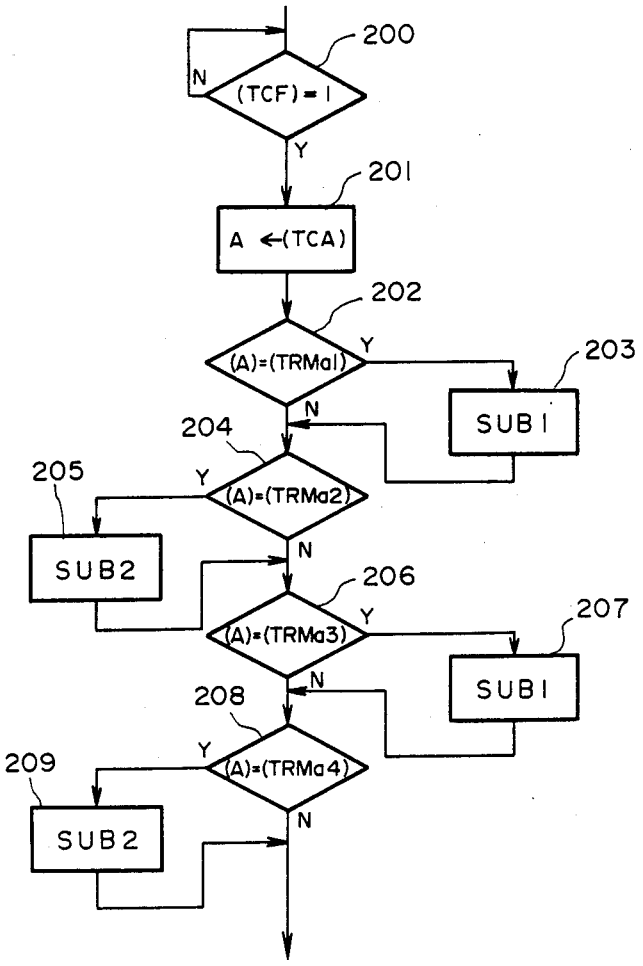
FIG. 32 is a flowchart illustrating a processing sequence for control of the front folding plate.

FIG. 32 is a flowchart illustrating the flow of the control operation. For the sake of description, we will let TRMa-1–TRMa-4 represent the parts of the register that store the counted values indicative of the timings FT1′–FT4′, respectively. The flowchart of FIG. 32 illustrates only the portions necessary for describing control of the operation of front folding plate 23.

When the central processor 120 is in the stand-by state, the processor monitors at a step 200 of the flowchart whether the counted value TC of timing signal tpa has been updated. The updating of the counted value TC is carried out through an interrupt processing routine whenever the timing signal tpa is applied, the signal tpa serving as an interrupt signal. In the interrupt processing routine, the updated counted value TC is written into a counted value register TCA provided in a predetermined area of the RAM 123*b*, and a flag TCF indicating that the counted value TC has been updated is set. Accordingly, the central processor checks for the flag TCF at step 200. In a case where the flag has been set, the data in the counted value register TCA is read from this register to an accumulator register A in the central processor 120 at a step 201. The data in the accumulator register A and the data in the register TRMa1 are then compared at a step 202. If the result of the comparison is that the two agree, the central processor 120 executes a subroutine SUB1 at a step 203. The subroutine SUB1 is a processing program for starting the operation of the front folding plate 23 and, in specific terms, constitutes sending a control signal to the drive circuit 125*d* through the input/output control circuit 124 to energize the clutch coil of the electromagnetic clutch brake 113. If the result of the comparison at the step 202 is non-agreement, then the data in the accumulator register A and the data in the register TRMa2 are compared at a step 204. If the result of the comparison here is agreement, then the central processor 120 executes a subroutine SUB2 at a step 205. The subroutine SUB2 is a processing program for stopping the operation of the front folding plate 23 and, in specific terms, constitutes sending a control signal to the drive circuit 125*d* through the input/output control circuit 124 to energize the brake coil of the electromagnetic clutch brake 113. If the result of the comparison at the step 204 is non-agreement, then the data in the accumulator register A and the data in the register TRMa3 are compared at a step 206. If the result of the comparison here is agreement, then the central processor 120 executes the subroutine SUB1 at a step 207. If the result of the comparison at the step 206 is non-agreement, then the data in the accumulator register A and the data in the register TRMa4 are compared at a step 208. If the result of the comparison here is agreement, then the central processor 120 executes the subroutine SUB2 at a step 209. In case of non-agreement, subsequent processing is executed.

The case described above deals with the front folding plate 23. In actuality, however, basic counted values TC are stored in the basic timing storage areas TMa of ROM 123*a* and corresponding changeover switches for adjustment are provided for the operation timing of all operating elements that are subject to adjustment. The values decided by the basic counted values and the changeover switches for adjustment are written into the respective timing registers set in the predetermined area TRMa of the RAM 123*b*. Whenever a counted value TC is updated it is compared with the data in the respective operation timing register and, when the two agree, processing predetermined in relation to the respective operation timing register is executed.

Figure 36:
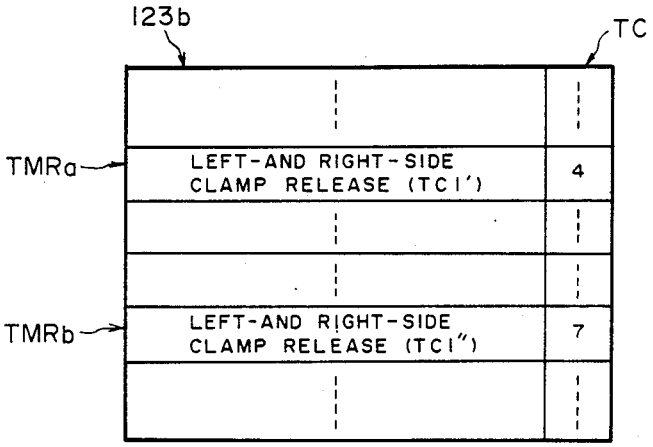
FIG. 36 is a view schematically showing an operation timing register and a basic timing register of the RAM.

The foregoing description is for a case where the operation timing for each operating element is adjusted by manipulating the timing adjustment switch 122*a* of the timing adjustment unit 122 during assembly, inspection or maintenance performed on the side of the manufacturer. However, as described above, it is so arranged that some of the operation timings for respective operating elements, e.g., the timings for operating the movable left and right guide members 65, 67, 65′, 67′ and the timing for stopping the film feeding mechanism are adjusted by manipulating adjustment switches of the control unit 121*a* provided on the control and display panel 121 or on the basis of detection information from the article size sensing unit 128. In such case, the predetermined area of RAM 123*b* is provided with a basic timing register TRMb, as shown in FIG. 36, in addition to the operation timing register TRMa, for storing timing values adjusted by the manufacturer. Timing values decided by basic timing count values TC stored beforehand in the basic timing storage area TMa of ROM 123*a* and by position information from adjustment switches for use by the manufacturer are stored in the basic timing register TRMb, operation timing values decided by timing values stored in the basic timing register TRMb and by position information from adjustment switches of the control unit 121*a* for manipulation by the user are stored in the operation register TRMa, and the corresponding operating elements are controlled on the basis of the timing values stored in the operation register TRMa.

Described next as a specific example of a timing adjustment performed on the user side will be the adjustment of timing at which the clamping of left and right edges of the stretchable film is released. This entails actuating the movable right and left guide members 65, 67, 65', 67' to release the grippers 41, 41' engaging therewith.

Figure 33:
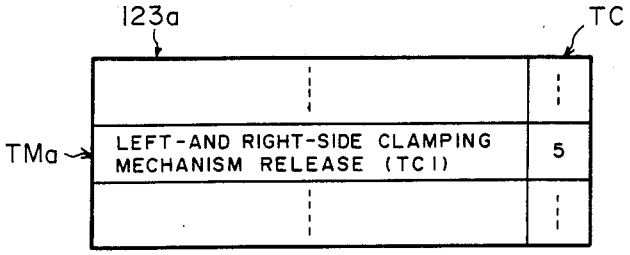
FIG. 33 is a view schematically showing a basic timing storage area of the ROM storing the timing at which left and right side clamping mechanisms are released.
Figure 34:
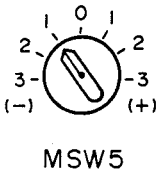
FIG. 34 shows an example of a switch operated by the manufacturer for adjusting release timing.
Figure 35:
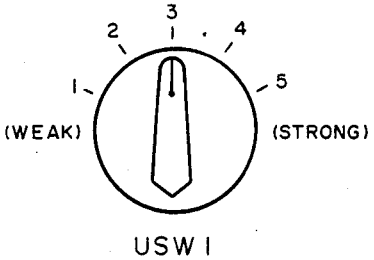
FIG. 35 shows an example of a switch operated by the user for adjusting release timing.

Let us assume that the basic timing counted value TC indicative of the timing TC1 for releasing the clamping of the left and right edges of the film is set to 5. As shown in FIG. 33, the counted value TC (=5) indicative of the timing for releasing the clamping of the left and right edges of the film is stored in the basic timing storage area TMa of the ROM 123*a*. The timing adjustment unit 122 is provided with a switch MSW5, of the kind shown in FIG. 34, which is operated by the manufacturer for adjusting the release timing TC1. Like the changeover switches MS1–MS4, the switch MSW5 is a changeover switch capable of being switched to any one of seven stages that range from dial graduations of −3 to +3. As shown in FIG. 35, the control unit 121*a* of the control panel is provided with a user-operated adjustment switch USW1 for adjusting the timing TC1 at which left and right clamping is released. Since the tensioned state of the wrapping film can be adjusted by changing the film clamping release timing, the switch USW1 is referred to as a tension adjustment switch. Setting a large counted value for the release timing increases film tension, while setting a small counted value decreases film tension. The adjustment switch USW1 is capable of being switched to any one of five stages that range from dial graduations of 1 to 5. Each graduation corresponds to a numerical value added to the counted value TC. As shown in FIG. 36, the RAM 123*b* is provided with an operation timing register TMRa and semibasic timing register TMRb which correspond to the switch MSW5 for adjustment by the manufacturer. A counted value TC=4 indicative of semibasic left and right clamp release timing TC1' is stored in the semibasic timing register TMRb. The counted value TC=4 is decided by the central processor 120 based on the counted value 5 indicative of the left and right clamp release timing TC1 stored in the basic timing register TMa shown in FIG. 33 and the information −1 indicative of the position to which the switch MSW5 for adjustment by the manufacturer has been set. A counted value TC=7 indicative of left and right clamp release timing TC1'' is stored in the operation timing register TMRa. The counted value TC=7 is decided by the central processor 120 based on the counted value TC=4 stored in the register TMRb and the information 3 indicative of the position to which the switch USW1 for adjustment by the user has been set. When the counted value stored in the operation timing register TMRa and the timing signal counted value in the counted value register TCA agree, the movable left and right guide members 65, 67, 65', 67' are actuated to release the grippers 41, 41' engaging therewith, just as in the case described above. Thus, setting the manufacturer-operated adjustment switch MSW5 changes the range over which timing values are capable of being adjusted by the switch USW1 for operation by the user.

The manner in which the apparatus of the illustrated embodiment is adjusted at the time of assembly will now be described. First, following assembly of the mechanical components, all of the switches MSW for adjustment by the manufacturer are set to the graduation "0", and all of the switches MSW for operation by the user are set to a prescribed graduation, i.e., "1". The apparatus is then put into operation. If such mechanical conditions as machining precision and mounting precision conform exactly to design, the apparatus will operate in conformance with predetermined mechanical charts and no adjustments should be necessary. In actuality, however, operation usually does not conform to design due to structural errors ascribable to machining or assembly. In such case, the operation timing of each operating element is adjusted by manipulating the adjustment switches MSW for use by the manufacturer. As an example, the switch MSW1 is turned in the minus direction if the timing at which the closing operation for the front folding plate 23 is to start lags behind the designed timing. Upon setting the switch MSW1, the apparatus is put into operation again to confirm whether it is operating normally, i.e., in conformance with design. The position to which the switch MSW1 is eventually set is decided by repeating this operation. This adjustment is performed for all operating elements whose timing is improper.

Adjustment of elements operating at an improper timing can also be performed during maintenance and serving through a method similar to that just described.

Thus, the control apparatus of the foregoing embodiment is capable of adjusting the operation timing of each operating element of the wrapping machine electrically and digitally through simple manipulation of a variety of switches. This greatly facilitates the timing adjustment operation by dispensing with complicated mechanical adjustments of operating elements as in the prior art. Moreover, since the operation timings of elements requiring adjustment can be adjusted independently of one another, changing the timing of one operating element has no effect upon the timing of other operating elements. As a result, the adjustment operation is very simple, special knowledge amount the various mechanisms constituting the wrapping machine is unnecessary, and it is possible to standardize the adjustment operation.

The apparatus of the foregoing embodiment is so arranged that information indicative of the position to which each adjustment switch is set is used as numerical value data, the counted value TC indicative of the operation timing of each operating element is obtained by processing performed by the central processor 120 based on these numerical value data and basic timing counted values stored in the ROM 123*a*, and the counted values TC are written into the registers TRMa, TRMb. However, the invention is not limited to such an arrangement, for it is clear from the above description of the control apparatus of the illustrated embodiment that it will suffice if it is so arranged as to obtain, by manipulation of adjustment switches, counted values indicative of adjusted operation timings of elements requiring such adjustment, and to write these counted values in the operation timing register. For example, an arrangement as shown in FIG. 37 can be adopted. Here, all counted values needed for effecting adjustment are stored beforehand in the basic timing storage area TMa of ROM 123*a* as basic timing values of the various operating elements, and all items of information indicative of the positions of an adjustment switch MSW1' are stored in the storage area TMa as addresses. Then, by changing the setting of the adjustment switch MSW1', one counted value is selected from among the stored counted values and is written into the operation timing register TMRa of RAM 123*b*. In the illustrative example, the counted value "6" is selected by the information indicating position "1" of the adjustment switch MSW1', and this value is stored in the operation timing register TMRa. Although this arrangement requires that the basic timing storage area TMa of ROM 123*a* have a large capacity, it eliminates the need for the central processor to perform processing to obtain counted values as the operation timings of the wrapping machine elements, as in the above-described embodiment.

Since the counted values of the timing signal tpa are the minimum controllable units in the foregoing embodiment, the "width" of an operation timing adjustment is limited to one count. More specifically, since the spacing between the adjacent slits TPA formed in the slitted disk 84 is 12°, 30 count pulses are generated by one full revolution of the slitted disk 84. Consequently, in a case where the time needed for one cycle of wrapping machine operation (the time needed for one revolution of the slitted disk 84) is set to two seconds, the minimum adjustable width is limited to 67 msec, which is one count of the timing signal tpa (i.e., one count = 67 msec). Adjustment finer than this length of time is, therefore, not possible. Accordingly, if an adjustment within one count is required, a technique that can be adopted is to employ a timer and set operation timing by using the counted value of the timing signal tpa and a delay time measured from this counted value, the timer being utilized for the time delay. A case will now be described in which operation timing is adjusted over a range of one-half of a count.

As shown in FIG. 38(A), the setting positions of an adjustment switch MSW6 are assigned the meanings shown in FIG. 38(B). To this end, the operation timing register TRMa of RAM 123*b* is provided with a section for storing the counted values TC and a section for storing delay time information Tm. Assume now that the counted value indicative of basic timing and stored in ROM 123*a* in correspondence with the adjustment switch MSW6 is "5". Then, when the position to which the switch MSW6 is set is "−1", "4" (4=5−1) is written into the section of RAM 123*b* storing the counted values TC and "1" is written into the section storing the delay time information. Whenever the counted value TC of the timing signal tpa is updated, the central processor 120 compares the counted value TC with the counted value TC in the section of the operation timing register that stores the counted values. When the result of the comparison shows agreement, namely when the updated counted value TC is "4" in the illustrative example, the central processor checks the delay time information Tm. In the illustrative example, the delay time information is "1", which means that a delay of one-half count (=33 msec) is applied. Therefore, the central processor 120 starts the programmable timer 127 (see FIG. 22) counting for 33 msec. When 33 msec elapses, the programmable timer 127 provides the central processor 120 with an interrupt signal to inform the processor of the fact. Upon receiving this signal, the central processor 120 executes a processing program corresponding to the operation timing register TRMa. Adopting such an arrangement enables an adjustment to be performed over a width of one-half count. Though the delay time information is set by the adjustment switch MSW6 in the above embodiment, it is of course possible to adopt an arrangement in which counted values serving as basic timing data and delay time information are set in a ROM beforehand.

Figure 40:
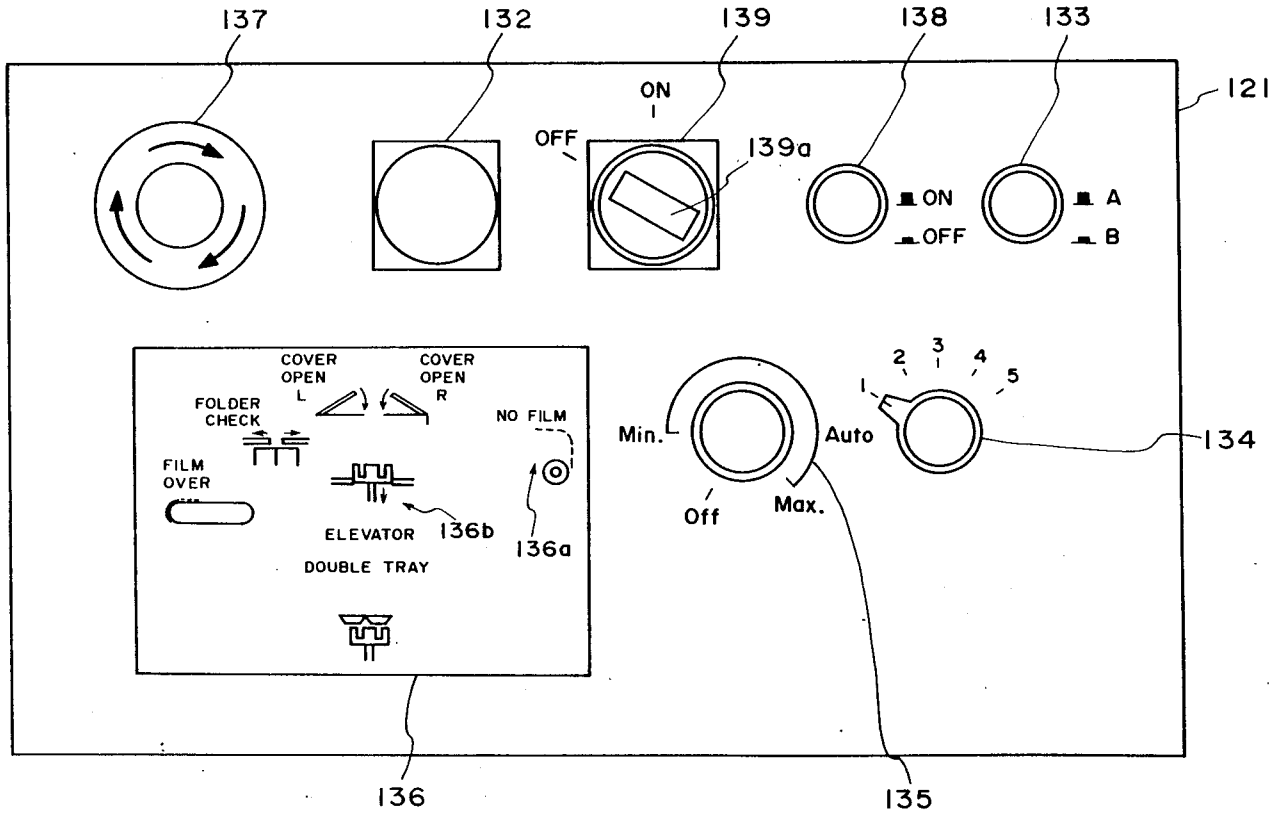
FIG. 40 is a plan view showing the external appearance of a control and display panel of the wrapping machine of the present invention.

FIG. 40 illustrates a control and display panel, which corresponds to the control and display panel 121 shown in FIG. 22. The control and display panel 121 is provided with a power switch 139 having a knob 139*a*, a manual operation button 132, a tray changeover button 133, a tray changeover switch 134, a heater temperature adjustment knob 135, a verification monitor 136, an emergency stop button 137, and a clutch release button 138.

The power switch 139 cuts off power when the knob 139*a* is turned to the OFF position, and introduces power when the knob 139*a* is turned to the ON position. The manual operation button 132 places the wrapping machine in the manual operation mode by being pressed. The tray changeover button 133 is for selecting the type of tray which receives the article to be wrapped. For example, if the tray comprises a strong and rigid material such as styrofoam, the button is placed in the raised position A. If the tray comprises soft and pliable material such as polypropylene, the button is placed in the depressed position B. The tray changeover switch 134 has five stages of from 1 to 5 corresponding to the sizes of the trays that receive the article to be weighed. The switch 134 also has an AUTO position. When this is the position chosen, a changeover is made in such a manner that the sizes of trays fed in are measured automatically by sensors, described below, provided on the infeed conveyance mechanism 1. The heater temperature adjustment knob 135 is for adjusting the temperature of the heating belt 71 in the outfeed mechanism 5. The verification monitor 136 is for verifying the status of each operating section of the wrapping machine. For example, the monitor 136 includes a display section 136*a* for indicating the fact that the stretchable film has run out, a display section 136*b* for displaying the status of the elevator mechanism 3, and other useful display sections. The emergency stop button 137 is for bringing the wrapping machine to an emergency stop when an emergency develops such as the jamming or turn-over of article to be wrapped, non-supply of the film, etc. The clutch release button 138 is for releasing the electromagnetic clutch brakes 108, 113, 115, 117 (FIG. 12) to enable manual movement of the elements constituting the various wrapping machine mechanisms when the wrapping machine has been brought to an emergency stop by pressing the emergency stop button 137.

When wrapping an article in stretchable film, the degree of film tension greatly influences the final appearance of the wrapped article. In order to obtain a constant film tension, factors which play a critical role are the size of the article to be wrapped, the rigidity of the tray, and the timing at which the left, right and central clamping mechanisms are caused to release their hold on the stretchable film at folding. Accordingly, it goes without saying that how these factors are controlled to obtain a constant stretchable film tension decides the attractiveness of the final package.

Figures 41, 42, 43:
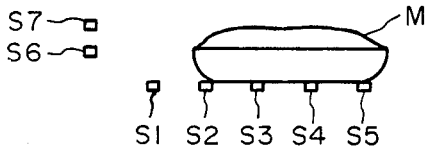
FIG. 41 is a view showing the general arrangement of sensors for sensing the size of an article to be wrapped.
FIG. 42 is a table depicting the relationship between a number of actuated sensors and subdivisions a through e indicative of the size of an article to be wrapped.
FIG. 43 is a table showing the relationship between the article size subdivisions a through e and timings TCa, TCb, TCc, TCd at which left and right clamping mechanisms are released, a central clamping mechanism is released, a film is cut and a chain conveyor is halted, respectively.
Figure 44:
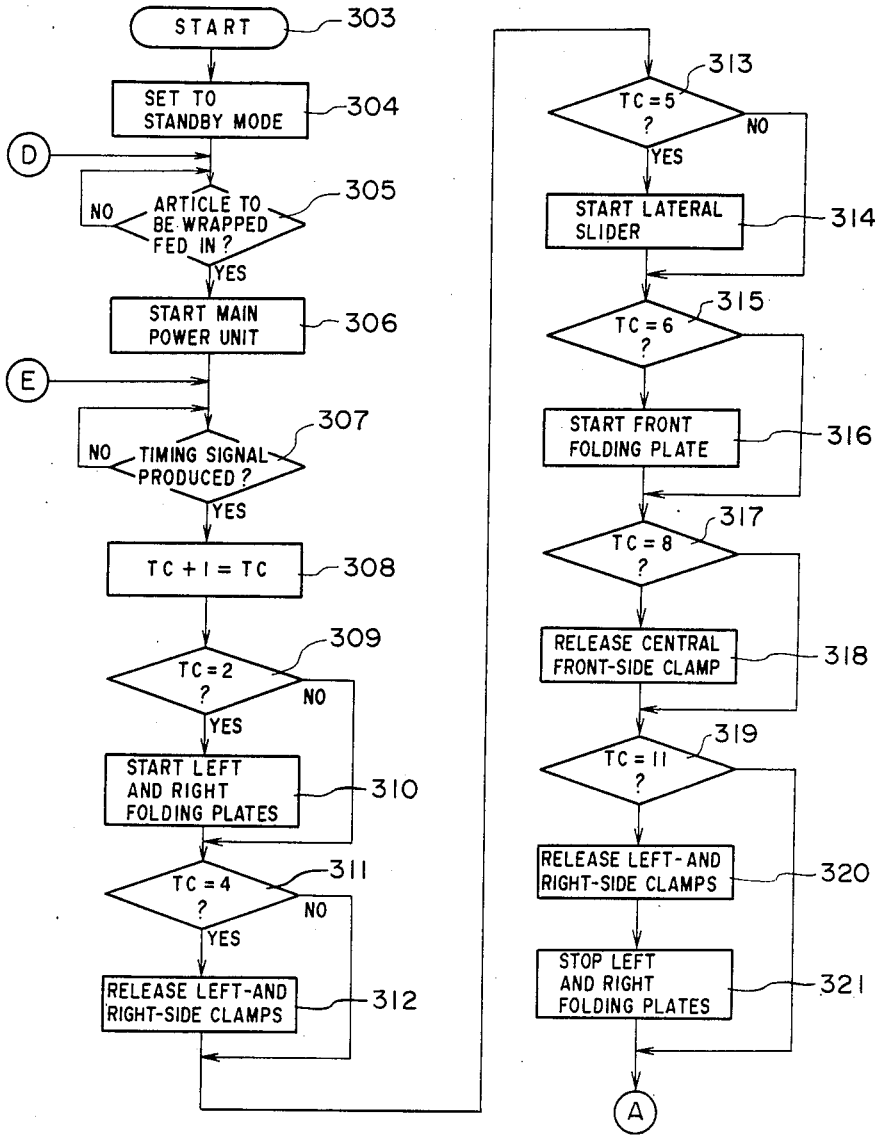
FIGS. 44(A), 44(B), 44(C) and 44(D) are flowcharts illustrating a control processing sequence executed by the control apparatus of the wrapping machine of the present invention.
Figure 44B:
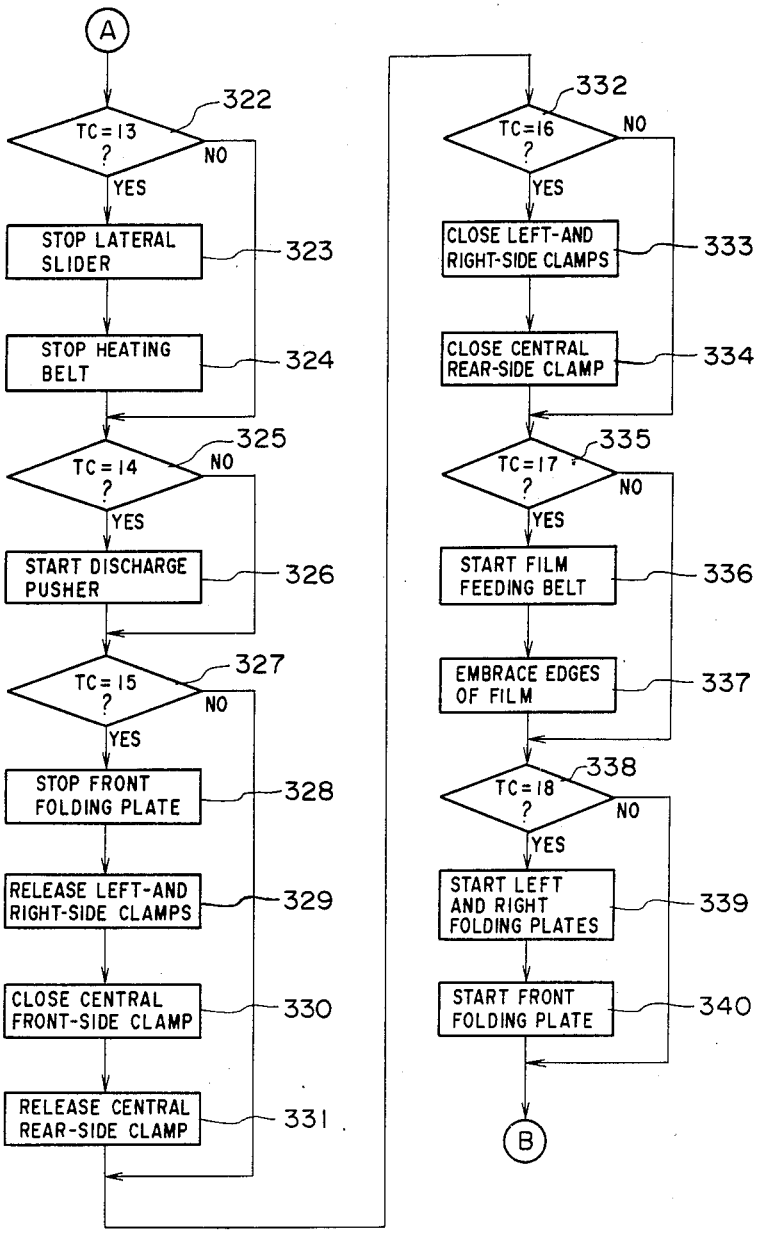
Figure 44:
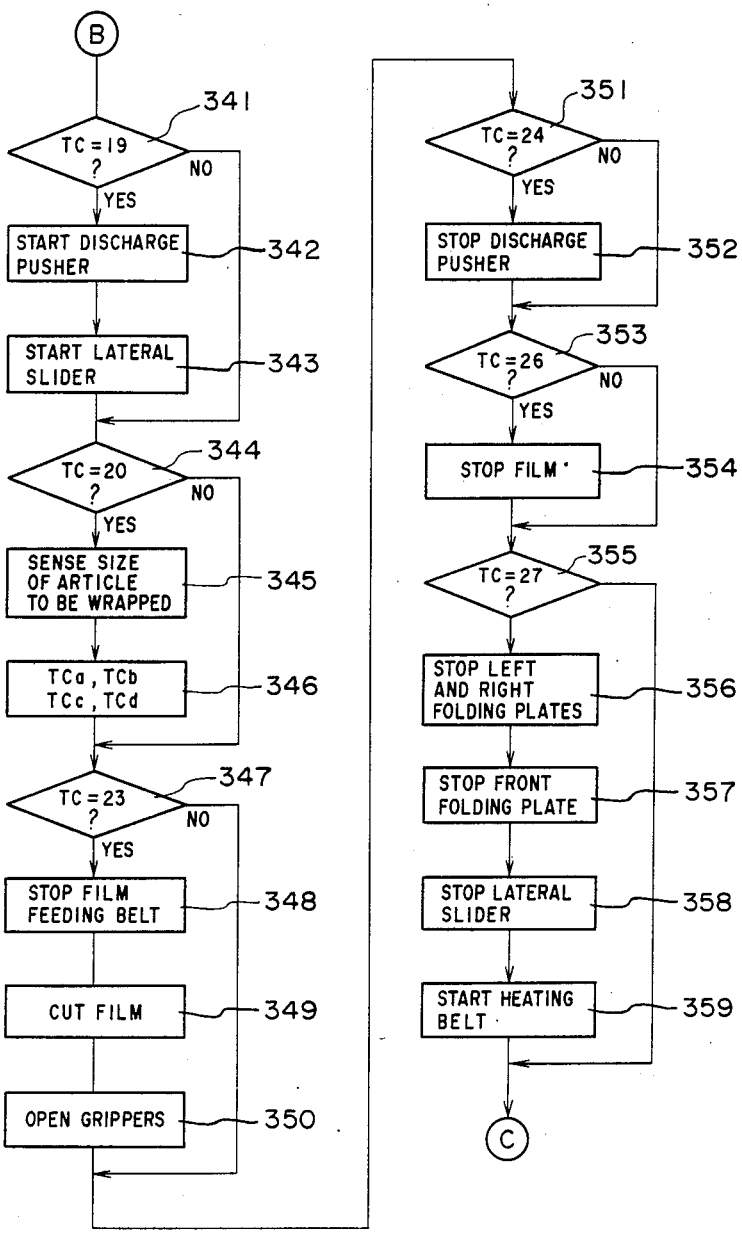
Figure 44:
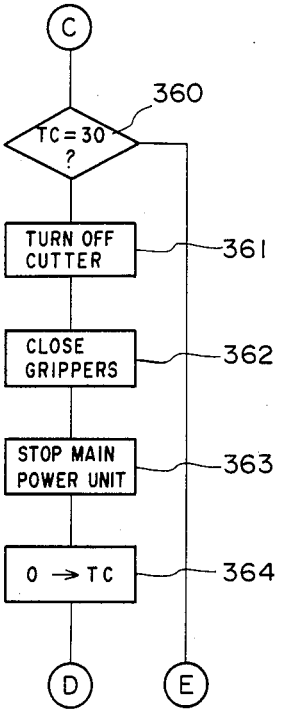
Figure 45A:
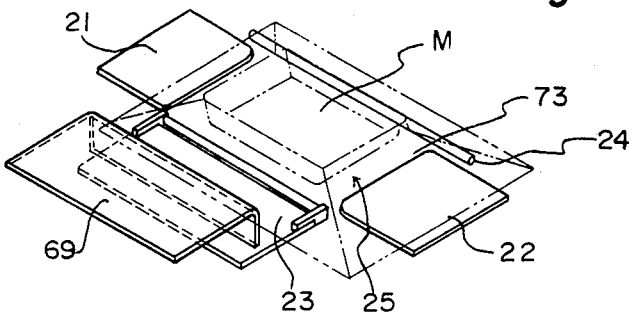
FIGS. 45(A), 45(B), 45(C) and 45(D) are views schematically illustrating the operation of a folding mechanism included in the wrapping machine of the present invention.
Figure 45B:
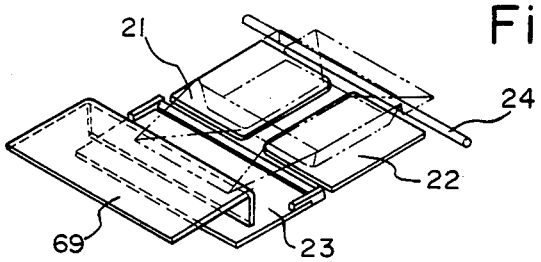
Figure 45C:
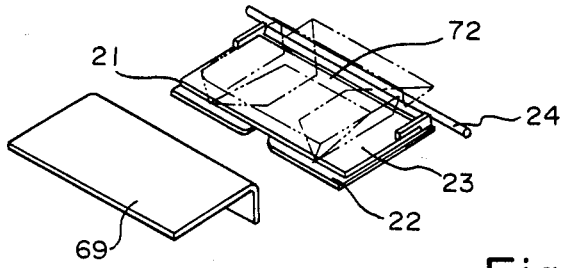
Figure 45D:
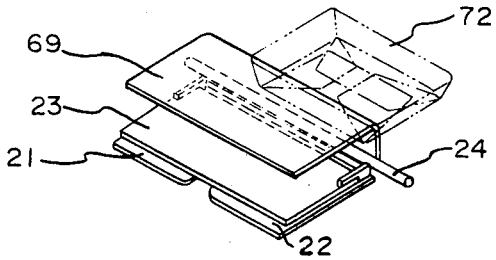

Though the size of an article to be wrapped depends upon the size of the tray, tray size is predetermined. Therefore, either the size of the tray used is set by the tray changeover switch 134, or the tray changeover switch 134 is set to AUTO and the size of the article to be wrapped is sensed by the size sensors, as shown in FIG. 41. Setting the switch 134 to the AUTO position is particularly effective when continuously dealing with mixed trays of different sizes. In FIG. 41, S1–S5 denote sensors for sensing the width of the article M to be wrapped, and S6, S7 designate sensors for sensing the height of the article M. These sensors are provided at the article infeed entryway to the infeed conveyance mechanism 1 for automatically sensing the sizes of the articles fed in. It should be noted that the "length" of a tray or article to be wrapped refers to the dimension of the tray in the direction of movement thereof, and that "width" of the tray or article refers to the dimension of the tray perpendicular to the direction of movement.

FIG. 42 illustrates a table in which the sizes of articles to be wrapped are broken down into five categories a, b, c, d, e based on width and height.

Initially, a first article to be wrapped is fed in on the infeed conveyance mechanism 1 and is then conveyed on the belt conveyor 15 unit it abuts against the positioning plate 20 and is stopped thereby. In this state, a second article to be wrapped is fed in and a weight stability signal is produced. In response to this signal, the elevator bed 17 is raised, the left and right folding plates 21, 22 are moved toward the opening 25, the timing at which the grippers 41 and 41' engaging with the left and right movable guide members 65, 65' and 67, 67' are released (namely the timing at which the left- and right-side clamping mechanisms are released) is assumed to be TCa, the front folding plate 23 is then advanced, the timing at which the grippers 41' engaging the central movable guide member 66' are opened is assumed to be TCb, the stretchable film is fed, the timing (hereafter referred to as "film cut timing") at which the stretchable film is cut by the cutter 43 is assumed to be TCc, the cut length of stretchable film is advanced, and the timing (hereafter referred to as "chain conveyor stop timing") at which the center of the cut length of stretchable film is brought into agreement with the center of the opening 25 is assumed to be TCd.

In general, the timing for starting the operation of the left and right folding plates 21, 22 is fixed, and the longer the timing TCa at which the left and right grippers are released, the tighter the film will be stretched. If the tray is large and possessed of little rigidity, however, the timing TCa should be shortened. The same generally holds true for the front gripper release timing. The film cut timing TCc conforms to the size of the tray. Cutting is performed at a delayed timing for large trays and at a more advanced timing for small trays.

FIG. 43 is a table showing the relationship between the sizes of the aforementioned five categories a, b, c, d, e of articles to be wrapped and the left-right gripper release timing TCa, front gripper release timing TCb, cut timing TCc and a timing TCd at which film feed ends. The numerals in the table of FIG. 43 indicate a timing count from the main timing sensor 126 (FIG. 22) described below, and the numerals in the parentheses indicate timing counts for trays having great rigidity.

Control of a wrapping operation performed by the wrapping machine of the present invention will now be described with reference to the wrapping machine control apparatus of FIG. 22 and the flowcharts of FIGS. 44(A) through 44(D). These flowcharts illustrate operation for a case where the initial article to be wrapped has a size d, for which article TCa=4, TCb=8, TCc=27, TCd=28 shall hold, and where the next article to be wrapped has a size b, for which article TCa=6, TCb=10, TCc=23, TCd=26 shall hold.

The first step is step 303, which calls for the power switch 139 to be placed in the ON position to start the operation of the wrapping machine. Next, the wrapping machine is placed in a standby mode at a step 304 for the initial setting of status flags and the like (timing TC=0), the checking of various sensors and the verification of apparatus status. This is followed by a step 305 at which it is determined whether an article to be wrapped has been fed in, and then by a step 306 for starting the main power unit 129 if the decision at the step 305 is affirmative. Here the pusher conveyor 13 and belt conveyor 15 begin circulating and, in synchronism therewith, the elevator mechanism 3 begins to be raised by the elevator cam 93.

Next, whether or not the timing signal is being produced by the main timing sensor 126 comprising the slitted disk 84 and sensor 85 is monitored at a step 307. In the absence of the timing signal, the system waits until the signal arrives. The timing signal acts as an interrupt signal with respect to the central processor 120. Each time an interrupt is produced by the timing signal, the central processor 120 adds 1 to the counted value TC to increment the same at a step 308. Next, it is determined at a step 309 whether the incremented counted value TC is 2. If it is, the elevator bed 17 is at its uppermost position and, hence, the left and right folding plates 21, 22 start to be moved toward the center of the opening 25 at a step 310 [see FIGS. 16(A), 16(B), 17(A), 17(B)].

When the decision rendered at the step 309 is that the counted value TC is not equal to 2, or when the processing of step 310 is concluded, it is determined at a step 311 whether the counted value TC is equal to 4. If it is, the left-and right-side clamping mechanisms clamping the longitudinal edges of the stretchable film are released at a step 312 [see FIGS. 18(A), 18(B)]. The left and right clamping mechanism releasing timing, namely the release counted value TC, is decided by referring to the table of FIG. 43. When the decision at the step 311 is that the counted value TC does not equal 4, or when the processing of step 312 is concluded, it is determined at a step 313 whether the counted value TC equals 5. If it does, the lateral slider 70 starts to be moved at a step 314 to position it over the heating belt 71.

When the decision at the step 313 is that the counted value TC does not equal 5, or when the processing of step 314 is concluded, it is determined at a step 315 whether the counted value TC equals 6. If it does, the front folding plate 23 starts to be moved at a step 316 toward the opening 25 [see FIGS. 19(A), 19(B)].

When the decision at the step 315 is that the counted value TC does not equal 6, or when the processing of step 316 is concluded, it is determined at a step 317 whether the counted value TC equals 8. If it does, the central front-side clamping mechanism is released at a step 318 to release the front edge of the stretchable film.

When the decision at the step 317 is that the counted value TC does not equal 8, or when the processing of step 318 is concluded, it is determined at a step 319 whether the counted value TC equals 11. If it does, the left and right-side clamping mechanisms are closed at a step 320 and the advance of the left and right folding plates 21, 22 is stopped at a step 321. Note that though the left- and right-side clamping mechanisms are closed at the step 320, it will suffice if this is performed by the time the film is fed. However, the left- and right-side clamping mechanism closing operation is performed at the instant of step 320 in view of conserving power. At the completion of left and right edge folding at step 321, the elevator bed 17 may be lowered since the left and right folding plates 21, 22 are holding the article M to be wrapped. The arrangement is such that the elevator bed 17 is lowered by the elevator operating cam 93 when the counted value TC becomes equal to 12 (i.e, TC=12) [see FIGS. 21(A), 21(B)]. In the above embodiment, the stopping of the left and right folding operation is controlled by the timing signal from the slitted disk 84. However, as shown in FIG. 22, it is possible to adopt an arrangement in which the positions of the left and right folding plates 21, 22 are sensed by the position sensor 141 and the motion of the left and right folding plates is stopped when these folding plates attain predetermined positions. Note, however, that if control is based upon the counted value TC of the timing signal from the slitted disk 84, the folding plate stopping position can be changed at will depending upon the width of the article to be wrapped. This is an advantageous arrangement because an attractively wrapped package can always be obtained irrespective of the size of the article to be wrapped.

When the decision at the step 319 is that the counted value TC does not equal 11, or when the processing of step 321 is concluded, it is determined at a step 322 whether the counted value TC equals 13. If it does, the lateral slider 70 is stopped at a step 323 at a predetermined position above the heating belt 71. The heating belt 71 is then stopped at a step 324. Control for moving the lateral slider 70 to the predetermined position may also be performed as shown in FIG. 22. Specifically, the slider 70 may be arranged to be stopped when it is sensed by the position sensor 144 that the slider 70 has reached the predetermined position. When the lateral slider 70 is at the predetermined position above the heating belt 71, it is unnecessary for the heating belt 71 to be circulated. It is for this reason that the heating belt is stopped at the step 324.

When the decision at the step 322 is that the counted value TC does not equal 13, or when the processing of step 324 is concluded, it is determined at a step 325 whether the counted value TC equals 14. If it does, the discharge pusher 69 is driven at a step 326 to push the article M to be wrapped onto the lateral slider 70 [see FIGS. 20(A), 20(B), 21(A), 21(B)]. At this time the elevator bed 17 is at its lowermost position so that it is possible for the article M to be transferred above the elevator bed 17 by the push conveyor 13 and belt conveyor 15.

When the decision at the step 325 is that the counted value TC does not equal 14, or when the processing of step 326 is concluded, it is determined at a step 327 whether the counted value TC equals 15. If it does, the front folding plate 23 is stopped at a step 328, the left- and right-side clamping mechanisms are released at a step 329, the central front-side clamping mechanism is closed at a step 330, and the central rear-side clamping mechanism is released at a step 331. The front folding plate 23 may be stopped at the step 328 by sensing, by means of the position sensor 142 shown in FIG. 22, that this folding plate has reached a predetermined position. However, if control is effected based on the counted value TC of the timing signal from the slitted disk 84, this will make it possible to change the stopping position in accordance with the length of the article to be wrapped. The reason for releasing the left- and right-side clamping mechanisms at the step 329 is as follows. Since the central rear-side clamping mechanism is released at the next step 331, the left-and right-side clamping mechanisms, closed at the step 320, are re-released in order to assure the release of the film.

When the decision at the step 327 is that the counted value TC does not equal 15, or when the processing of step 331 is concluded, it is determined at a step 332 whether the counted value TC equals 16. If it does, the left- and right-side clamping mechanisms are closed at a step 333 and the central rear-side clamping mechanism is closed at a step 334.

When the decision at the step 332 is that the counted value TC does not equal 16, or when the processing of step 334 is concluded, it is determined at a step 335 whether the counted value TC equals 17. If it does, the film feeding belts 39, 39', 40, 40' are started at a step 336 and both edges of the stretchable film are embraced by the grippers 41, 41' and round rubber belts 42, 42' at a step 337.

When the decision at the step 335 is that the counted value TC does not equal 17, or when the processing of step 337 is concluded, it is determined at a step 338 whether the counted value TC equals 18. If it does, the left and right folding plates 21, 22 start to be moved toward their initial positions at a step 339 and the front folding plate 23 starts to be moved toward its initial position at a step 340. Since movement of the article M to the lateral slider 70 is almost complete at this time, the front folding plate 23 may be retracted at the step 340 without problems.

When the decision at the step 338 is that the counted value TC does not equal 18, or when the processing of step 340 is concluded, it is determined at a step 341 whether the counted value TC equals 19. If it does, the discharge pusher 69 starts to be moved toward its initial position at a step 342 and the lateral slider 70 is started at a step 343 to move the article M laterally.

When the decision at the step 341 is that the counted value TC does not equal 19, or when the processing of step 343 is concluded, it is determined at a step 344 whether the counted value TC equals 20. If it does, the size of the article to be wrapped is sensed at a step 345, whereby the size of the article is decided from the table shown in FIG. 42 (it being assumed here that the size is category b). Next, at a step 346, it is decided from the table shown in FIG. 43 that left- and right-side clamp releasing timing TCa=6, central front-side clamp releasing timing TCb=10, film cut timing TCc=23 and film feed timing TCd=26.

When the decision at the step 344 is that the counted value TC does not equal 20, or when the processing of step 346 is concluded, it is determined at a step 347 whether the counted value TC equals 23. If it does, the stretchable film feeding belts 39, 39' are stopped at a step 348, the cutter drive mechanism 44 is started to cause the cutter 43 to cut the stretchable film at a step 349, and the grippers 41, 41' engaging with the movable guide members 72 on that side of the feeding belts 39, 39' and 40, 40' upstream of the cutter 43 are released at a step 350 in order to set the stretchable film. The process of step 350 is to prevent the feed of the uncut film.

When the decision at the step 347 is that the counted value TC does not equal 23, or when the processing of step 350 is concluded, it is determined at a step 351 whether the counted value TC equals 24. If it does, the discharge pusher 69 is stopped at its initial position at a step 352. The discharge pusher 69 may be stopped at the step 352 by sensing, by means of the position sensor 143 shown in FIG. 22, that it has reached its initial position.

When the decision at the step 351 is that the counted value TC does not equal 24, or when the processing of step 352 is concluded, it is determined at a step 353 whether the counted value TC equals 26. If it does, the chain conveyors 57, 57' are stopped at a step 354 to halt the cut length of stretchable film.

When the decision at the step 353 is that the counted value TC does not equal 26, or when the processing of step 354 is concluded, it is determined at a step 355 whether the counted value TC equals 27. If it does, the left and right folding plates 21, 22 are stopped at their initial positions at a step 356, the front folding plate 23 is stopped at its initial position at a step 357, the lateral slider 70 is stopped at its initial position at a step 358, and the heating belt 71 is started at a step 359. The left and right folding plates 21, 22, the front folding plate 23 and the lateral slider 70 may be stopped at the respective steps 356, 357, 358 by sensing, by means of the position sensor 144 shown in FIG. 22, that these elements have reached their initial positions. By starting the heating belt 71, an article wrapped in the stretchable film is fed out while having a label automatically affixed thereto by the labeler 140*c*, the label bearing such printed information as price based on, e.g., the article weight sensed by the sensor 140*a*. It should be noted that the processing for calculating price based on the weight signal from the weigher 14, printing the price together with product name data on the label and automatically affixing the label to the wrapped package is controlled by the label affixing control unit 140 and that this is carried out separately of wrapping machine control. However, since one article is wrapped in two cycles according to the wrapping machine of the present invention, the printed data employs data representative of the article of the immediately previous cycle.

When the decision at the step 355 is that the counted value TC does not equal 27, or when the processing of step 359 is concluded, it is determined at a step 360 whether the counted value TC equals 30. If it does, the film cutter 43 is turned off at a step 361, grippers 41, 41' on that side of the feeding belts 39, 39' and 40, 40' upstream of the cutter 43 are closed at a step 362, the main power unit, namely the motor 16, is stopped at a step 363 to halt the infeed conveyance mechanism 1 comprising the pusher conveyor 13 and belt conveyor 15, and the timing counter is reset at a step 364 to make the counter value TC equal to zero, i.e., TC=0. This ends one cycle of operation, whereupon the program returns to the step 305 to monitor the feed-in of the next article to be wrapped. The operating sequence described above is executed continuously. If the decision at the step 360 is that the counted value TC does not equal 30, then the program returns to the step 307 to monitor the input of the next timing signal.

The above flowchart is for describing the general features of control processing in the wrapping machine of the present invention and the incrementing of the counted value TC at the steps 307, 308 is performed by a main processing routine. However, in the flowchart of the control program actually used, the usual practice is to adopt a processing method in which the counted value TC is incremented as an interrupt processing routine at the instant an interrupt is produced by the timing signal, a flag informing of the event is set, and the flag is monitored with the main processing routine.

Further, in the above embodiment, the release timing values of the clamping mechanisms are changed in dependence upon the size of the article to be wrapped in order to adjust the tensioned state of the film used in wrapping the article. However, the tensioned state of the film can also be adjusted in a similar manner by holding the release timing values of the clamping mechanisms fixed and varying the operation start timing values of the left, right and front folding plates 21, 22, 23, respectively, in dependence upon the size of the article to be wrapped. In addition, the structure of the above embodiment is such that the timing value at which operation of the left and right folding plates 21, 22 starts is varied independently of the timing value at which operation of the front folding plate 23 starts. Therefore, even if the tray is small so that the cut length of stretchable film is set small in comparison with the initial spacing between the left and right folding plates 21, 22, the operation start timing value of the left and right folding plates 21, 22 is changed in accordance with the cut length of stretchable film, thereby enabling control to be exercised in such a manner that the cut length of film is larger than the spacing between the left and right folding plates 21, 22 when the film covering the article to be wrapped passes between the plates 21, 22 by raising the elevator bed 17. The range of wrappable tray sizes is therefore very wide.

The operation of the folding mechanism 4 of the illustrated embodiment is as shown in FIG. 45. First, as shown if FIG. 45(A), the article M to be wrapped, which is contained in a tray, is raised by the elevator bed 17 into engaging contact with a cut length of film F extended below the opening 25 formed by the left and right folding plates 21, 22, the front folding plate 23 and the rear folding roller 24. Next, as shown in FIG. 45(B), the left and right folding plates 21, 22 are moved toward the center of the opening 25 to fold the left and right edge portions of the stretchable film F under the tray. The front folding plate 23 is then moved toward the center of the opening 25 to fold the front edge portion of the stretchable film F under the tray, as depicted in FIG. 45(C). Thereafter, the discharge pusher 69 pushes the tray so that the rear edge portion of the stretchable film F is folded under the tray by the rear folding roller 24, as shown in FIG. 45(D). Thus, in the operation of the folding mechanism 4 in the illustrated embodiment, the left and right folding plates 21, 22, the front folding plate 23 and the rear folding roller 24 all act at right angles to the article M to be wrapped. This differs from the prior-art arrangement, in which the stretchable film is underfolded by a pressing or squeezing action performed by left and right folding plates and a roller serving as the front folding plate. Accordingly, the present invention makes it possible to obtain an attractively wrapped package without producing a large number of wrinkles, creases and folds in the stretchable film. Further, in the event of an emergency stop when the article M turns over or becomes jammed in the equipment, the operator need only press the clutch release button 138 on the control and display panel 121 to release the electromagnetic clutch brakes 113, 115, 117, manually move the various elements constituting the folding mechanism 4, such as the left, right and front folding plates 21, 22 and 23, respectively, and free the jammed article M or the stretchable film. This makes it very easy to return the wrapping machine to the operating state. If reversible motors are used in place of the electromagnetic clutches 113, 115, 117, the recovery operation can be made even easier by restoring the various operating elements automatically, rather than manually, through proper selection of the direction of motor rotation.

As mentioned earlier, the tensioned state of the film that influences the final appearance of the wrapped package is in turn influenced by the dimensions of the cut film and by such dimensions as the length, width and height of the article to be wrapped. The unfortunate result in the case of the conventional wrapping machine is that film tension changes with the size of the article to be wrapped, thereby causing a difference in the final appearance of the wrapped packages. It has been attempted to deal with this problem by adjusting, in dependence upon the length of cut film, the timing at which the left and right edges of the film are clamped. In recent years, however, a wide variety of trays have into common use. These include small trays having a very small length and width, standard trays, large trays, and slender trays which are very small in length in comparison to width (where the length and width of a tray or article are as defined earlier). A constant film tension cannot be achieved merely by adjusting left and right clamping timing in accordance with film length as in the prior art. Furthermore, in the prior art, the cut film length is decided with the tray used serving as a reference, and left and right clamp timing is adjusted based on the cut film length, with absolutely no consideration being given to the condition, namely the height, of the article in the tray. Therefore, even if trays are of the same size, there are cases where film tension from one wrapped article to another is irregular because of the amount or type of contents wrapped.

The present embodiment of the invention is so adapted as to obtain a constant film tension at all times irrespective of the size of the article wrapped. Film tension adjustment for achieving this constant film tension will now be described.

The structure of the wrapping machine of the present invention is such that the wrapping of one article is completed in two cycles. More specifically, in the first half of one cycle (namely the period of time from the start of article infeed by the pusher conveyor 13 to the completion of article infeed onto the elevator bed 17, which period of time corresponds to a count TC of 0 to 15), the article is raised by the elevator bed 17 and the left, right and front edge portions of the cut film are folded under the article by the left, right and front folding plates 21, 22 and 23, respectively. In the latter half of this single cycle (which corresponds to a count TC of 16 to 30), the film in unreeled and feed by the chain conveyors 57, 57' and cut. Accordingly, at the initial cycle, the article to be wrapped waits on the elevator bed 17. At this time the stretchable film cut to a predetermined length is in the extended state at the predetermined position above the elevator bed 17. When, under these conditions, the next article to be wrapped is placed on the weigher 14 of the pusher conveyor 13 and the weigher 14 generates a weight stability signal to initiate the next single cycle, the article on the elevator bed 17 is pushed onto the lateral slider 70 by the discharge pusher 69 in the first half of this current cycle, this occurring following the raising of the article and the underfolding of the left, right and front edge portions of the film. These operations are repeated in successive fashion. Thus, by completing the wrapping of one article through two cycles, processing speed is raised in a case where a wrapping activity is of the continuous type.

Figure 46:
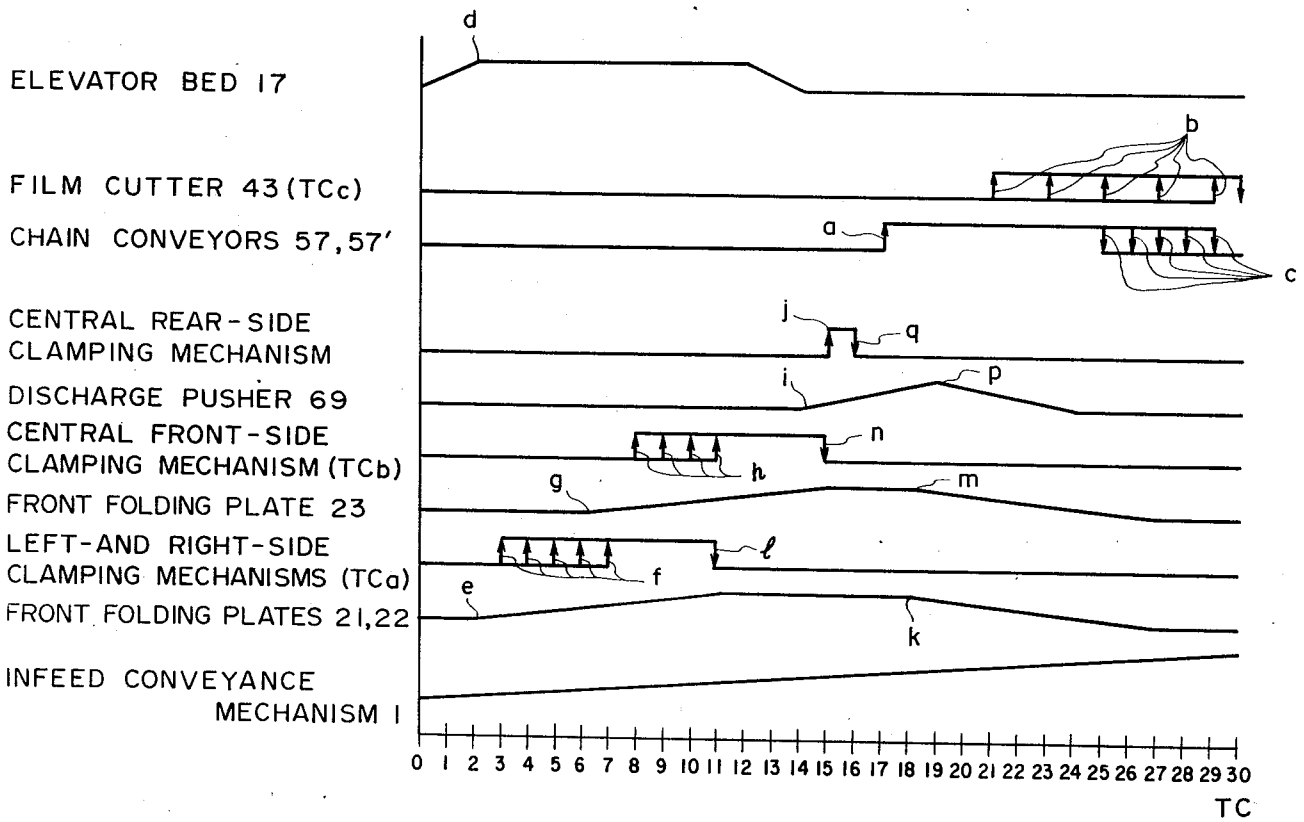
FIG. 46 is a mechanical chart illustrating the operation timing of various elements of the wrapping machine.

Let us describe the foregoing with reference to FIG. 46. In the interval of counted values TC from 16 to 30 of the initial cycle, the film is fed and cut to a length conforming to the article size. Then, in the interval of counted values TC from 1 to 15 of the next cycle, a wrapping operation is performed in response to detection of the next article to be wrapped. First, then, the infeed conveyance mechanism 1 constituted by the pusher conveyor 13 and belt conveyor 15 is started and, when an article so fed in attains a predetermined position on the belt conveyor 15, the width, length and height of the article are sensed in a manner described later. The chain conveyors 57, 57' are started at a predetermined timing (TC=17, as shown at a in FIG. 46) to feed the film. When the film has been fed by an amount equivalent to a predetermined cutting length related to the width and height of the article to be wrapped, the cutter 43 is actuated to cut the film to this predetermined length (b in FIG. 46). Next, the chain conveyors 57, 57' are stopped at a predetermined timing to bring the center of the cut length of film into agreement with the center of the opening 25 (c in FIG. 46). When the feed-in of the next article to be wrapped is sensed under these conditions, the elevator bed 17 starts to be raised at the counted value TC=0 and reaches the uppermost end of its stroke at a predetermined timing (TC=2, as shown at d in FIG. 46). The left and right folding plates 21, 22 start to operate at a predetermined timing (TC=2, as shown at e in FIG. 46), then the left and right movable guide members 65, 67, 65', 67' are actuated at a timing corresponding to the cut length of film to release the left- and right-side clamping mechanisms (f in FIG. 46). The front folding plate 23 starts operating at a predetermined timing (TC=6, as shown at g in FIG. 46), and then the central front movable guide member 66' is actuated at a predetermined timing corresponding to the length of the article sensed earlier, thereby releasing the central front-side clamping mechanism (h in FIG. 46). The discharge pusher 69 starts operating at a predetermined timing (TC=14, as shown at i in FIG. 46), and then the central rear movable guide member 66 is actuated to release the central rear-side clamping mechanism (j in FIG. 46). The left and right folding plates 21, 22, the central front-side clamping mechanism, the front folding plate 23, the central front-side clamping mechanism, the discharge pusher 69 and the central rear-side clamping mechanism start to be restored to their original positions at predetermined timings (i.e., at k, l, m, n, p, q in FIG. 46).

The method described above is one in which the timing for releasing the central front-side clamping mechanism is adjusted upon sensing the length of the article to be wrapped. However, the description would be much the same for a case where the height of the article to be wrapped is sensed and the timings (f and h in FIG. 46) at which the left- and right-side clamping mechanisms and the central front-side clamping mechanism are released are adjusted by taking the height of the article into consideration.

A specific timing adjustment method will now be described.

Figure 48:
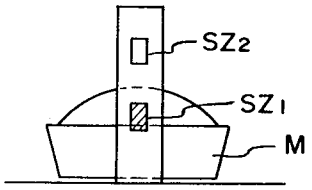
FIG. 48 is a view showing the side arrangement of height sensors.
Figure 49:
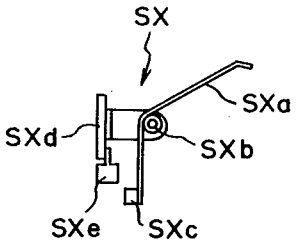
FIG. 49 is a view showing the structure of a width sensor.
Figure 47:
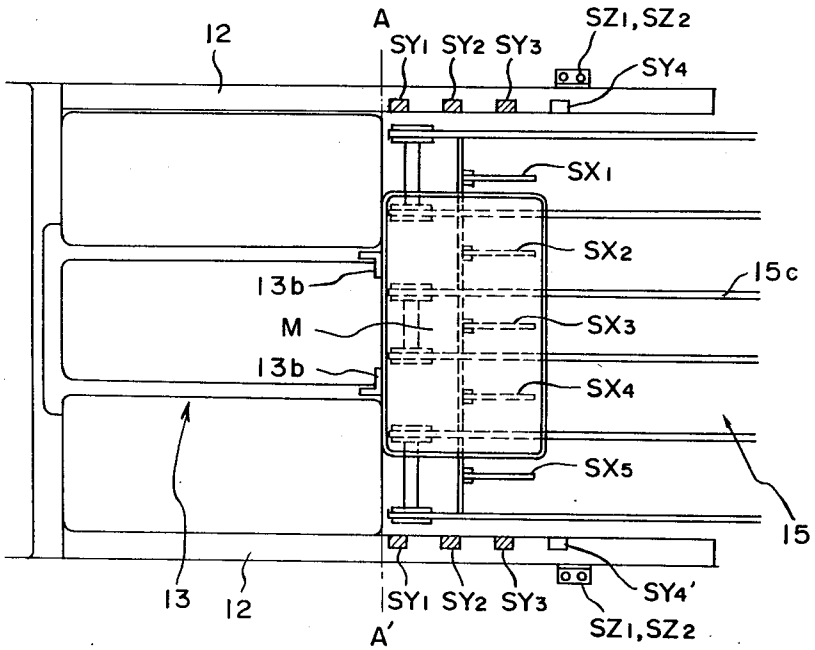
FIG. 47 is a view showing a planar arrangement of sensors constituting a sensing unit for sensing the size of an article to be wrapped.

The article size sensing unit 128 has the construction shown in FIGS. 47 and 48. The sensing unit 128 comprises five sensors SX1–SX5 for sensing the width of an article to be wrapped, four sensors SY1–SY4 for sensing the length of the article, and two sensors SZ1, SZ2 for sensing the height of the article. The sensors SY1–SY4 are arranged a prescribed distance apart on the infeed conveyance frame 12 on both sides of the belt conveyor 15. By way of example, light from the sensors SY1–SY4 on one side is detected by the sesors SY1–SY4 on the opposite side. As shown in FIG. 49, each of the sensors SX1–SX5 is rotatably supported on a shaft SXb as center and comprises a lever SXa biased at all times in the position shown by a spring, a sensing arm SXc provided at the rear end of the lever SXa, a support member SXd supporting the lever SXa, and a sensing element SXe for sensing the proximity of the sensing arm SXc. The width sensors SX1–SX5 of the above-described structure are secured between neighboring ones of the round rubber belts 15*c* in such a manner that the distal end of each lever SXa projects above the belt conveyor 15. The height sensors SZ1, SZ2 are arranged on both sides of the belt conveyor 15, as shown in FIG. 47 and, in an exemplary set-up, light is emitted by the sensors SZ1, SZ2 on one side and detected by the sensors SZ1, SZ2 on the opposite side.

When an article M to be wrapped is pushed to the position of the line A—A' in FIG. 47 by the pusher 13*b* of the push conveyor 13, some of the levers SXa of the width sensors SX1–SX5 are pressed against by the article M, whereby the corresponding sensing element SXe senses the corresponding sensing arm SXc. The width X of the article M to be wrapped is detected based on the number of width sensors SX1–SX5 actuated in this manner. At the same time that width is detected, the length Y of the article M to be wrapped is detected based on the number of length sensors SY1–SY4 actuated. As the article M is advanced further, its height Z is detected based on the number of height sensors SZ1, SZ2 actuated.

As shown in the table of FIG. 50, the heights of articles M to be wrapped are classified into L and H in accordance with the operating states of the sensors SZ1, SZ2. Also, as shown in the table of FIG. 51, film cut lengths Fl are classified into five categories a, b, c, d and e in accordance with the height Z of the article to be wrapped and the width X of the tray. In FIG. 51, the vertically arranged numerals indicate the number of width sensors SX actuated, and the horizontally arranged numerals stand for the number of height sensors SZ actuated. As shown in FIG. 52, articles M to be wrapped are classified into four categories a, b, c and d in accordance with tray length TYl. If the height Z of an article M to be wrapped is L, then, as shown in the tables of FIGS. 53 and 54, left- and right-side clamping mechanism release timing TCa, film cut timing TCc, chain conveyor stop timing TCd and central front clamp release timing TCb are decided based upon film cut length Fl and tray length TYl. If the height Z of an article M to be wrapped is H, then left- and right-side clamping mechanism release timing TCa, film cut timing TCc, chain conveyor stop timing TCd and central front clamp release timing TCb are decided as shown in the tables of FIGS. 55 and 56.

Thus, the tensioned state of the film wrapping an article is adjusted by controlling the actuation of the left and right clamping mechanisms, the central front clamping mechanism and the chain conveyors at the timings illustrated in FIGS. 53 through 56. How the various operating elements of the wrapping machine are controlled at these timings will now be described.

Figure 57:
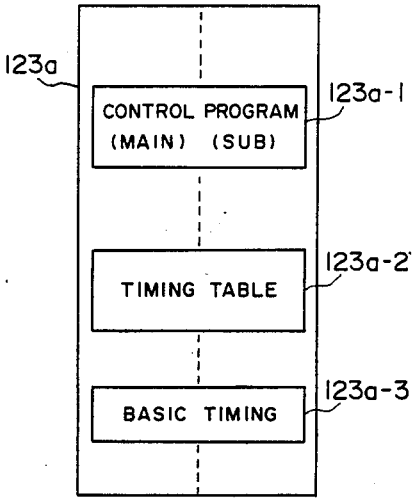
FIG. 57 is a view schematically showing various data storage areas of the ROM for storing a control program, timing table and basic timing.
Figure 58:
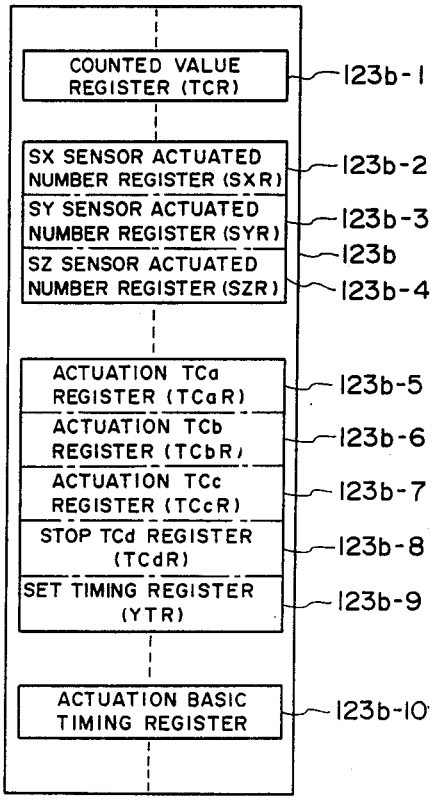
FIG. 58 is a view schematically showing various registers of the RAM.

The memory formats of the ROM 123*a* and RAM 123*b* of memory unit 123 are illustrated in FIGS. 57 and 58, respectively. As shown in FIG. 57, the ROM 123*a* is provided with a control program storage area 123*a*-1, a timing table storage area 123*a*-2 and a basic timing storage area 123*a*-3. The control program storage area 123*a*-1 stores a main routine processing program for performing the main control processing of the wrapping machine, as well as various subroutine processing programs. The timing table storage area 123*a*-2 stores the tables shown in FIGS. 50 through 56. The basic timing storage area 123*a*-2 stores the basic timings of the various wrapping machine operating elements, such as the actuation timings of the left and right folding plates 21, 22, front folding plate 23 and discharge pusher 69 (see e, g, i in FIG. 46). The RAM 123*b* is provided with a counted value register 123*b*-1 for storing the counted value of the timing signal tpa, an SX sensor actuated number register 123*b*-2 for storing a numerical value indicative of the number of width sensors SX actuated, an SY sensor actuated number register 123*b*-3 for storing a numerical value indicative of the number of length sensors SY actuated, an SZ sensor actuated number register 123*b*-4 for storing a numerical value indicative of the number of height sensors SZ actuated, a TCa register 123*b*-5 for storing the timing value TCa at which the left- and right-side clamping machanisms are released, a TCb register 123*b*-6 for storing the timing value TCb at which the central front-side clamping machanism is released, a TCc register 123*b*-7 for storing the timing value TCc at which the cutter is actuated, a TCd register 123*b*-8 for storing the timing value TCd at which the chain conveyor is stopped to halt the cut length of film at the center of the opening 25, a set timing register 123*b*-9 for storing a timing value YT of processing for selecting the timings TCa, TCb, TCc, TCd from the timing table storage area 123*a*-2 and planting these in the registers 123*b*-5 through 123*b*-9 (this value is set to one, e.g., 16, in the period between completion of left, right and front folding and the start of film cutting), and a basic timing register 123*b*-10 for storing the timing at which each of the wrapping machine elements is actuated.

The timing signal tpa from the main timing generator 126 is fed by the input/output control circuit 124 into the central processor 120 as an interrupt signal. The central processor 120 counts the timing signal tpa each time one arrives and stores the resulting counted value TC in the counted value register 123*b*-1 of RAM 123*b*. When the article M to be wrapped is moved by the pusher conveyor 13 to a predetermined position (line A—A' in FIG. 47) on the belt conveyor 15, the width and length of the article M are sensed by the width sensors SX1–SX5 and length sensors SY1–SY4, the number of these sensors actuated in sent from the article size sensing unit 128 to the central processor 120 through the input/output control circuit 124, and the processor stores the number of actuated width sensors SX1–SX5 in the register 123*b*-2 and the number of actuated length sensors SY1–SY4 in the register 123*b*-3. The height of the article M is then sensed by the height sensors SZ1, SZ2, the number of these sensors actuated is sent from the article size sensing unit 128 to the central processor 120, and the processor stores the number of actuated height sensors SZ1, SZ2 in the register 123*b*-4. For a case where the article M has the size shown in FIGS. 47 and 48, "4" is stored in the register 123*b*-2 to indicate the number of SX sensors actuated, "3" is stored in the register 123*b*-3 to indicate the number of SY sensors actuated, and "1" is stored in the register 123*b*-4 to indicate the number of SZ registers actuated. When the value TC in the counted value register 123*b*-1 agrees with the value YT in the set timing register 123*b*-9, the central processor 120 retrieves the timing table area 123*a*-2 of ROM 123*a* from the values stored in the registers 123*b*-2, 123*b*-3 and 123*b*-4, selects the left- and right-clamping mechanism release timing TCa, the central front-side clamping mechanism release timing TCb, the cutter actuating timing TCc and the chain conveyor stop timing TCd, which timings depend upon the width, length and height of the article M to be wrapped, and stores these timings in the TCa register 123*b*-5, TCb register 123*b*-6, TCc register 123*b*-7 and TCd register 123b-8, respectively. If, by way of example, "4", "3" and "1" are stored respectively in the registers 123b-2, 123b-3, 123b-4, as mentioned above, "L" is selected from register 123b-4, "c" is selected from registers 123b-2, 123b-4, and "c" is selected from register 123b-3. As a result, "5" is stored in TCa register 123b-5, "9" is stored in TCb register 123b-6, "25" is stored in TCc register 123b-7, and "27" is stored in TCb register 123b-8. When, under these conditions, the value in the counted value register 123b-1 attains the timing TC=17 (a in FIG. 46) at which the conveyors 57, 57' are actuated and which is stored in the basic timing register 123b-10, the central processor 120 causes the drive circuit 125l to circulate the chain conveyors 57, 57' in order to start film feed. Next, when the value in the counted value register 123b-1 agrees with the value (i.e., TC=25) stored in the TCc register 123b-7, the cutter 43 is actuated through the drive circuit 125k and cutter drive unit 44 to cut the film to a predetermined length (b in FIG. 46). When the value in the counted value register 123b-1 agrees with the value (i.e., TC=27) stored in the TCd register 123b-8, a signal for stopping the chain conveyors 57, 57' is sent to the drive circuit 125l to stop these chain conveyors in order to bring the center of the cut film into coincidence with the center of the opening 25 (c in FIG. 46). When the counted value stored in the counted value register 123b-1 reaches "30" (namely when one cycle ends), the register 123b-1 is reset by a reset signal from the main timing detector 126. Counted values again start being stored in the counted value register 123b-1 with the start of the next cycle. At TC=2, the elevator bed 17 reaches its uppermost position (d in FIG. 46) and the value in the counted value register 123b-1 coincides with the left and right folding plate actuation timing stored in the basic timing register 123b-10, whereupon the left and right folding plates 21, 22 start to be operated through the drive circuit 125c (e in FIG. 46). Next, when the value in the counted value register 123b-1 agrees with the left- and right-side clamping mechanism release timing TCa (TC=5) stored in the TCa register 123b-5 of RAM 123b, a signal is sent to the drive circuit 125f to actuate the left- and right-side movable guide members 65, 65', 67, 67' and release the left- and right-side clamping mechanisms (f in FIG. 46). When the value in the counted value register 123b-1 agrees with the front folding plate actuation timing value (i.e., TC=6) in the basic timing register 123b-10 at about the same time that the left and right clamping mechanisms are released, a signal is sent to the drive circuit 125d to start the operation of the front folding plate 23 (g in FIG. 46). When the value in the counted value register 123b-1 agrees with the central front-side clamping mechanism release timing TC (TC=9) stored in the TCb register 123b-6, a signal is sent to the drive circuit 125g to actuate the central front movable guide member 66' to release the central front-side clamping mechanism (h in FIG. 46). Next, when the value in the counted value register 123b-1 agrees with the discharge pusher actuation timing TC (TC=14), a signal is sent to the drive circuit 125e to start the operation of the discharge pusher 69 (i in FIG. 46). When the value in the counted value register 123b-1 agrees with the central rear-side clamping mechanism release timing TC (TC=15) stored in the basic timing register 123b-10, a signal is sent to the drive circuit 125h to actuate the central rear movable guide member 66 to release the central rear-side clamping mechanism (j in FIG. 46). The foregoing operations are performed by the main routine program and various subroutine programs stored in the control program storage area 123a-1 of ROM 123a.

As set forth hereinabove, timing TCa is set in dependence upon the cut film length and timing TCb is set in dependence upon the length of the article M in a case where the height of the article M is less than a given height (i.e., in a case where Z=L). In other words, tension at left and right underfolding is adjusted based on the cut length of film, and tensioning at front underfolding is performed based on the length of the article M to be folded. In a case where the height of the article M is greater than the given height (i.e., when Z=H), the timings TCa, TCb for the case Z=L are accelerated. Therefore, wrapping can be carried out at a highly stable film tension even for a tray which is very small, a tray whose length is very small in comparison with its width, or a tray whose height is great in comparison with its length and width.

In the above embodiment, the length to which the film is cut is selected based on the width and height of the article to be wrapped and the release timing TCa is set in accordance with the cut film length. However, an arrangement is possible in which the release timing TCa is set in accordance with the width of the article to be wrapped. Further, though the selection will be a rough one, an arrangement can be adopted in which the cut film length itself is selected based solely on the width of the article to be wrapped without taking the height of the article into account.

Furthermore, in the above embodiment, tension adjustment at the left, right and front portions is made by changing the timing TCa (f in FIG. 46) at which the film is released by the left- and right-side clamping mechanisms and the timing (h in FIG. 46) at which the film is released by the central front-side clamping mechanism. However, film tension adjustment is not limited to such an arrangement, for the tensioned state of the film can be adjusted even if timing for film release by the left- and right-side clamping mechanisms and timing for film release by the central front-side clamping mechanism are fixed at respective predetermined values and the operation timings of the left, right and front folding plates 21, 22, 23 are changed. In addition, it is possible to adjust the tensioned state of the film by changing, when necessary, both the left- and right-side clamping mechanism release timing and the operation timing of the left, right and front folding plates 21, 22, 23. In other words, left and right tensioning is decided by the time difference between the start of operation of the left and right folding plates 21, 22 and the film release by the left and right clamping mechanisms, and front tensioning is decided by the time difference between the start of operation of the front folding plate 23 and the film release by the central front-side clamping mechanism. Therefore, a constant film tension can be realized at all times by adjusting these time differences in dependence upon the size of the article to be wrapped.

In the above-described embodiment, the arrangement is such that when the height Z of an article to be wrapped is greater than a given height (i.e., when Z=H), an adjustment is made to shorten the abovementioned time differences in comparison with the case where Z is less than the given height (i.e., when Z=L), thereby to obtain a tension which is the same regardless of whether the article is great or small in height. However, the height Z of the article to be wrapped changes over a range small in comparison with the width X and length Y of the article, and the film itself possesses stretchability. If the wrapping machine is of a simple type, therefore, an adjustment which takes the height of the article into account can be deleted. Even if such is the case, the tension adjustment based on the length of the article is performed solely by the front folding plate according to the wrapping machine of the present invention, so that the tensioned state dependent upon the size of the article is of greater stability than that obtained with the prior-art wrapping machine of this type.

In the above embodiment, the cut film length, which depends upon the width and height of the article to be wrapped, and the operation timings of the operating elements, which depend upon the tray length categories and article height categories, are stored beforehand in table form in ROM 123*a*, and the predetermined timing values are read out of the ROM on the basis of a detection signal indicative of the size of the article to be wrapped. However, an arrangement is also possible wherein the basic timings of the various operating elements are stored beforehand in the ROM 123*a* or RAM 123*b* and the central processor 120 calculates the operation timing of each operating element based on these basic timings and either the size detection signal from the article size sensing unit 128 or a setting signal entered manually from the control panel.

It should be noted that in the tension adjustment described hereinabove, only the tensioned states at left, right and front edge underfolding are taken into account, and no particular adjustment is applied to the tensioned state at rear edge underfolding. The reasons for this are twofold. First, since articles are brought into alignment by the positioning plate 20 with the rear edge serving as a reference, the film underfolds are already defined. Second, since the rear edge underfolding operation is performed in parallel with article discharge after the left, right and front underfolding operations, the tensioned state of the film is virtually decided at the conclusion of the left, right and front underfolding operations. Since it thus appears that rear edge underfolding does not have much influence on tension, a structure can be adopted wherein the left, right and central clamping mechanisms are provided on the front side only, with only a single, undivided clamping mechanism being provided on the rear side.

Figure 59:
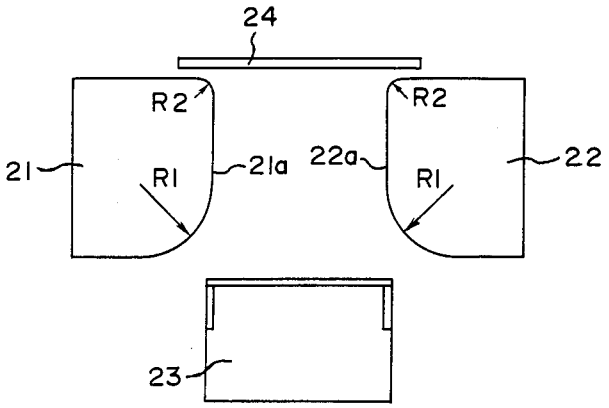
FIG. 59 is a view schematically showing the folding mechanism.

In the film folding mechanism having the structure illustrated in the above embodiment, the rounded corners of the left and right folding plates 21, 22 on the side of the front folding plate 23 have a radius R1 which is greater than the radius R2 of the rounded corners of the left and right folding plates 21, 22 on the side of the rear folding roller 24, and the opposing sides 21*a*, 22*a* of the left and right folding plates 21, 22 are parallel, as shown in FIG. 59. Further, when the wrapped article is fed out, the rear folding roller side serves as a placing reference for the article with relation to the rear underfolding operation. In consequence, when dealing with a variety of trays of different lengths and widths, there are cases where difficulty is experienced in wrapping articles attractively. The reasons for this will now be described.

As mentioned earlier, trays for receiving articles to be wrapped include small trays having a very small length and width, slender trays which are very wide in comparison to length, and large trays having a large length and width. Let us describe a wrapping operation taking a small tray and a slender tray as examples.

Figure 60:
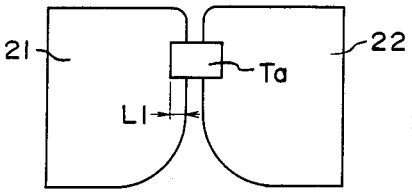
FIGS. 60(A), 60(B), 60(C) are views showing the relation between small, slender and large trays, respectively, and left and right folding plates.
Figure 60:
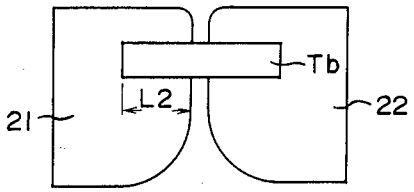
Figure 60:
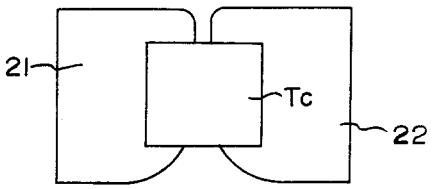

FIGS. 60(A) through 60(C) show the relationship between trays and the positions occupied by the left and right folding plates 21, 22 at the end of an underfolding operation. The opposing sides 21*a*, 22*a* of the folding plates 21, 22 are parallel, as mentioned above, and are of equal widths $l_1$, $l_2$. FIG. 60(A) illustrates the situation for a small tray Ta, FIG. 60(B) for a slender tray Tb, and FIG. 60(C) for a large tray Tc. For the slender tray Tb, the length $L_2$ of the underfold shown in FIG. 60(B) is larger than that of the underfold $L_1$ for the small tray Ta, shown in FIG. 60(A). For the large tray Tc whose length and width both are great, as shown in FIG. 60(C), no particular problem is involved in final package appearance even though the length of the underfold is large. For the slender tray Tb of small length, however, as shown in FIG. 60(B), the excess film on the side of the front folding plate 23 is squeezed excessively at front underfolding owing to the clearance between the left and right folding plates 21, 22. This causes the central portion of the package on the front side thereof to develop a large number of creases and wrinkles, thus detracting from the final appearance of the wrapped package.

Figure 61:
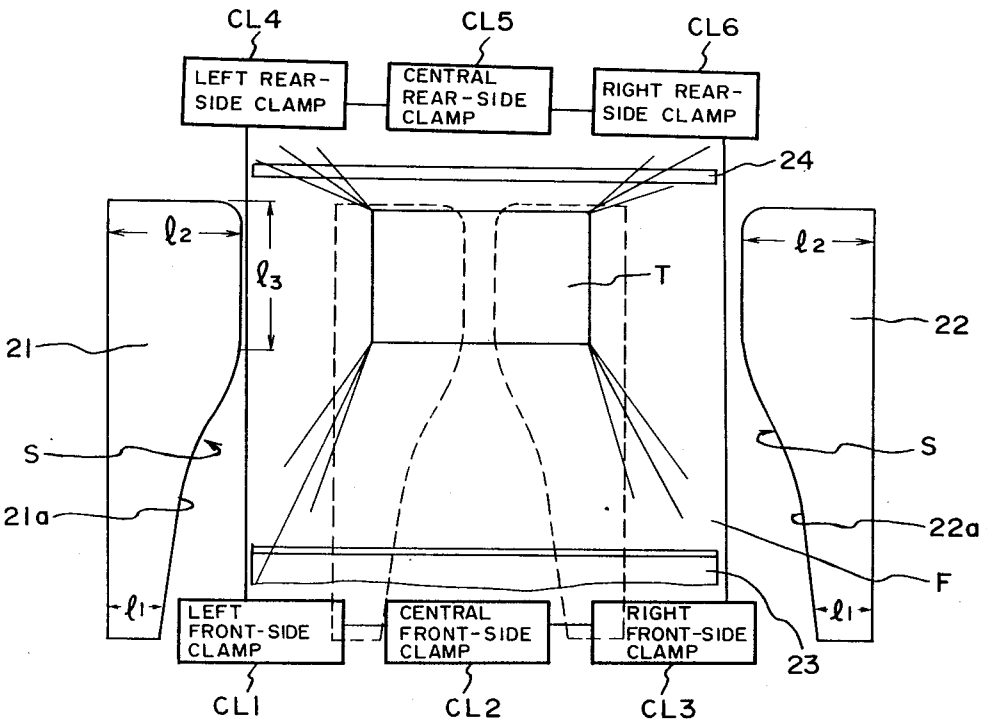
FIG. 61 is a view schematically illustrating another embodimeent of the folding mechanism.

Accordingly, in another embodiment of the present invention, the left and right folding plates 21, 22 are formed as shown in FIG. 61. Specifically, the clearance between the opposing left and right folding plates 21, 22 is formed to have sides which are parallel over a predetermined length $l_3$ on the side of the rear folding roller 24, and to widen gradually toward the side of the front folding plate 23. In other words, the left and right folding plates 21, 22 have a dimension $l_1$ on the side of the front folding plate 23 which is smaller than a dimension $l_2$ of the parallel portions $l_3$ on the side of the rear folding roller 24, whereby a portion S for allowing the escape of the film F is formed on the opposing sides 21*a*, 22*a* of the left and right folding plates. The length $l_3$ of the parallel portions is formed to be approximately the same as the maximum width of the trays to be wrapped.

When the left and right folding plates 21, 22 are advanced horizontally toward a tray T to fold the film F under the bottom of the tray T, the left and right folding plates 21, 22 come to occupy the positions indicated by the dashed lines. At the moment that left and right underfolding ends, the amount of film folded under the tray by the front folding plate 23 is large on the rear side and small on the front side thereof. That is, since the clearance defined by the left and right folding plates 21, 22 is larger on the front side than at the rear side, the amount of film underfolded on the front side is less than that underfolded on the rear side. Accordingly, when the front folding plate 23 is moved toward the tray T under these conditions, the portion of the film F underfolded by the front folding plate 23 is not squeezed excessively. Hence, an attractively wrapped package with few wrinkles and creases can be obtained.

By forming the film escape portion S between the left and right folding plates 21, 22, as described above, the timing at which the plates 21, 22 contact the film on the side of the front folding plate 24 and that at which they contact the film on the side of the rear folding roller 24 at left and right underfolding differ. In other words, contact occurs later on the side of the front folding plate 23 than on the side of the rear folding roller 24. Consequently, if left and right front-side clamping mechanisms CL1, CL3 and left and right rear-side clamping mechanisms CL4, CL6 are operated at the same timing, there are occasions where the tension of the film F differs at the front and back, thus resulting in an unattractively wrapped package. Accordingly, the tension of the film F is adjusted by setting the release timing of the left and right-rear side clamping mechanisms CL4, CL6 to be earlier than that of the left and right front-side clamping mechanisms CL1, CL3.

The above embodiment adopts a method in which the cut length of film is decided automatically upon sensing the width and height of the article to be wrapped. However, it is also possible to adopt a method in which the cut length of film is set manually at the control and display panel 121 in accordance with the size of the tray used. This manual setting method will now be described.

Figure 62:
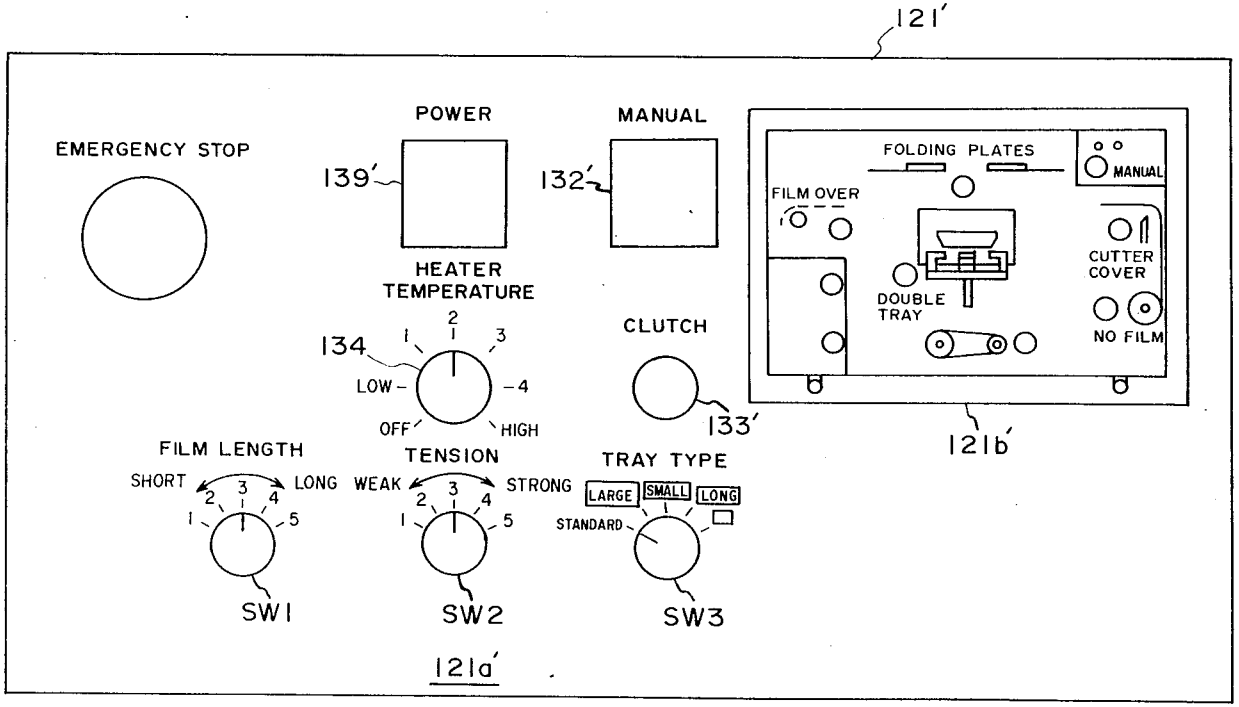
FIG. 62 is a plan view illustrating another embodiment of the control and display panel.

FIG. 62 is a view showing the external appearance of another embodiment of the control and display panel, here designated 121'. The control and display panel 121' is provided with a power switch 139', a manual operation button 132', a tray type changeover switch SW3 for changing the type of tray, a film tension adjustment switch SW2 for adjusting film tension, a film cut-length selection switch SW1 for selecting the cut length of film, a clutch release switch 133' for clutch release, a heater temperature adjustment switch 134', and an emergency stop switch 135', these elements constituting the control panel section 121*a'* (which corresponds to the section 121*a* of FIG. 22). A display section 121*b'* is provided with means for displaying the status of various wrapping machine elements, such as underfolding status, film status and the like. This section corresponds to section 121*b* of FIG. 22.

The tray type changeover switch SW3 is for changing among standard, large, small, slender trays, etc., in accordance with trays categorized by dimensions and shape. The film tension adjustment switch SW2 is for changing over film tension from weak to strong in five stages. Left and right film tension is decided by the operation timing of the left and right grippers at the front and of the left and right grippers at the rear, and tension at the front side of the film is decided by the operation timing of the central grippers at the front. In essence, then, it is the operation timings of the above operating elements that are changed by the switch SW2. The film length selection switch SW1 is for changing over film length from short to long in five stages. Here the arrangement is such that the selection effected by the tray type changeover switch SW3 takes precedence over of the selections made by the film tension adjustment switch SW2 and film length selection switch SW1. In other words, these switches are interrelated and are not adjusted independently of one another. For example, even if the film length selection switch SW1 is set to "3", the actual cut length of the film will differ depending upon whether the tray type changeover swtich SW3 is set to LARGE or SMALL. This point will now be described in detail.

Trays now in common use may be classified broadly into four types, namely standard trays T1, large trays T2, small trays T3 and long (slender) trays T4, as shown in FIG. 63. The standard tray T1 is that most widely employed and includes a wide variety of trays from small to large having a substantially fixed length-to-width ratio. The large tray T2 is a so-called "jumbo" tray of great size having a length-to-width ratio of near unity and is used widely for meat products. The small tray T3 is of very small size, and the long tray T4 is much greater is width than in length (where width and length are as defined earlier). Assuming that the five categories of cut film length in progressively larger order are A, B, C, D and E, cut film length set at the graduations 1, 2, 3, 4 and 5 of the film length selection switch SW1 will be rendered as shown in FIG. 64 by setting the tray type changeover switch SW3 to standard, large, small and long. Further, assume that the five categories of left and right front-side clamping mechanism release timing in progressively slower order are a, b, c, d and e. Then, by setting the tray type changeover switch SW3 to standard, large, small and long, left and right front-side gripper release timing will be rendered as shown in FIG. 65 by setting the film length selection switch SW1 to 1–5 in a case where the film tension adjustment switch SW2 is set to "3".

The reason for thus changing what is indicated by the graduations of the film length selection switch SW1 and film tension adjustment switch SW2 by designating the tray type through use of the tray type changeover switch SW3 is to obtain an attractively wrapped package irrespective of the tray type category.

When the cut film lengths A, B, C, D and E are decided by the tray type changeover switch SW3 and film length selection switch SW1 as shown in FIG. 64, the timing Tm at which the left and right folding plates 21, 22 are actuated is decided as shown in, e.g., FIG. 66, in dependence upon the cut film lengths A, B, C, D and E. The numerical values representative of the operation timing Tm indicate the angle of rotation of the slitted disk 84, namely the count of pulse signals from the main timing detector 126 (where it is assumed that one pulse is produced for every 5° of rotation of the slitted disk 84).

Selection of release timing for the left and right clamping mechanisms on the front side and left and right folding plate operation timing Tm is performed entirely on the basis of the table selected by the ROM 123*a*. The central processor 120 performs a monitoring operation to determine whether the count of pulse signals from the main timing detector 126 has been updated. When the count is updated, the central processor 120 determines whether the count agrees with the individually set timing counts and, when such is the case, executes the particular process.

Figure 67:
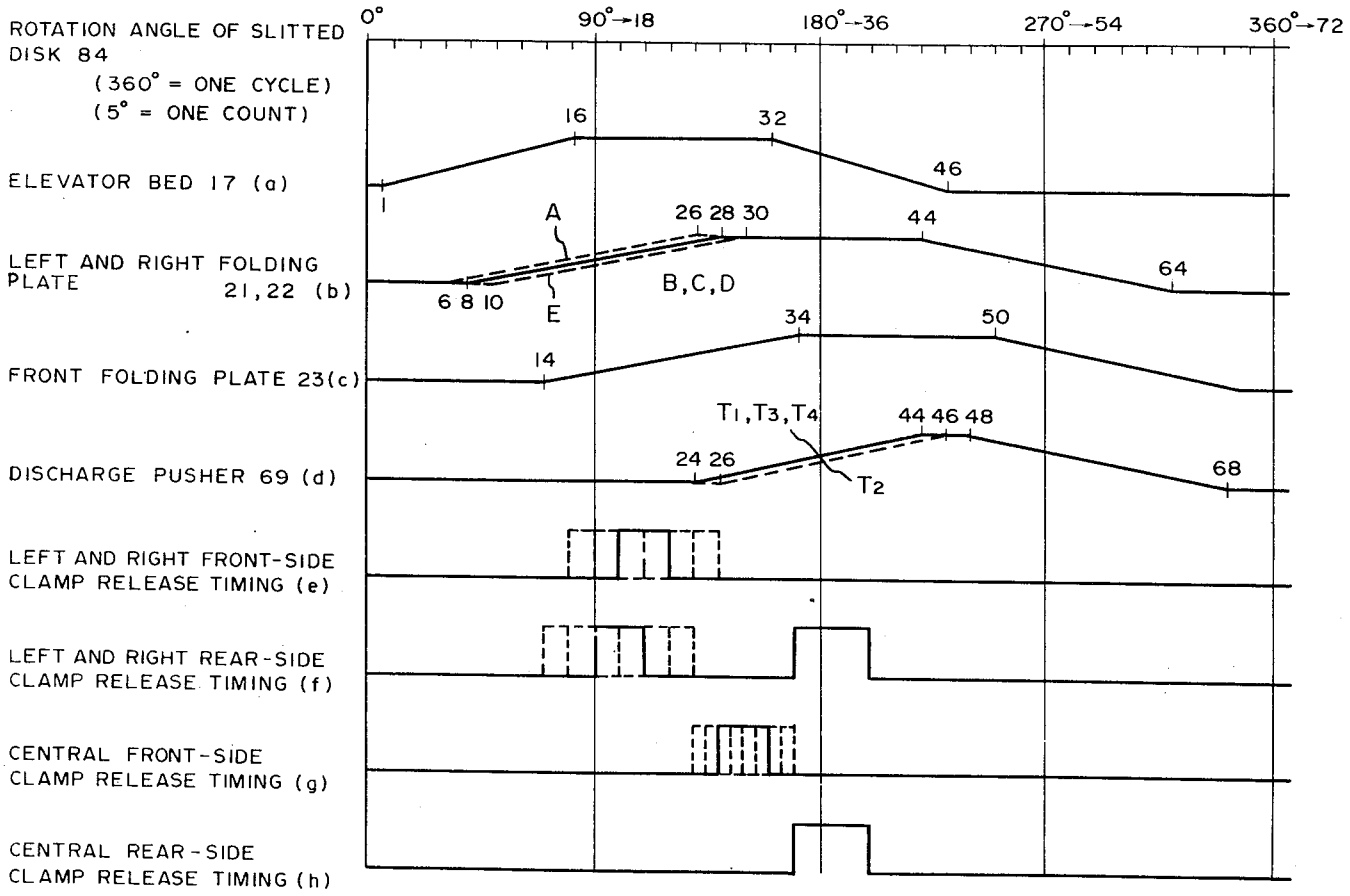
FIG. 67 is a mechanical chart showing the operation timing of various elements of the wrapping machine of the present invention.

FIG. 67 is a mechanical chart illustrating an example of the operation of the various elements constituting the folding mechanism. It is assumed in the Figure that the main timing detector 126 produces one pulse each time the slitted disk 84 rotates by 5°. The elevator bed 17 begins ascending at timing 1, reaches its uppermost position at timing 16, begins descending at timing 32 and reaches its lowermost position at timing 46 [see (a) in FIG. 67]. For a cut film length A (the smallest possible), the left and right folding plates 21, 22 begin advancing at timing 6, finish advancing at timing 26, begin withdrawing at timing 44 and finish withdrawing at timing 64. For cut films lengths B, C and D, however, the left and right folding plates 21, 22 begin advancing at timing 8 and finish advancing at timing 28, and for a cut film length E (the largest possible), the left and right folding plates 21, 22 begin advancing at timing 10 and finish advancing at timing 30 [see (b) in FIG. 67]. Thus, the timing at which the left and right folding plates 21, 22 are actuated is hastened when the cut film length is small and prolonged when the cut film length is large.

For tray categories T1 (standard), T3 (small) and T4 (long), the discharge pusher 69 begins advancing at timing 24, finishes advancing at timing 44, begins withdrawing at timing 48 and finishes withdrawing at timing 68. For tray category T2 (large), the discharge pusher 69 begins advancing at timing 26 and finishes advancing at timing 46 [see (d) in FIG. 67]. Thus, the operation timing of the discharge pusher 69 is changed depending upon the tray category to adjust the tension at the rear side of the film and, hence improve the appearance of the wrapped package. The adjustment of film tension, which influences the final appearance of the wrapped package, is performed by changing the release timings of the left and right clamping mechanisms on the front and rear sides, as indicated by the solid or dashed lines at (e) and (f) of FIG. 67, and the adjustment of film tension on the front side is performed by changing the central clamping mechanism on the front side, as shown in (g) of FIG. 67. Though the tension of the film at the rear side is adjusted by changing the operation timing of the discharge pusher 69, it is also possible to perform this adjustment by changing the operation timing of the central clamping mechanism on the rear side.

Figure 68:
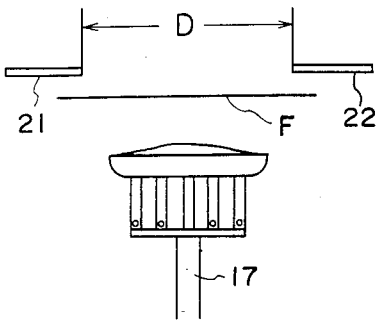
FIGS. 68(A), 68(B) are views schematically illustrating steps for folding a stretchable film on a large-size tray with the folding mechanism of the present embodiment.
Figure 69:
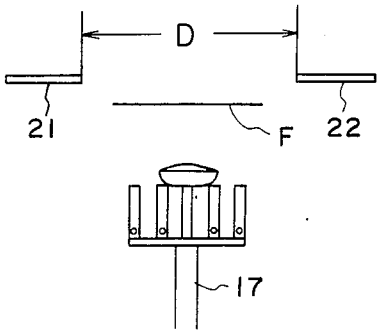
FIGS. 69(A), 69(B) are views schematically illustrating steps for folding a stretchable film on a small-size tray.
Figure 68:
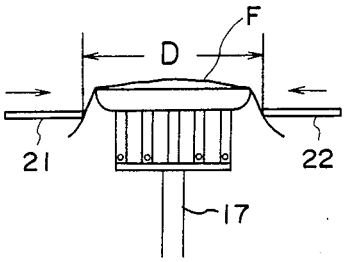
Figure 69:
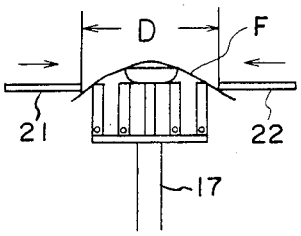

Thus, the operation timing of the left and right folding plates 21, 22 is changed based on the cut length of film, with plates 21, 22 being actuated later for large cut film lengths and earlier for short cut film lengths. The resulting relationship among the film F, left and right folding plates 21, 22 and tray T is as shown in FIGS. 68 and 69. Specifically, for a large length of cut film, the length Fl of the cut film F is greater than the distance D between the left and right folding plates 21, 22, as shown in FIG. 68(A). Therefore, the timing at which the left and right folding plates 21, 22 are actuated is made later so that the left and right edges of the film can be fully engaged by the ends of the folding plates 21, 22 even though the elevator bed 17 is raised to press the tray T into tensioned contact with the film F, as shown in FIG. 68(B). This assures that the film F will be folded smoothly under the bottom of the tray T. For a small length of cut film, the length Fl of the cut film F is smaller than the distance D between the left and right folding plates 21, 22, as shown in FIG. 69(A). However, the timing at which the left and right folding plates 21, 22 are actuated is hastened so that the left and right edges of the film can be fully engaged by the ends of the folding plates 21, 22 even though the elevator bed 17 is raised to press the tray T into tensioned contact with the film F, as shown in FIG. 69(B). This assures that the film F will be folded smoothly under the bottom of the tray T.

As many apparently widely different embodiments of the present invention can be made without departing from the spirit and scope thereof, it is to be understood that the invention is not limited to the specific embodiments thereof except as defined in the appended claims.

What we claim is:

1. A wrapping machine for wrapping an article in a film delivered by a film delivery section and cut to a predetermined length, comprising:

film feeding means for feeding the cut film and extending said cut film at a predetermined position of the wrapping machine;

infeed means for feeding in an article to be wrapped;

lifting means for lifting the article fed in by said infeed means into engaging contact with the extended film so that the article may be wrapped in the film;

discharging means for discharging a wrapped article from the wrapping machine;

said film feeding means having first and second stretching means for clamping two opposite edge portions of the film, said first stretching means stretching the film in the lengthwise direction thereof by applying a predetermined tension thereto in the lengthwise direction as said film is fed to the wrapping machine, said second as said film is fed to the wrapping machine, said second stretching means stretching the film in the widthwise direction thereof by applying a predetermined tension thereto in the widthwise direction as said film is fed to the wrapping machine; as said film is fed to the wrapping machine;

left and right folding plates disposed above the extended film at positions having left-right symmetry with respect to the article feed-in direction for underfolding left and right edge portions of the film covering the article from above;

a front folding plate and a rear folding member disposed at positions perpendicular to said left and right folding plates for underfolding front and rear edge portions of the film;

said left, right and front folding plates and said rear folding member defining a generally rectangular opening;

first sliding means for supporting and moving said left and right folding plates toward the center of the opening;

second sliding means for supporting and moving said front folding plate toward said rear folder member; and drive means for driving said left and right folding plates together with each other and for selectively driving said front folding plate together with or separately from said left and right folding plates.

2. The wrapping machine according to claim 1, wherein said infeed means comprises an infeed conveyor, said discharging means comprises a discharge conveyor, and said infeed conveyor and discharge conveyor are arranged perpendicular to said film feeding means.

3. The wrapping machine according to claim 2, wherein said lifting means comprises an elevator mechanism having an elevator bed, and wherein there is provided positioning means for positioning the infed article to be wrapped above said elevator bed, an outfeed side of the article serving as a reference.

4. The wrapping machine according to claim 1, wherein said left and right folding plates define a gap between opposing sides thereof, said opposing sides being shaped in such a manner that the gap is larger on the side of said front folding plate than on the side of said rear folding member.

5. The wrapping machine according to claim 1, wherein said drive means comprises means for transmitting driving power from a drive source through electromagnetic clutches.

6. The wrapping machine according to claim 1, wherein said drive means comprises reversible motors.

7. The wrapping machine according to claim 1, wherein the film delivery section is operated at a speed lower than a speed at which said film feeding means is operated, whereby said first stretching means applies the predetermined tension to the film in the lengthwise direction.

8. The wrapping machine according to claim 1, wherein said film feeding means has a diverging configuration, whereby said second stretching means applies the predetermined tension to the film in the widthwise direction while the film is clamped at its opposing edge portions and fed by said film feeding means.

9. The wrapping machine according to claim 1 or claim 8, wherein said film feeding means comprises a pair of chain conveyors, a round rubber belt disposed on the outer periphery of each of said chain conveyors, and a plurality of grippers pivotally provided on each of said chain conveyors, the opposing edge portions of the film being clamped between said grippers on one side thereof and said round rubber belts on the other side thereof.

10. The wrapping machine according to claim 9, wherein said grippers constitute a film clamping mechanism with a plurality of movable guide members for opening and closing said grippers and a portion of the extended film.

11. The wrapping machine according to claim 1, further comprising a control unit for controlling the wrapping machine in such a manner that a single article to be wrapped is wrapped in two cycles of operation, said control unit effecting control in such a manner that an article to be wrapped, which has been fed in above said lifting means at a second half of an immediately preceding cycle, is lifted into engaging contact with the extended film and said film is folded under said article by said folding mechanism at a first half of a current cycle, and such that another article to be wrapped is fed in above said lifting means by said infeed means at a second half of the current cycle.

12. The wrapping machine according to claim 1, further comprising a control unit for sensing the size of an article to be wrapped at a first half of an immediately preceding cycle of operation, cutting and feeding the film on the basis of a signal, indicative of the sensed size of said article to be wrapped, at a second half of the immediately preceding cycle of operation, and actuating said folding mechanism at a first half of a current cycle of operation on the basis of a signal indicative the size of the article to be wrapped sensed at the first half of the immediately preceding cycle of operation.

13. The wrapping machine according to claim 1, further comprising a weigher provided at a portion of said infeed means for producing a weight signal indicative of the weight of an article to be wrapped, and labeling means provided at a portion from which a wrapped article is fed out for affixing a label to the wrapped article, said label bearing printed information such as article price based on the weight signal from said weigher.

14. A wrapping machine according to claim 5, wherein said drive means further includes control means for controlling said electromagnetic clutches for driving said left and right folding plates independent of the drive of said front folding plate.

15. A wrapping machine according to claim 6, wherein said drive means further includes control means of controlling said reversible motors for driving said left and right folding plates independent of the drive of said front folding plate.

* * * * *

UNITED STATES PATENT AND TRADEMARK OFFICE

CERTIFICATE OF CORRECTION

PATENT NO. : 4,674,269

DATED : June 23, 1987

INVENTOR(S) : TOSHIO DENDA

It is certified that error appears in the above-identified patent and that said Letters Patent is hereby corrected as shown below:

Column 44, lines 9 and 10, after "machine;" delete "as said film is fed to the wrapping machine;".

Signed and Sealed this

Twenty-ninth Day of March, 1988

*Attest:*

DONALD J. QUIGG

*Attesting Officer*

*Commissioner of Patents and Trademarks*